US007753189B2

(12) United States Patent
Maier et al.

(10) Patent No.: US 7,753,189 B2
(45) Date of Patent: Jul. 13, 2010

(54) CURRENCY PROCESSING DEVICE, METHOD AND SYSTEM

(75) Inventors: Ken W. Maier, North Wales, PA (US); William J. Jones, Barrington, IL (US); Douglas U. Mennie, Barrington, IL (US); Marek Baranowski, Shamong, NJ (US); Yanmei Chen, Aurora, IL (US)

(73) Assignee: Cummins-Allison Corp., Mt. Prospect, IL (US)

( * ) Notice: Subject to any disclaimer, the term of this patent is extended or adjusted under 35 U.S.C. 154(b) by 861 days.

(21) Appl. No.: 11/036,686

(22) Filed: Jan. 14, 2005

(65) Prior Publication Data

US 2005/0183928 A1 Aug. 25, 2005

Related U.S. Application Data

(63) Continuation-in-part of application No. 10/903,745, filed on Jul. 30, 2004.

(60) Provisional application No. 60/492,104, filed on Aug. 1, 2003, provisional application No. 60/580,662, filed on Jun. 17, 2004.

(51) Int. Cl.
*G07F 7/04* (2006.01)
*G07F 9/10* (2006.01)

(52) U.S. Cl. ..... 194/206; 194/344; 194/350; 271/299; 271/185

(58) Field of Classification Search ..... 194/206, 194/350; 271/225, 184, 185, 186, 299, 284, 271/69; 198/793, 798, 799, 801
See application file for complete search history.

(56) References Cited

U.S. PATENT DOCUMENTS 3,362,532 A * 1/1968 Riddle et al. ..... 209/3.1
3,671,035 A * 6/1972 Reist ..... 271/202
3,972,520 A * 8/1976 McKeefry ..... 270/52.11
3,976,198 A * 8/1976 Carnes et al. ..... 209/534

(Continued)

FOREIGN PATENT DOCUMENTS

EP 1139303 A2 3/2001

(Continued)

OTHER PUBLICATIONS

International Search Report dated Jun. 7, 2006.

(Continued)

*Primary Examiner*—Patrick Mackey
*Assistant Examiner*—Mark Beauchaine
(74) *Attorney, Agent, or Firm*—Nixon Peabody LLP

(57) ABSTRACT

According to one embodiment of the present invention, a currency processing device for receiving and processing a stack of currency bills is described. The currency processing device comprises an input receptacle for receiving a stack of bills to be processed, a plurality of output receptacles for receiving bills after the bills have been processed, a transport mechanism for transporting the bills from the input receptacle to the output receptacles, and a discriminating unit for examining the bills. The output receptacles are arranged such that a center of at least one output receptacle is laterally offset from a center of the input receptacle. The discriminating unit includes a detector positioned between the input receptacle and the output receptacles and is adapted to determine the denomination of bills.

21 Claims, 52 Drawing Sheets

U.S. PATENT DOCUMENTS

| | | | | | |
|---|---|---|---|---|---|
| 4,025,420 | A | | 5/1977 | Horino | 209/74 |
| 4,744,468 | A | * | 5/1988 | Goi et al. | 209/534 |
| 4,787,518 | A | | 11/1988 | Yuge et al. | |
| 5,163,672 | A | | 11/1992 | Mennie | 271/187 |
| 5,207,788 | A | | 5/1993 | Geib | 271/122 |
| 5,295,196 | A | | 3/1994 | Raterman et al. | 382/7 |
| 5,310,062 | A | | 5/1994 | Stevens et al. | 209/584 |
| 5,390,910 | A | | 2/1995 | Mandel et al. | 271/296 |
| 5,467,405 | A | | 11/1995 | Raterman et al. | 382/135 |
| 5,467,406 | A | | 11/1995 | Graves et al. | 382/135 |
| D369,984 | S | | 5/1996 | Larsen | D10/97 |
| 5,564,544 | A | * | 10/1996 | Takemoto et al. | 194/206 |
| 5,633,949 | A | | 5/1997 | Graves et al. | 382/135 |
| 5,640,463 | A | | 6/1997 | Csulits | 382/135 |
| 5,652,802 | A | | 7/1997 | Graves et al. | 382/135 |
| 5,687,963 | A | | 11/1997 | Mennie | 271/119 |
| 5,692,067 | A | | 11/1997 | Raterman et al. | 382/135 |
| 5,704,491 | A | | 1/1998 | Graves | 209/534 |
| 5,724,438 | A | | 3/1998 | Graves | 382/135 |
| 5,740,897 | A | * | 4/1998 | Gauselmann | 194/206 |
| 5,751,840 | A | | 5/1998 | Raterman et al. | 382/135 |
| 5,790,693 | A | | 8/1998 | Graves et al. | 382/135 |
| 5,790,697 | A | | 8/1998 | Munro et al. | 382/135 |
| 5,806,650 | A | | 9/1998 | Mennie et al. | 194/206 |
| 5,815,592 | A | | 9/1998 | Mennie et al. | 382/135 |
| 5,822,448 | A | | 10/1998 | Graves et al. | 382/135 |
| 5,832,104 | A | | 11/1998 | Graves et al. | 382/135 |
| 5,867,589 | A | | 2/1999 | Graves et al. | 382/135 |
| 5,870,487 | A | | 2/1999 | Graves et al. | 382/135 |
| 5,875,259 | A | | 2/1999 | Mennie et al. | 382/135 |
| 5,905,810 | A | | 5/1999 | Jones et al. | 382/135 |
| 5,909,502 | A | | 6/1999 | Mazur | 382/135 |
| 5,909,503 | A | | 6/1999 | Graves et al. | 382/135 |
| 5,912,982 | A | | 6/1999 | Munro et al. | 382/135 |
| 5,938,044 | A | | 8/1999 | Weggesser | 209/534 |
| 5,940,623 | A | | 8/1999 | Watts et al. | 395/712 |
| 5,943,655 | A | | 8/1999 | Jacobsen | 705/30 |
| 5,960,103 | A | | 9/1999 | Graves et al. | 382/135 |
| 5,966,456 | A | | 10/1999 | Jones et al. | 382/135 |
| 5,982,918 | A | | 11/1999 | Mennie et al. | 382/135 |
| 5,992,601 | A | | 11/1999 | Mennie et al. | 194/207 |
| 6,003,761 | A | | 12/1999 | Chapman | |
| 6,012,565 | A | | 1/2000 | Mazur | 194/207 |
| 6,021,883 | A | | 2/2000 | Casanova et al. | 194/217 |
| 6,026,175 | A | | 2/2000 | Munro et al. | 382/135 |
| 6,028,951 | A | | 2/2000 | Raterman et al. | 382/135 |
| 6,039,645 | A | | 3/2000 | Mazur | 453/10 |
| 6,068,194 | A | | 5/2000 | Mazur | 235/492 |
| 6,072,896 | A | | 6/2000 | Graves et al. | 382/135 |
| 6,073,744 | A | | 6/2000 | Raterman et al. | 194/207 |
| 6,074,334 | A | | 6/2000 | Mennie et al. | 493/438 |
| 6,128,402 | A | | 10/2000 | Jones et al. | 382/135 |
| 6,220,419 | B1 | | 4/2001 | Mennie | 194/207 |
| 6,237,739 | B1 | | 5/2001 | Mazur et al. | 194/207 |
| 6,241,069 | B1 | | 6/2001 | Mazur et al. | 194/207 |
| 6,256,407 | B1 | | 7/2001 | Mennie et al. | 382/135 |
| 6,278,795 | B1 | | 8/2001 | Anderson et al. | 382/135 |
| 6,311,819 | B1 | * | 11/2001 | Stromme et al. | 194/207 |
| 6,318,537 | B1 | | 11/2001 | Jones et al. | 194/346 |
| 6,328,166 | B1 | * | 12/2001 | Sakai | 209/534 |
| 6,351,551 | B1 | | 2/2002 | Munro et al. | 382/135 |
| 6,363,164 | B1 | | 3/2002 | Jones et al. | 382/135 |
| 6,371,303 | B1 | | 4/2002 | Klein et al. | 209/534 |
| 6,378,683 | B2 | | 4/2002 | Mennie | 194/207 |
| 6,381,354 | B1 | | 4/2002 | Mennie et al. | 382/135 |
| 6,398,000 | B1 | | 6/2002 | Jenrick et al. | 194/200 |
| 6,439,395 | B1 | | 8/2002 | Voellmer et al. | 209/534 |
| 6,459,806 | B1 | | 10/2002 | Raterman et al. | 382/135 |
| 6,460,705 | B1 | | 10/2002 | Hallowell | 209/534 |
| 6,493,461 | B1 | | 12/2002 | Mennie et al. | 382/135 |
| 6,539,104 | B1 | | 3/2003 | Raterman et al. | 382/135 |
| 6,560,355 | B2 | | 5/2003 | Graves et al. | 382/135 |
| 6,588,569 | B1 | | 7/2003 | Jenrick et al. | 194/206 |
| 6,601,687 | B1 | | 8/2003 | Jenrick et al. | 194/206 |
| 6,603,872 | B2 | | 8/2003 | Jones et al. | 382/135 |
| 6,621,919 | B2 | | 9/2003 | Mennie et al. | 382/135 |
| 6,628,816 | B2 | | 9/2003 | Mennie et al. | 382/135 |
| 6,636,624 | B2 | | 10/2003 | Raterman et al. | 382/135 |
| 6,647,136 | B2 | | 11/2003 | Jones et al. | 382/137 |
| 6,650,767 | B2 | | 11/2003 | Jones et al. | 382/135 |
| 6,654,486 | B2 | | 11/2003 | Jones et al. | 382/135 |
| 6,659,258 | B2 | * | 12/2003 | Otsuka | 194/206 |
| 6,661,910 | B2 | | 12/2003 | Jones et al. | 382/135 |
| 6,665,431 | B2 | | 12/2003 | Jones et al. | 382/135 |
| 6,676,127 | B2 | * | 1/2004 | Johnson et al. | 273/149 R |
| 6,678,401 | B2 | | 1/2004 | Jones et al. | 382/135 |
| 6,678,402 | B2 | | 1/2004 | Jones et al. | 382/135 |
| 6,705,470 | B2 | | 3/2004 | Klein et al. | 209/534 |
| 6,721,442 | B1 | | 4/2004 | Mennie et al. | 382/135 |
| 6,724,926 | B2 | | 4/2004 | Jones et al. | 382/135 |
| 6,724,927 | B2 | | 4/2004 | Jones et al. | 382/135 |
| 6,731,785 | B1 | | 5/2004 | Mennie et al. | 382/135 |
| 6,731,786 | B2 | | 5/2004 | Jones et al. | 382/135 |
| 6,748,101 | B1 | | 6/2004 | Jones et al. | 382/135 |
| 6,772,886 | B2 | * | 8/2004 | Werner et al. | 209/534 |
| 6,778,693 | B2 | | 8/2004 | Munro et al. | 382/136 |
| 6,798,899 | B2 | | 9/2004 | Mennie et al. | 271/10.09 |
| 6,810,137 | B2 | | 10/2004 | Jones et al. | 382/137 |
| 6,811,016 | B2 | * | 11/2004 | Blair | 194/206 |
| 6,896,116 | B2 | * | 5/2005 | Deaville et al. | 194/206 |
| 7,219,083 | B2 | * | 5/2007 | Bellucci et al. | 705/43 |
| 2001/0015311 | A1 | | 8/2001 | Mennie | 194/302 |
| 2001/0035603 | A1 | | 11/2001 | Graves et al. | 271/265.01 |
| 2002/0020603 | A1 | | 2/2002 | Jones et al. | 194/346 |
| 2002/0056605 | A1 | | 5/2002 | Mazur et al. | 194/207 |
| 2002/0085745 | A1 | | 7/2002 | Jones et al. | 382/135 |
| 2002/0126885 | A1 | | 9/2002 | Mennie et al. | 382/135 |
| 2002/0145035 | A1 | | 10/2002 | Jones | 235/379 |
| 2002/0154806 | A1 | | 10/2002 | Jones et al. | 382/135 |
| 2003/0009420 | A1 | | 1/2003 | Jones | 705/39 |
| 2003/0015395 | A1 | | 1/2003 | Hallowell et al. | 194/206 |
| 2003/0015396 | A1 | | 1/2003 | Mennie | 194/206 |
| 2003/0059098 | A1 | | 3/2003 | Jones et al. | 382/135 |
| 2003/0062242 | A1 | | 4/2003 | Hallowell et al. | 194/302 |
| 2003/0081824 | A1 | | 5/2003 | Mennie et al. | 382/135 |
| 2003/0108233 | A1 | | 6/2003 | Raterman et al. | 382/135 |
| 2003/0121752 | A1 | | 7/2003 | Stromme et al. | 194/207 |
| 2003/0121753 | A1 | | 7/2003 | Stromme et al. | 194/207 |
| 2003/0132281 | A1 | | 7/2003 | Jones et al. | 235/379 |
| 2003/0139994 | A1 | | 7/2003 | Jones | 705/36 |
| 2003/0168308 | A1 | | 9/2003 | Maier et al. | 194/207 |
| 2003/0174874 | A1 | | 9/2003 | Raterman et al. | 382/135 |
| 2003/0182217 | A1 | | 9/2003 | Chiles | 705/35 |
| 2003/0198373 | A1 | | 10/2003 | Raterman et al. | 382/135 |
| 2003/0202690 | A1 | | 10/2003 | Jones et al. | 382/139 |
| 2004/0003980 | A1 | | 1/2004 | Hallowell et al. | 194/206 |
| 2004/0016621 | A1 | | 1/2004 | Jenrick et al. | 194/206 |
| 2004/0016797 | A1 | | 1/2004 | Jones et al. | 235/379 |
| 2004/0028266 | A1 | | 2/2004 | Jones et al. | 382/135 |
| 2004/0083149 | A1 | | 4/2004 | Jones | 705/35 |
| 2004/0145726 | A1 | | 7/2004 | Csulits et al. | 356/71 |
| 2004/0149538 | A1 | | 8/2004 | Sakowski | 194/207 |
| 2004/0153408 | A1 | | 8/2004 | Jones et al. | 705/43 |
| 2004/0154964 | A1 | | 8/2004 | Jones | 209/534 |
| 2004/0164483 | A1 | | 8/2004 | Focke et al. | 271/264 |
| 2004/0251110 | A1 | | 12/2004 | Jenrick et al. | |
| 2005/0183928 | A1 | | 8/2005 | Jones et al. | 194/206 |

FOREIGN PATENT DOCUMENTS

| | | |
|---|---|---|
| WO | WO 91/11778 | 8/1991 |
| WO | WO 92/17394 | 10/1992 |
| WO | WO 93/23824 | 11/1993 |
| WO | WO 95/24691 | 9/1995 |

| | | |
|---|---|---|
| WO | WO 96/10800 | 4/1996 |
| WO | WO 96/36933 | 11/1996 |
| WO | WO 97/30422 | 8/1997 |
| WO | WO 97/43734 | 11/1997 |
| WO | WO 97/45810 | 12/1997 |
| WO | WO 98/12662 | 3/1998 |
| WO | WO 98/13785 | 4/1998 |
| WO | WO 98/24052 | 6/1998 |
| WO | WO 98/24067 | 6/1998 |
| WO | WO 98/35323 | 8/1998 |
| WO | WO 98/40839 | 9/1998 |
| WO | WO 98/47100 | 10/1998 |
| WO | WO 98/50892 | 11/1998 |
| WO | WO 98/59323 | 12/1998 |
| WO | WO 99/09511 | 2/1999 |
| WO | WO 99/14668 | 3/1999 |
| WO | WO 99/23601 | 5/1999 |
| WO | WO 99/41695 | 8/1999 |
| WO | WO 99/48040 | 9/1999 |
| WO | WO 99/48042 | 9/1999 |
| WO | WO 00/24572 | 5/2000 |
| WO | WO 01/08108 | 2/2001 |
| WO | WO 01/62650 A1 | 5/2001 |
| WO | WO 01/59685 | 8/2001 |
| WO | WO 01/59723 | 8/2001 |
| WO | WO 02/29735 | 4/2002 |
| WO | WO 02/054360 | 7/2002 |
| WO | WO 03/005312 | 1/2003 |
| WO | WO 03/028361 | 4/2003 |
| WO | WO 03/029913 | 4/2003 |
| WO | WO 03/030113 | 4/2003 |
| WO | WO 03/067532 | 8/2003 |
| WO | WO 03/107282 | 12/2003 |
| WO | WO 2004/010367 | 1/2004 |
| WO | WO 2004/027717 | 4/2004 |
| WO | WO 2004/036508 | 4/2004 |
| WO | WO 2004/038631 | 5/2004 |
| WO | WO 2004/068422 | 8/2004 |

OTHER PUBLICATIONS

Search Report for PCT/US2004/025359 [WO 2005/013209] which claims priority to U.S. Appl. No. 60/492,104 and U.S. Appl. No. 60/580,662 (May 12, 2005).
Int'l Preliminary Report on Patentability for PCT/US2004/025359 [WO 2005/013209] which claims priority to U.S. Appl. No. 60/492,104 and 60/580,662 (Feb. 16, 2006).
Search Report for PCT/US2006/000670 [WO 2006/076289] which claims priority to U.S. Appl. No. 11/036,686 (May 22, 2006).
Written Opinion for PCT/US2006/000670 [WO 2006/076289] which claims priority to U.S. Appl. No. 11/036,686 (Oct. 19, 2006).
Notification re republication for PCT/US2006/000670 [WO 2006/076289] which claims priority to U.S. Appl. No. 11/036,686 (Feb. 8, 2007).
Int'l Preliminary Report on Patentability for PCT/US2006/000670 [WO 2006/076289] which claims priority to U.S. 11/036,686 (Jul. 26, 2007).
Communication pursuant to Article 96(2) [Examination Report] for EP 04 780 228.5 corresponding to PCT/US2004/025359 [WO 2005/013209] which claims priority to U.S. Appl. No. 60/492,104 and 60/580,662 (Dec. 21, 2006).
Response to Communication pursuant to Article 96(2) [Examination Report] dated Dec. 21, 2006 for EP 04 780 228.5 corresponding to PCT/US2004/025359 [WO 2005/013209] which claims priority to U.S. Appl. No. 60/492,104 and 60/580,662 (Apr. 26, 2007).
Communication pursuant to Article 96(2) [Examination Report] for EP 04 780 228.5 corresponding to PCT/US2004/025359 [WO 2005/013209] which claims priority to U.S. 60/492,104 and U.S. Appl. No. 60/580,662 (Jun. 5, 2007).
Response to Communication pursuant to Article 96(2) [Examination Report] dated Jun. 5, 2007 for EP 04 780 228.5 corresponding to PCT/US2004/025359 [WO 2005/013209] which claims priority to U.S. Appl. No. 60/492,104 and U.S. Appl. No. 60/580,662 (Oct. 5, 2007).
Search Report for EP08161715.
Office Action Dated Feb. 18, 2009; from U.S. Appl. No. 11/809,621; 12 pages.
BARS 5600 Currency Sorter, 6 pages (est. prior to Aug. 12, 2003).
BARS 6000 Single Note Inspection System, 6 pages (est. prior to Aug. 12, 2003).
BARS 5000 Currency Sorter, 6 pages (est. prior to Aug. 12, 2003).
BEB Webpages Cashcat Desktop Banknote Processing System, 4 pages (Apr. 2002).
Cummins JetScan MPS Brochure (023-01614), 2 pages (Nov. 2000).
Cummins JetScan MPS Model 4101—Operating Instructions, 152 pages (Jun. 2001).
Cummins JetScan MPS Models 4102 and 4103 (023-1639), 1 page (Sep. 2001).
Cummins JetScan MPS Bar Coded Ticket Processing Brochure (023-1655 Rev 1), 2 pages (Sep. 2002).
Cummins JetScan MPS Model 4200 Brochure (023-1674), 2 pages (Jun. 2003).
Cummins JetScan MPS Model 4100 Brochure (023-1661), 8 pages (Jun. 2003).
Currency System International Webpages—Cash Cat Desktop Sorter, 2 pages (Oct. 1999).
Currency System International Cobra Banknote Sorter, 4 pages (copyright 2001).
Currency System International Description of Currency Discriminators, 2 pages (date uncertain, believed to be prior to Mar. 7, 1995).
Currency System International Currency Processing System CPS 300, 4 pages (copyright 1992).
Currency System International Webpages CPS 300-600, 4 pages (Oct. 1999).
Currency System International Description of CSI CPS 600 and CPS 900 devices, 1 page (date estimated 1994).
Currency Systems International Medium Speed Currency Sorting Family CPS 600 and CPS 900, 4 pages (copyright 1994).
Currency System International Webpages—CPS 900, 4 pages (Oct. 1999).
Currency System International Webpages—CPS 1200-1500-1800, 4 pages (Oct. 1999).
Currency System International CPS 1200, 4 pages (copyright 1992).
Currency System International Mr. W. Kranister in Conversation with Richard Haycock, 5 pages (est. 1994).
De La Rue Systems the Processing of Money and Documents, 4 pages (1987).
De La Rue 3100 Serie L Internationale des Machines a trier les Billets, 4 pages (copyright 1989) (French).
De La Rue Cash Systems 2800 VB Currency Counting Machine brochure, 2 pages (copyright 2000).
De La Rue Cash Systems 3700e—The Worlds Leading Note Sorter, 6 pages (est. prior to Apr. 9, 2003).
De La Rue Systems 900 Series High Speed Document Reader Sorters, 8 pages (1980).
De Le Rue Webpages—Cobra Note Sorter, 2 pages (Apr. 2002).
De La Rue Inter Innovation Innomat, 3 pages (Apr. 1996).
G & D BPS 200 Desktop Banknote Processing System, 10 pages (Mar. 1999).
G & D BPS 500 Desktop Banknote Processing System, 4 pages (Mar. 1998).
G & D BPS 1000 Banknote Processing System with Bundler, 2 pages (Feb. 1998).
G & D Numeron—Desktop Machine for Banknote processing, 4 pages (Mar. 2002).
Glory GSA 500 Sortmaster brochure, 4 pages (est. Jan. 14, 1994).
Glory GSA 500 Sortmaster brochure, 2 pages (est. Jan. 14, 1994).
Glory Sale of Glory GSA 500 Sortmaster, 1 page (1986).
Glory GSA 500 Instruction Manual, 40 pages (prior to Jul. 1998).
Glory GSA 500 Operating Procedures, 9 pages (prior to Jul. 1998).
Glory UW-100 Compact Currency Fitness Sorter, 2 pages (copyright 1999).
Glory UW-200 Multi-Purpose Compact Currency Sorter, 4 pages (copyright 1999).

Mosler Toshiba Model CS 6600 Optical Currency Counter Sorter, 4 pages (1985).
Mosler Toshiba Model CS 6600 Optical Currency Counter Sorter, 4 pages (1992).
Mosler Toshiba Model CS 6600 Currency Handler brochure Let Mosler Help You Cut Costs Four Ways, 4 pages (1993).
Mosler-Toshiba TouchSort Currency Processing System from wwwmoslercom, 3 pages (Jun. 28, 2002).
Toshiba CS 601 and CS 700 All in one pass product information printed from website, 6 pages (Jun. 28, 2002).

* cited by examiner

CURRENCY PROCESSING DEVICE, METHOD AND SYSTEM

CROSS-REFERENCE TO RELATED APPLICATIONS

This application is a continuation-in-part application of U.S. patent application Ser. No. 10/903,745, entitled "Currency Processing Device, Method And System" which was filed Jul. 30, 2004; U.S. patent application Ser. No. 10/903,745 claims priority to U.S. Provisional Patent Application Ser. No. 60/492,104, entitled "Currency Processing Device, Method And System" which was filed on Aug. 1, 2003 and U.S. Provisional Patent Application Ser. No. 60/580,662, entitled "Method And System For A Document Processing Device Utilizing Imaging" which was filed on Jun. 17, 2004, all of the above applications are incorporated herein by reference in their entirety.

FIELD OF THE INVENTION

The present invention relates to currency bill processing. Specifically, the present invention relates to an apparatus for currency bill denominating, authenticating, imaging and/or sorting.

BACKGROUND OF THE INVENTION

A variety of techniques and apparatus have been used in automated or semi-automated currency handling systems. Many of these systems have been very large—too large for the operator to be close to the input receptacle, operating panel, and output receptacles while remaining in one position. Therefore, a need exists for a system that is more compact so that the operator can be in close proximity to the input receptacle, output receptacle, and operating panel while remaining in one position.

Previous attempts to solve this problem have focused on stacking output receptacles in one of two ways; vertically stacking output receptacles relative to the input receptacle, or horizontally stacking output receptacles relative to the input receptacle. The problem these machines faced is that after a few output receptacles are arranged in a vertical manner, the system is too tall for the operator to use while sitting down. The systems arranging the output receptacles horizontally became too wide to use while seated or standing in one position.

Additionally, the existing systems for sorting currency have been expensive. Accordingly, there is a need for a currency sorter which is more affordable.

SUMMARY OF THE INVENTION

In some embodiments, a compact multi-pocket sorter for receiving a stack of currency bills and rapidly evaluating all the bills in the stack is provided. The device has an input receptacle for receiving a stack of bills to be evaluated and a number of output receptacles for receiving the bills after the bills have been evaluated. A transport mechanism transports bills, one at a time, from the input receptacle along a transport path to one of the output receptacles. A discriminating unit evaluates the bills, determining certain information concerning the bills. In some embodiments, at least one output receptacle is located to the left of the input receptacle and at least one output receptacle is located to the right of the input receptacle. Arranging the output receptacles on both the right and left of the input receptacle allows the output receptacles to be located in closer proximity to the input receptacle.

In some embodiments, a compact multi-pocket sorter for receiving a stack of currency bills and rapidly evaluating all the bills in the stack is provided. The device has an input receptacle for receiving a stack of bills to be evaluated and a number of output receptacles for receiving the bills after the bills have been evaluated. A transport mechanism transports bills, one at a time, from the input receptacle along a transport path to one of the output receptacles. A discriminating unit evaluates the bills, determining certain information concerning the bills. In some embodiments, at least one output receptacle is located to the left or right side of the input receptacle. The transport mechanism is adapted to transport bills from the input receptacle to the output receptacle located to the left or right side of the input receptacle in a manner such that the leading edge of a bill is maintained throughout the transportation of the bill.

The present invention relates, in general, to document processing devices. In some embodiments, a currency processing device for receiving and evaluating a stack of currency bills is provided. The currency processing device comprises an input receptacle for receiving a stack of bills to be evaluated, a plurality of output receptacles for receiving bills after the bills have been evaluated laterally offset from said input receptacle, an imager for capturing an image of each bill, the captured image being used for at least one of authenticating, counting, and determining the denomination of the bills, a first bill rotating mechanism for rotating the currency bills around an axis passing through the leading and trailing edges of the currency bills and orthogonal to the those edges, and a second bill rotating mechanism for rotating the currency bills around an axis passing through the leading and trailing edges of the currency bills and orthogonal to those edges so that the leading edge of a currency bill is aligned with said output receptacles.

In some embodiments, a method of processing currency bills is provided. In some embodiments, the method comprises moving currency bills from a stack of bills placed in an input receptacle to a plurality of output receptacles laterally offset from said input receptacle, capturing an image of at least one surface of the currency bills, creating a control signal based on the captured image of the currency bills, rotating the bills 90° around an axis extending orthogonally through the leading and trailing edges of the bills, and moving the rotated bills laterally toward one of said plurality of output receptacles based on the control signal.

The above summary describes some exemplary embodiments and is not intended to and does not describe all embodiments.

DETAILED DESCRIPTION OF THE ILLUSTRATED EMBODIMENTS

Figure 1A:
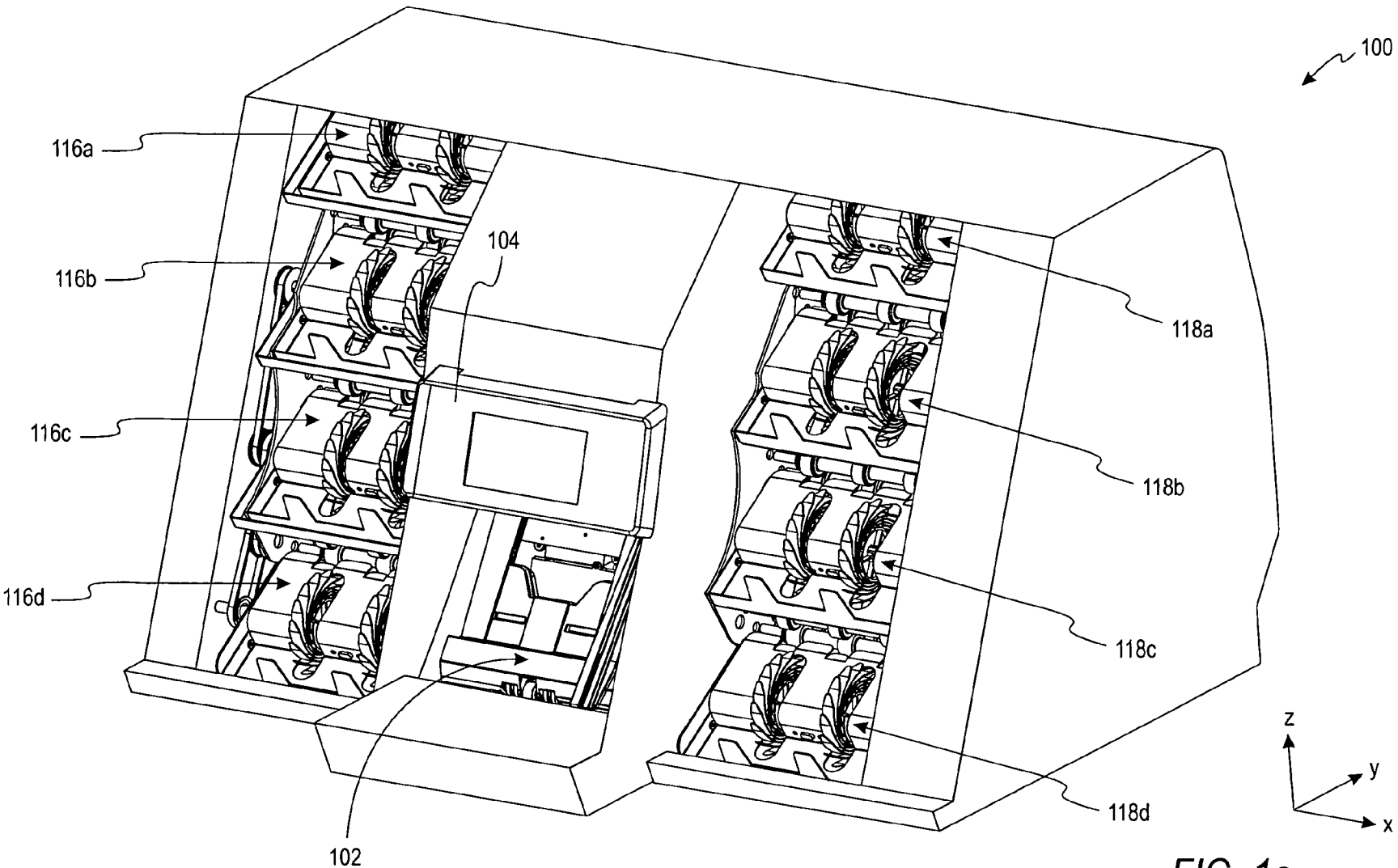
FIG. 1*a* is a perspective view of a multi-pocket currency sorter device having eight output receptacles according to one embodiment of the present invention.

FIG. 1*a* is a perspective view of one embodiment of a multi-pocket currency sorter or processing device 100. The device 100 has an input hopper or receptacle 102 adapted to receive a stack of currency bills to be processed. In some embodiments, the input hopper has a capacity of approximately 700 to approximately 800 currency bills. The device 100 also comprises a number of output receptacles or pockets which are laterally offset from the input hopper 102. As depicted in FIG. 1*a*, the shown embodiment comprises four output receptacles 116*a*-116*d* to the left of the input hopper 102 and four output receptacles 118*a*-118*d* to the right of the input hopper. The device may also comprise an operator or user interface 104 adapted to receive information from and/or provide information to an operator or user. In the embodiment illustrated in FIG. 1*a*, the interface 104 is in the form of a touchscreen. A controller coupled to the control panel causes the device to operate in a number of modes in response to the operational instructions from the user received via the user interface 104.

The device also comprises a transport mechanism adapted to transport bills, one at a time, from the input hopper 102 to one or more of the output receptacles 116, 118 based on one or more criteria. The device comprises one or more sensors which can be employed to count, denominate, authenticate, image, and/or otherwise discriminate, evaluate, analyze and/or image the bills. The results of the above process or processes may be used to determine to which output receptacle 116,118 a bill is to be directed. In general, the one or more sensors which are employed to count, denominate, authenticate, image, and/or otherwise discriminate, evaluate, analyze and/or image the bills in conjunction with one or more processors associated with these sensors may be referred to as a discriminating unit and the location or locations of the sensors along a transport path may be referred to an examination region or regions. In some embodiments, all these sensors may be located in close proximity so as to define a single examination or evaluation region while in other embodiments the sensors may be located in different regions along the transport path so that several examination regions exist.

For example, the device 100 may be adapted to determine the denomination of the bills placed into the input hopper and then sort the bills into the various output receptacles based on their denomination, e.g., $1 bills may be routed to pocket 116*a*, $2 bills to pocket 116*b*, $5 bills to pocket 116*c*, $10 bills to pocket 116*d*, $20 bills to pocket 118*a*, $50 bills to pocket 118*b*, and $100 bills to pocket 118*c*. In some embodiments, pocket 118*d* may be used as a reject pocket and used to receive bills or documents which cannot be denominated as having one of the above seven U.S. denominations, bills suspected to be counterfeit (suspect bills), and/or bills or documents meeting or failing to meet some other criterion.

According to some embodiments currency bills are placed in the input receptacle 102 with their wide edges generally parallel to the front of the machine, that is parallel to the X-axis as indicated in FIG. 1*a*. The currency bills are fed from the input receptacle, one by one, inward wide-edge leading into the device 100.

Figure 1B:
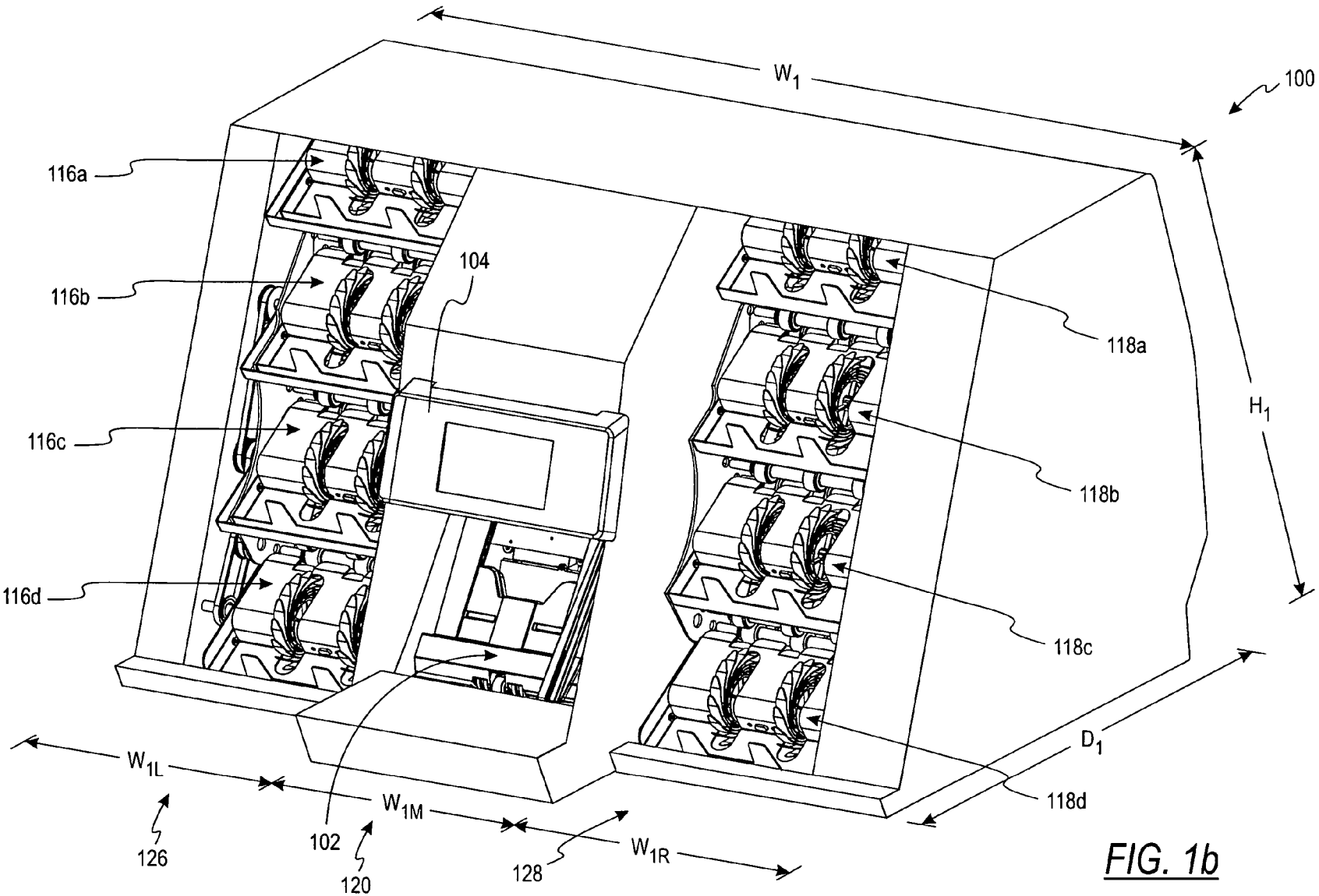
FIG. 1*b* illustrates the sorter of FIG. 1*a* with some dimensional indications.

FIG. 1*b* illustrates the sorter 100 of FIG. 1*a* with some dimensional indications. According to one embodiment of the multi-pocket sorter 100 is compact having a height ($H_1$) of about 27 inches (about 68.6 cm), width ($W_1$) of about 44 inches (about 111.8 cm), and a depth ($D_1$) of about 25.5 inches (about 64.8 cm) and weighs approximately 250 lbs. (about 113.4 kg). A central section 120 has a width ($W_{1M}$) of about 14 inches (35.6 cm). A left section 126 has a width ($W_{1L}$) of about 15 inches (about 38.1 cm). A right section 128 has a width ($W_{1R}$) of about 15 inches (about 38.1 cm). Thus according to some embodiments an eight output receptacle sorter is provided which has a footprint (width×depth) of less than about 1122 $in^2$ (about 7.8 $ft^2$) (about 7250 $cm^2$) and a volume of less than about 30,300 $in^3$ (about 17.5 $ft^3$) (about ½ $m^3$).

Figures 1C, 1D:
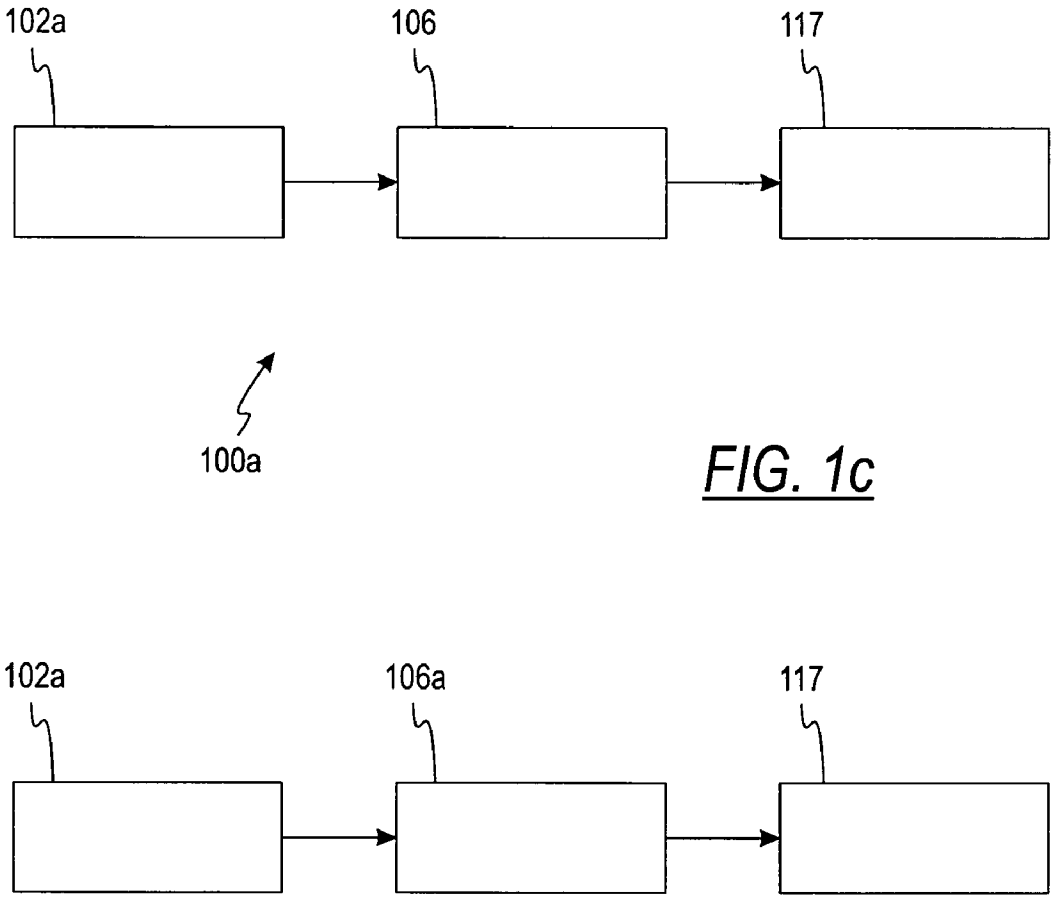
FIG. 1*c* is a generalized block diagram of a multi-pocket sorter.
FIG. 1*d* is a block diagram of a device having an imager.

FIG. 1*c* is a generalized block diagram of a device 100*a* such as device 100. Bills are transported from an input receptacle 102*a* past one or more sensor of a discriminating unit 106 and to one of a plurality of output receptacles 117. The device 100*a* may have any of a variety configurations. In general, the device 100*a* may be configured as described in connection with FIGS. 1-17 and 20. Along these lines, the device 100*a* may be the device of any of FIGS. 1*a*, 1*b*, 1*f*, 8*a*-12*d*, 14*a*-15*c*, and 20.

Figure 2A:
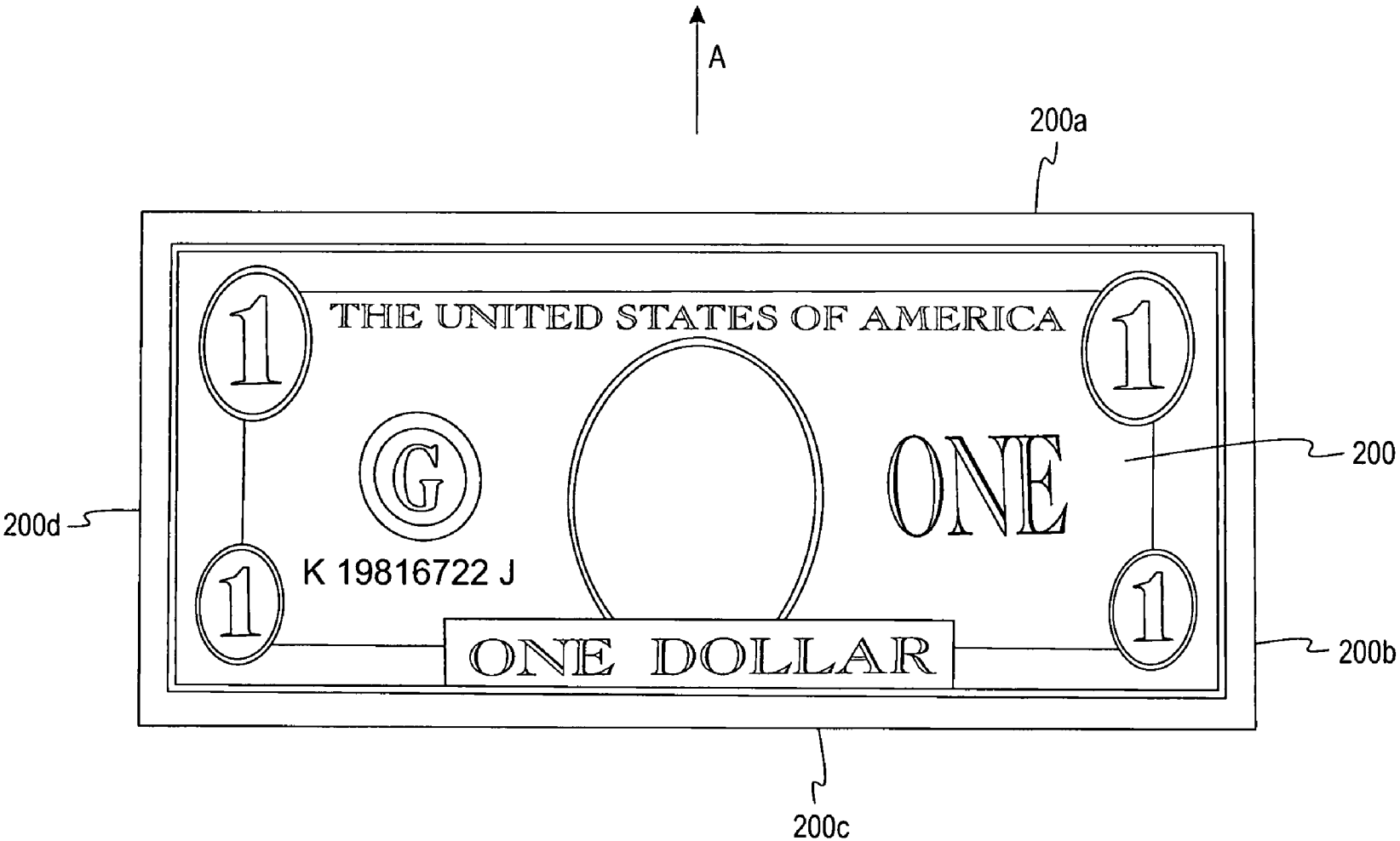
FIG. 2*a* illustrates an example of a bill which may be processed according to some embodiments of the present invention.

FIG. 2*a* illustrates an example of a bill 200 that may be processed according to some embodiments of the present invention. The bill is rectangular and has four edges, two wide edges 200*a* and 200*c* and two narrow edges 200*b* and 200*d*. In the example illustrated in FIG. 2*a*, the bill 200 is transported in direction A. In such embodiment, the bill is transported such that one of the wide edges, namely 200*a*, is the leading edge. According to some embodiments, as described in more detail below, the device transports a bill from the input hopper to one of the laterally offset output receptacles while maintaining the same edge of the bill as leading throughout the transportation process.

Figure 2B:
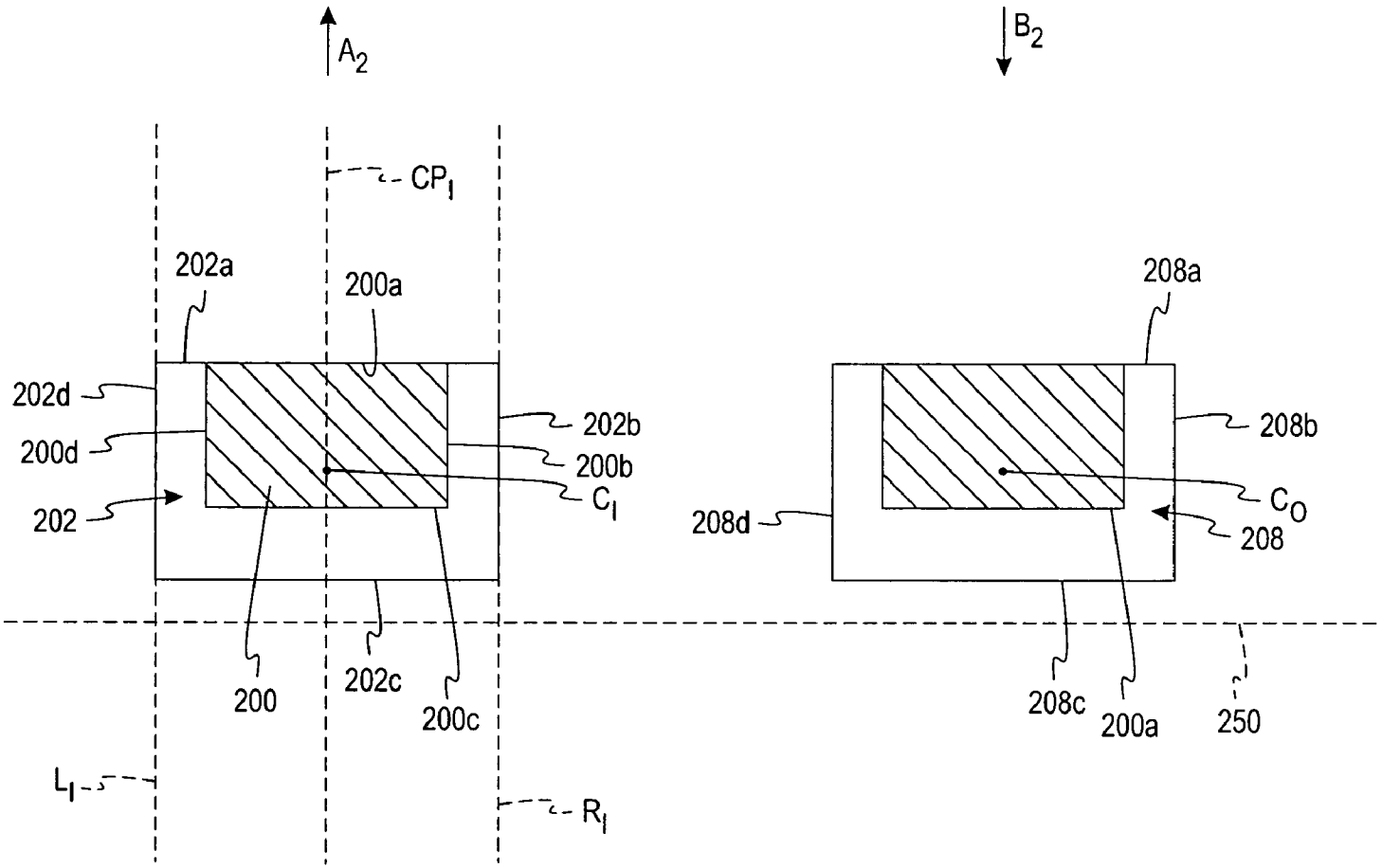
FIG. 2*b* is a top view of an input receptacle and a laterally offset output receptacle according to one embodiment of the present invention.

Turning to FIG. 2*b*, an input hopper 202 and a laterally offset output receptacle 208 of a currency processing device 100 (FIG. 1*a*) are illustrated. The lower-most dashed line in FIG. 2*b* represents a front edge 250 of the currency processing device 100. According to one embodiment of the present invention, the input hopper 202 functionally depicts the input hopper 102 and the laterally offset output receptacle 208 functionally depicts one of the output receptacles 116*a*-*d* and 118*a*-*d* of FIGS. 1*a*,*b*.

A bill 200 is shown as having been placed in the input hopper 202. The input hopper 202 is generally rectangular in shape having a wide rear side 202*a* that is parallel to a wide front side 202*c* and a narrow right side 202*b* that is parallel to a narrow left side 202*d*. The front side 202*c* is the side from which bills are inserted into the input hopper 202 by an operator (i.e., the front side 202*c* is closest to the operator inserting bills into the input hopper 202). The bill 200 also has a rectangular shape having two wide sides 200*a* and 200*c* and two narrow sides 200*b* and 200*d*. Similar to the input hopper 202, the output receptacle 208 is generally rectangular in shape having a wide rear side 208*a* that is parallel to a wide front side 208*c* and a narrow right side 208*b* that is parallel to a narrow left side 208*b*.

Bills are fed from the rear side 202*a* of the input hopper 202 in the direction indicated by arrow $A_2$ such that the leading edge 200*a* of the bill(s) 200 is the wide edge 200*a* of the bill. The bills 200 are transported from the input hopper 200 and delivered to the output receptacle 208 by a transport mechanism, which is described in detail below in connection with FIGS. 4-5*f* according to one embodiment of the present invention. In the embodiment illustrated, bills are fed into the output receptacle 208 from the rear side 208*a* of the output receptacle 208 as indicated by arrow $B_2$. In some embodiments, the front side 202*c* of the input hopper 202 is parallel to the front side 250 of the currency processing device 100. In some embodiments, the front side 208*c* of the output receptacle 208 (the side from which bills are removed by an operator) is parallel to the front side 250 of the currency processing device 100. In the illustrated embodiment, both the front side 202*c* of the input hopper 202 and the front side 208*c* of the output receptacle 208 are parallel to the front side 250 of the currency processing device 100—similar to the arrangement depicted in FIGS. 1*a* and 1*b*.

The output receptacle 208 has been described as being "laterally offset." The term "laterally offset" describes the physical location of an output receptacle 208 relative to the input hopper 202 using the initial direction of bill travel ($A_2$ in FIG. 2*b*) as a frame of reference according to one embodiment of the present invention. In FIG. 2*b*, the output receptacle 208 is laterally offset from the side wall 202*a* of the input hopper 202 because the output receptacle 208 is disposed to the right of the side wall 202*b* of the input hopper 208 as defined by the direction $A_2$ from which bills are removed or fed from the input hopper. As illustrated in FIG. 2*b*, given that bills are fed from the input hopper 202 through the rear side 202*a* in direction $A_2$, the left side of the input hopper 202*d* defines a plane $L_1$ and the right side of input hopper 202*b* defines a right plane $R_1$. The area between planes $L_1$ and $R_1$ defines the lateral position of the input hopper. An output receptacle 208 that is not disposed between planes $L_1$ and $R_1$ is laterally offset from the input hopper 202—laterally offset to the right in FIG. 2*b*. Accordingly, output receptacle 208 is laterally offset from input hopper 202 because it does not lie within the space defined by planes $L_1$ and $R_1$ according to one embodiment of the present invention. As illustrated, output receptacle 208 is positioned entirely to the right of the right plane $R_1$.

While FIG. 2*b* shows that the centers $C_1$ and $C_O$ of the input hopper 200 and output receptacle 208, respectively, are substantially linearly aligned along a line normal to the center-plane $CP_1$ of the input hopper 208, such linear alignment is not required for the output receptacle 208 to be laterally offset with respect to the input receptacle. (The center-plane $CP_1$ defines a vertical plane that passes through the center of the input hopper 202 and is parallel to the direction of bill travel $A_2$ out of the input hopper 202.) Thus, if FIG. 2*b* were modified to shift the output receptacle 208 toward the top of the page, the output receptacle 208 remains laterally offset from the input hopper 202 in this modified FIG. 2*b*. Turning briefly to FIG. 1*a* as an example, the centers of each of the output receptacles 116*a-b* and 118*a-d* are laterally offset to the left (output receptacle 116*a-d*) or to the right (output receptacle 118*a-d*) of the input hopper 102 relative to the direction of the initial bill transport out of the input hopper 102.

In other embodiments of the present invention, the center $C_O$ of the output receptacle 208 may be laterally offset to the right or to the left of the center $C_1$ of the input hopper 202. In FIG. 2*b*, the center $C_O$ of the output receptacle 208 is laterally offset from the center $C_1$ of the input hopper 202 in a direction normal to the direction of bill travel $A_2$ out of the input hopper 202. However, according to some embodiments of the present invention, the centers $C_1$, $C_O$ may be laterally offset but the left side 208*d* or the right side 208*b* of the output receptacle may fall within the area between planes $L_1$ and $R_1$ of the input receptacle 208. In such embodiments, the center $C_O$ of the output receptacle 208 would be laterally offset from the center $C_1$ of the input receptacle, but the output receptacle 208 would not be laterally offset from a side 202*b,d* of the input hopper 208 because a portion of the output receptacle 208 (e.g., the left edge 208*d* or the right edge 208*b*) lies in the area between planes $L_1$ and $R_1$ of the input hopper 202.

Figure 3:
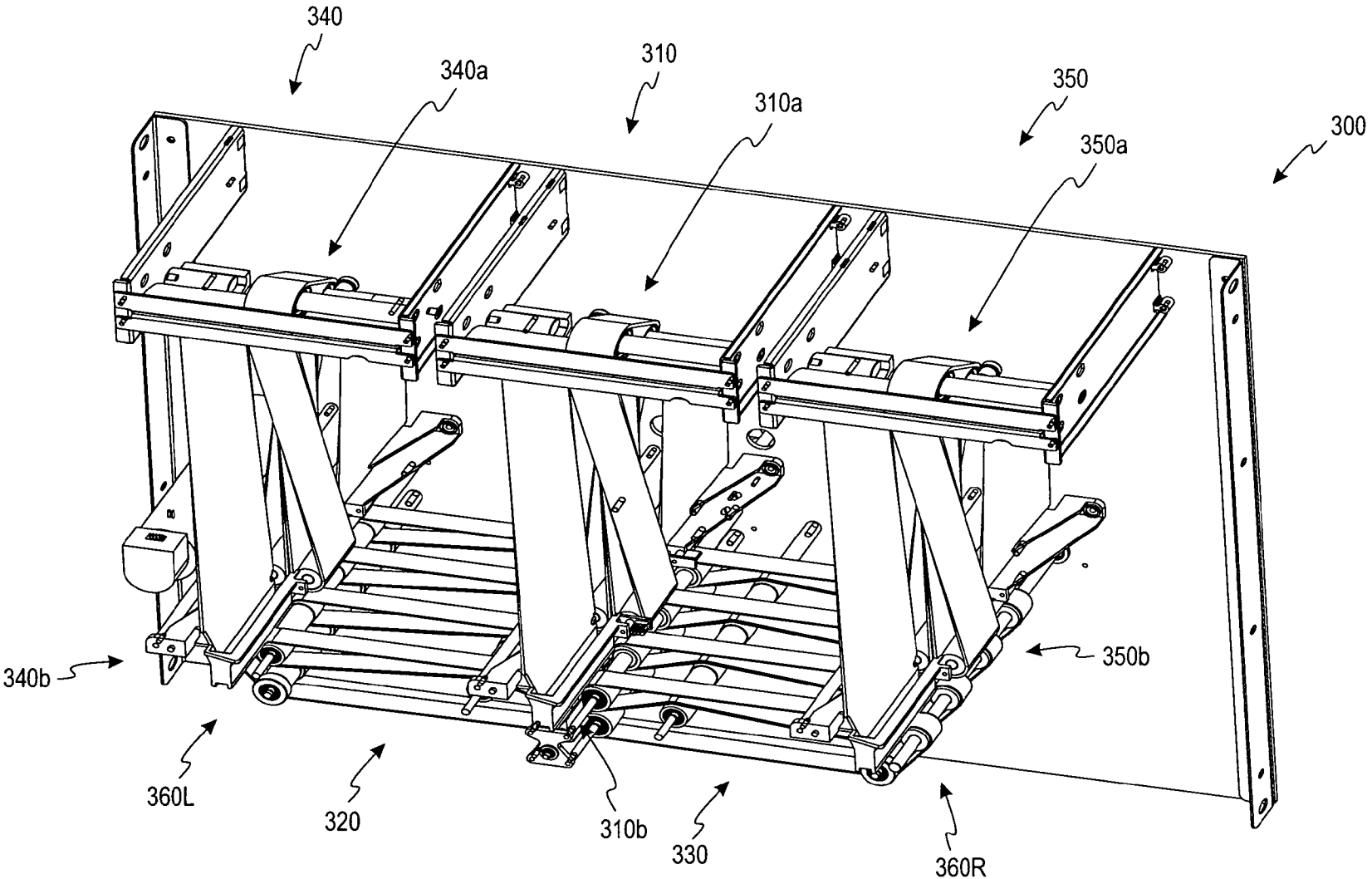
FIG. 3 is a perspective view of a portion of a transport mechanism according to one embodiment.

FIG. 3 illustrates a portion of a transport mechanism 300 that may be employed, for example, in connection with device 100 of FIG. 1*a*. In this embodiment, there is a central-vertical-currency-bill-rotating mechanism 310 which receives currency bills from the centrally-located-input-receptacle section 102. Bills from the input hopper enter the portion of the transport mechanism illustrated in FIG. 3 at the top 310*a* of central-rotating mechanism 310 and are transported downward to the bottom 310*b* of the central-rotating mechanism. As will be discussed in connection with FIG. 5*a*, the bills are rotated during this downward movement through central-rotating mechanism 310. From the bottom 310*b* of central rotating mechanism 310, the bills are then transported either to the left along a left-horizontal-transporting mechanism 320 or right along a right-horizontal-transporting mechanism 330.

Bills exiting the left end of the left-horizontal-transport mechanism 320 enter a left-vertical-currency-bill-rotating mechanism 340 at the bottom 340*b* and then are transported upward toward the top 340*a* of the vertical-rotating mechanism 340. The bills are rotated during this upward movement through the left-rotating mechanism 340.

In a similar fashion, bills exiting the right end of the right-horizontal-transport mechanism 330 enter a right-vertical-currency-bill-rotating mechanism 350 at the bottom 350*b* and then are transported upward toward the top 350*a* of the vertical-rotating mechanism 340. The bills are rotated during this upward movement through the left-rotating mechanism 340.

The left-horizontal-transport mechanism 320 and the left-vertical-currency-bill-rotating mechanism 340 make up a left section 360L of the transport mechanism 300. The right-horizontal-transport bed 330 and the right-vertical-currency-bill-rotating mechanism 350 make up right section 360R of the transport mechanism 300.

Figure 4A:
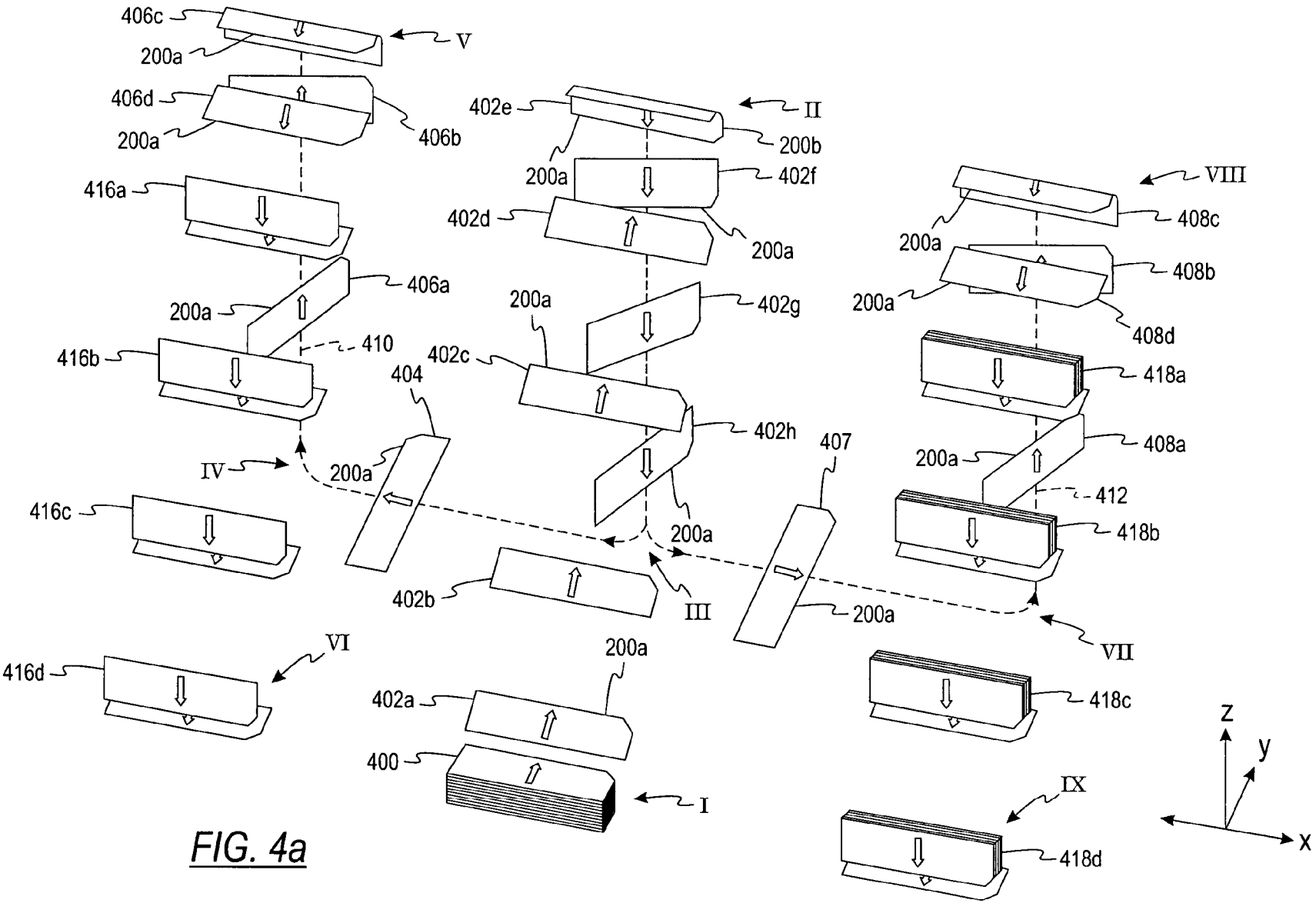
FIG. 4*a* is a perspective view of the currency bill flow sequence within the compact multi-pocket device of FIG. 1*a* according to one embodiment.

Turning now to FIG. 4*a*, a perspective view of the currency bill flow sequence within the compact-multi-pocket device 100 of FIG. 1*a* is depicted without the complication of the transport mechanism 300 according to one embodiment of the present invention. Depicted in FIG. 4*a* is the flow of currency bills in three planes without changing the wide-leading-edge orientation or the transport speed of the currency bill. The currency bills are fed, one by one, from a stack of currency bills 400 residing in the input hopper 102 at location I with the wide leading edge 200*a* parallel to the X-axis as shown in FIG. 4*a*. As placed in the input receptacle, the leading edge 200*a* is parallel to the X-axis. The bills 400 are depicted as having the back right (as viewed in FIG. 4*a*) corners removed so that the movement of the bills from location I to location VI or IX can be more easily tracked.

A currency bill then moves from location I to location II along the upward path indicated by locations 402*a*-402*d*. The movement of the center of a bill moving from location 402*a* to 402*b* to 402*c* and to 402*d* can be specified with its changes along the Z-axis (vertical as viewed in FIG. 4*a*) and the Y-axis (depth or front-to-back as viewed in FIG. 4*a*). During this portion of the transport, the location of the center of the bill 400 does not change in the X-axis (left-right as viewed in FIG. 4*a*). Due to the direction of motion of the center of a bill 400 between locations I and II, the direction of the bill movement of the center of the bill 400 can be altered by diverting the leading edge 200*a* of the bill about a line parallel to the X-axis. Such diversion of the leading edge 200*a* about a line parallel to the X-axis can change the direction of motion of the bill as defined by the Y-axis and the Z-axis (front/back and up/down) but does not change the direction of the bill with respect to the X-axis (left/right). Throughout the movement of the bill from location I to location II the leading edge 200*a* of a bill remains parallel to the X-axis.

Figure 4B:
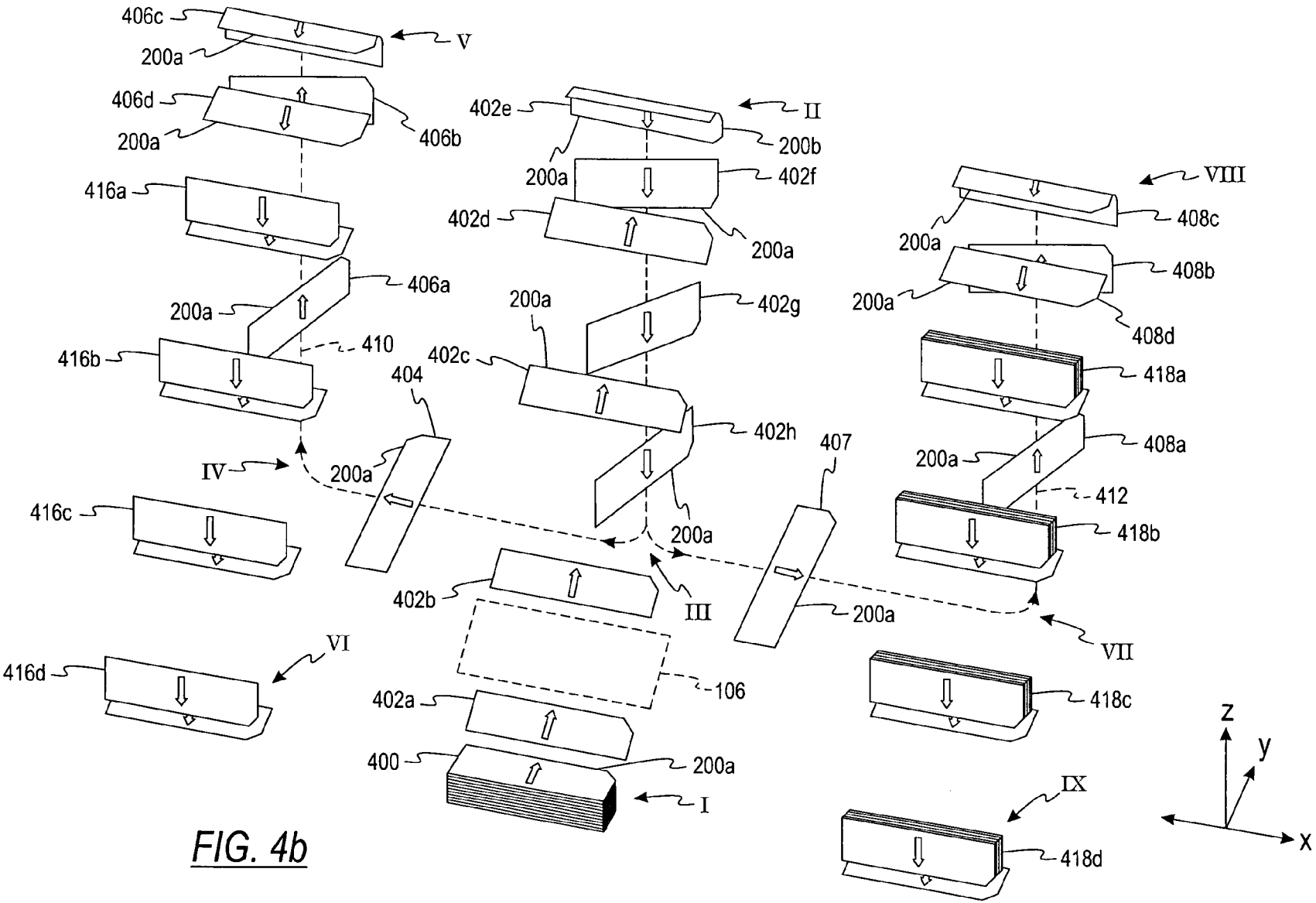
FIG. 4*b* is a perspective view of the currency bill flow sequence within the compact multi-pocket device of FIG. 1*a* illustrating an exemplary location of one or more sensors of a discriminating unit.

According to some embodiments, the evaluation region or regions are located between locations I and II. For example, FIG. 4*b* illustrates an exemplary location of one or more sensors of a discriminating unit 106. In other embodiments, some or all of the sensors of the discriminating unit are located in different areas along the transport path.

The leading edge 200*a* of a bill moves upward and backward (i.e., into the page) from location I to location II until it is turned in a downward direction at location II disposed at the top 310*a* of the vertical-rotating mechanism 310. A currency bill is then fed downward from location II to location III. As a currency bill is fed downward, it is rotated about a line parallel to the Z-axis while following the path indicated by locations 402*f*-402*h* as shown. That is, the leading edge 200*a* is rotated from being parallel to the X-axis to not being parallel to the X-axis. In the embodiment illustrated in FIG. 4*a*, the leading edge 200*a* is rotated about 90° from being parallel to the X-axis to being parallel to the Y-axis. By rotating the leading edge 200*a* from being along a line parallel to the X-axis to a line which is not parallel to the X-axis, the direction of the movement of the center of the bill 400 may now be altered in the X-axis by diverting the leading edge of the bill about a line parallel to the leading edge of the bill.

When a currency bill reaches the lower limit of travel, indicated by location III, the rotation is complete and the leading edge 200*a* of the bill is now parallel to the Y-axis. The currency bill may be diverted in the X-direction either to the left toward location 404 or to the right toward location 407 by diverting the leading edge 200*a* of the bill about a line parallel to the Y-axis.

Figure 5A:
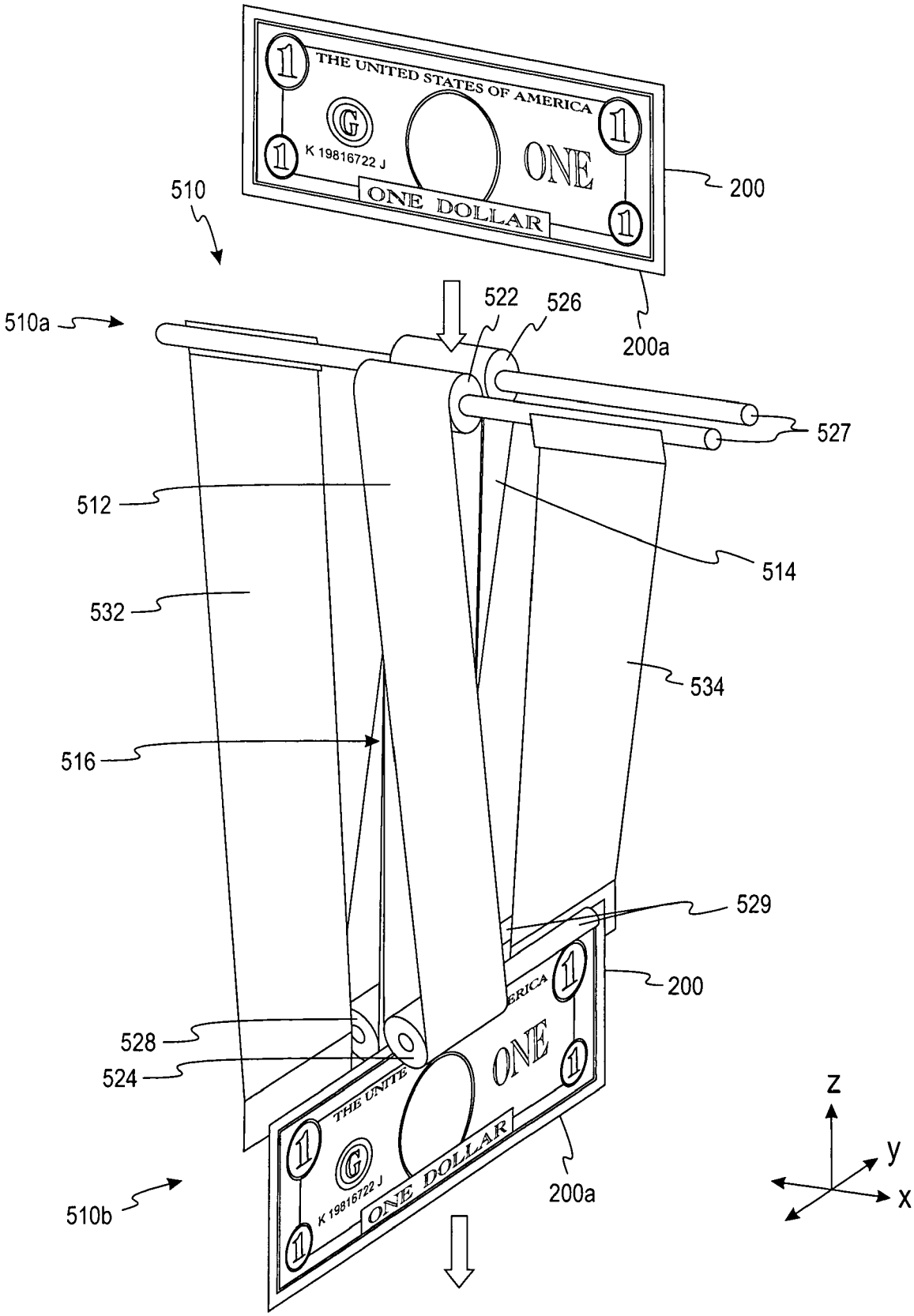
FIG. 5*a* illustrates one embodiment of a bill rotating mechanism.

According to some embodiments, a bill diverted to the left travels horizontally from location III toward location IV. The movement of the center of a bill 400 moving between locations III and IV can be specified with its change along the X-axis (their being no changes in the Z-axis in this example given that the transport direction is horizontal—see e.g., the embodiment of FIG. 5*b*). During this portion of the bill transport, the location of the center of the bill 400 does not change in the Y-axis (front to back). Due to the direction of motion of the center of a bill between locations III and IV and the leading edge 200*a* being parallel to the Y-axis, the direction of the bill movement of the center of the bill can be altered by diverting the leading edge 200*a* of the bill about a line parallel to the Y-axis. Such diversion of the leading edge 200*a* about a line parallel to the Y-axis can change the direction of motion of the bill as defined by the X and Z axes (left/right and up/down), but does not change the direction of the bill with respect to the Y-axis (front/back). Throughout the movement of the bill from location III to location IV the leading edge 200*a* of the bill remains parallel to the Y-axis. According to other embodiments, such as seen in FIGS. 3 and 5*c*, the transport path between locations II and III and/or locations III and VII is not completely flat but contains some vertical component.

At the end of the horizontal path, the currency bill is diverted upwards at location IV to vertical path 410. During the upward feed (between locations IV and V) a currency bill is rotated as shown at 406*a* and 406*b* until the wide leading edge 200*a* of the currency bill is again parallel to the X-axis. More specifically, as a currency bill is fed upward, it is rotated about a line parallel to the Z-axis while following path 410. That is, the leading edge 200*a* is rotated from being parallel to the Y-axis to not being parallel to the Y-axis. In the embodiment illustrated in FIG. 4*a*, the leading edge 200*a* is rotated 90 degrees from being parallel to the Y-axis to being parallel to the X-axis. By rotating the leading edge 200*a* from being along a line parallel to the Y-axis to a line which is not parallel to the Y-axis, the direction of the movement of the center of the bill may now be altered in the Y-axis by diverting the leading edge of the bill about a line parallel to the leading edge of the bill.

At the top of the upward travel, indicated by location V, the leading edge 200*a* of a currency bill is diverted about a line parallel to the X-axis. As illustrated in FIG. 4*a*, the direction of motion is altered from an upward direction to a direction downward and forward as shown at 406*c* and 406*d*. The bill is directed to one of the left side output receptacles 116*a*-116*d* (FIG. 1) as indicated by locations 416*a*-416*d*, respectively.

Returning to location III and with respect to a bill diverted to the right toward location 407, the transportation is similar to that described above with respect to a bill diverted to the left at location III. According to some embodiments, a bill diverted to the right travels horizontally from location III toward location VII. The movement of the center of a bill moving between locations III and IV can be specified with its change along the X-axis (their being no changes in the Z-axis in this example given that the transport direction is horizontal). During this portion of the transport mechanism, the location of the center of the bill does not change with respect to the Y-axis (front to back). Due to the direction of motion of the center of a bill between locations III and VII and the leading edge 200*a* being parallel to the Y-axis, the direction of the bill movement of the center of the bill can be altered by diverting the leading edge 200*a* of the bill about a line parallel to the Y-axis. Such diversion of the leading edge 200*a* about a line parallel to the Y-axis can change the direction of motion of the bill as defined by the X and Z axes (left/right and up/down), but does not change the direction of the bill with respect to the Y-axis (front/back). Throughout the movement of the bill from location III to location VII, the leading edge 200*a* of the bill remains parallel to the Y-axis.

At the end of the horizontal path, the currency bill 400 is diverted upwards at location VII to vertical path 412. During the upward feed (between locations VII and VIII) a currency bill is rotated as shown at 408*a* and 408*b* until the wide leading edge 200*a* of the currency bill is again parallel to the X-axis as shown at location 406*b*. More specifically, as a currency bill is fed upward, it is rotated about a line parallel to the Z-axis while following path 412. That is, the leading edge 200*a* is rotated from being parallel to the Y-axis to not being parallel to the Y-axis. In the embodiment illustrated in FIG. 4*a*, the leading edge 200*a* is rotated 90° from being parallel to the Y-axis to being parallel to the X-axis. By rotating the leading edge 200*a* from being along a line parallel to the Y-axis to a line which is not parallel to the Y-axis, the direction of the movement of the center of the bill 400 may now be altered in the Y-axis by diverting the leading edge 200*a* of the bill about a line parallel to the leading edge of the bill 400.

At the upper-most point of the right side, indicated by location VIII, the leading edge 200*a* of a currency bill is diverted about a line parallel to the X-axis. As illustrated in FIG. 4*a*, the direction of motion is altered from an upward direction to a downward and forward direction (out of the page) as shown at 408*c* and 408*d*. The bill is directed to one of the right side output receptacles 118*a*-118*d* (FIG. 1) as indicated by locations 418*a*-418*d*, respectively.

As is apparent from the above discussion and FIG. 4*a*, the above procedure permits a bill to be moved laterally with respect to its feed direction without changing the leading edge of the bill. For example, a bill can be moved from location 402*e* (location II) to the laterally offset location 408*c* (location VIII) without changing the leading edge from edge 200*a*. Furthermore, the above procedure permits a bill 400 to be moved to a laterally offset position with respect to a feed direction while maintaining the transport speed of the bill constant. For example, a bill 400 can be moved from traveling along a direction from I and II to traveling along a laterally offset direction such as VIII-IX without having to stop the transportation of the bill 400, for example, at location II and moving it sideways to location VIII (making edge 200*b* the leading edge). Thus according to some embodiments bills can be fed from an input receptacle and stacked in a laterally offset output receptacle while maintaining the same feeding and stacking orientation of the bills, i.e., wide edge leading.

One example of a bill rotating mechanism 510 that may be used as the bill rotating mechanism 312 of FIG. 3, will now be described with reference to FIG. 5*a*. As illustrated in FIG. 5*a*, the bill rotating mechanism 510 may be in the form of a two-belt currency bill rotating mechanism comprising a first belt 512 and a second belt 514. Each of the first and the second belts 512, 514 forms a continuous loop. The belts 512, 514 are disposed adjacent to each other such that the opposing surfaces of each belt 512, 514 form a currency bill transport path 516 therebetween. The bill rotating mechanism 510 has an inlet end 510*a* and an outlet end 510*b*. In the embodiment illustrated in FIG. 5*a*, the inlet end 510*a* is a top end and the outlet end 510*b* is a bottom end, although any orientation is possible.

Starting from the inlet end 510*a* of the mechanism 510, the first belt 512 is disposed about a first roller 522 and the second belt 514 is disposed about a second roller 526. The first roller 522 is disposed adjacent to the second roller 526. Each roller 522, 526 is connected to and rotates about a respective shaft 527. In the embodiment illustrated in FIG. 5*a*, shafts 527 and rollers 522, 526 are oriented parallel to the X-axis.

At the outlet end 510*b* of the rotating mechanism 510, a second end of the first belt 512 is disposed about a third roller 524 and a second end of the second belt 514 is disposed about a fourth roller 528. The third roller 524 is disposed adjacent to the fourth roller 528. Each roller 524, 528 is connected to and rotates about a respective shaft 529. In the embodiment illustrated in FIG. 5*a*, shafts 529 and rollers 524,528 are oriented parallel to the Y-axis. Accordingly, the orientation of the outlet end 510*b* is rotated approximately 90° with respect to the inlet end 510*a* of the rotating mechanism. In some embodiments the degree of rotation may be between 0-90° such as, for example, 45°.

As described above, the second or bottom end of the first and the second belts 512, 514 are twisted approximately 90° with respect to a first or upper end of the first and the second belts 512, 514.

According to some embodiments, the adjacent surfaces of belts 512, 514 are in contact with each other where no bill is located therebetween. The complementary rotation of the belts 512, 514 (here the adjacent surfaces both moving in a downward direction as viewed in FIG. 5*a*) moves bills therebetween along the transport part 516 (here in a downward direction). In some embodiments, when a currency bill 200 is inserted between the inwardly rotating belts 512, 514 the currency bill is transported between the belts 512, 514 by contact friction. According to some embodiments, the belts 512, 514 form the only active mechanisms for driving bills along the transport path 516 from the inlet end 510*a* to the outlet end 510*b* of the bill rotating mechanism 510.

In the illustrated embodiment, a currency bill 200 is transported through the rotating mechanism 510 with the long or wide edge 200*a* of the currency bill 200 leading. The width of the bill 200 is greater than the width of the first and the second belts 512, 514 causing a significant portion of the currency bill 200 to overhang each edge of the belts 512, 514. Because of the high processing rate at which the currency bill handling devices described herein can operate (e.g., 800 to 1600 bills per minute), a significant angular velocity is imparted to a currency bill directed through the rotating mechanism 510*b*. For example, some embodiments of the currency handling devices described herein are operated at speeds in excess of 1200 currency bills per minute. The differences in air pressures acting on the front and the back surfaces areas of the currency bill 200 as the bill is twisted or rotated can cause the bill 200 to fold or be forced such that the bill is no longer being transported in a substantially flat manner. This situation can occur more readily when the currency bill stiffness is degraded due to wear resulting from heavy usage. Additionally, currency bills are often folded in a variety of manners which may cause a currency bill to be biased in a certain direction such that the currency bill will not lie flat under its own weight.

According to some embodiments, it is preferable for the currency bill 200 to be transported through the rotating mechanism 510 (and the currency handling device 100) in a substantially flat manner. If the bill 200 is not substantially flat when traveling, either into the bill rotating mechanism 510 at inlet end 510*a* or out of the rotating mechanism 510 at outlet end 510*b*, there is a possibility that the bill may become skewed or jammed.

According to some embodiments, the currency bill rotating mechanism 510 also comprises two guides 532, 534 disposed along the transport path 516. In some embodiments the guides 532 and 534 may be made of a rigid material. The guides 532, 534 provide support to portions of the currency bill 200 that overhang the belts 512, 514. These guides 532, 534 aid in preventing a bill from folding during its transport through the rotating mechanism 510. These guides can also aid in maintaining a bill in a substantially flat manner during its transport through the rotating mechanism 510.

In the embodiment illustrated in FIG. 5*a*, the movement of the currency bill 200 is depicted in the downward direction through the rotating mechanism 510. In alternative embodiments or usage of a rotating mechanism 510 within the currency bill transport mechanism 300, the direction of currency bill movement may be in an upward direction (e.g., rotating mechanisms 340 and 350 of FIG. 3) or in any other direction.

Figure 5B:
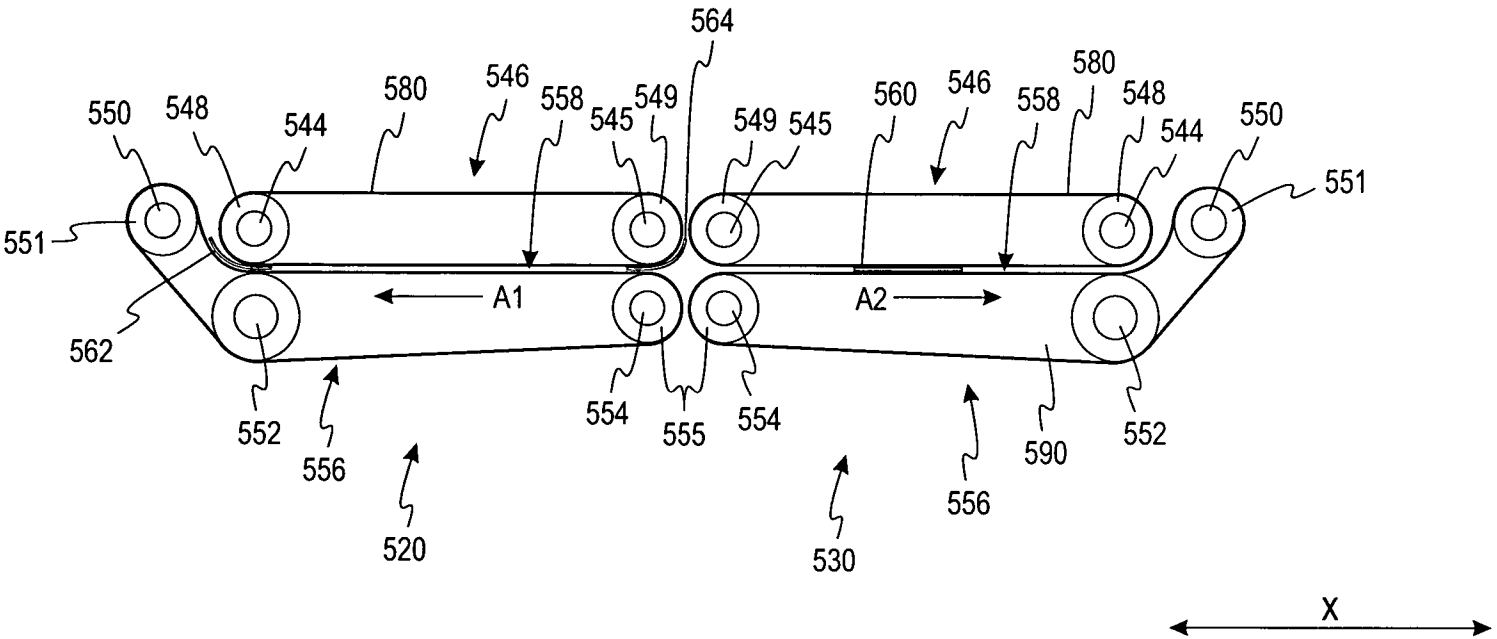
FIG. 5*b* is a side view of one embodiment of horizontal transport mechanisms.
Figure 5C:
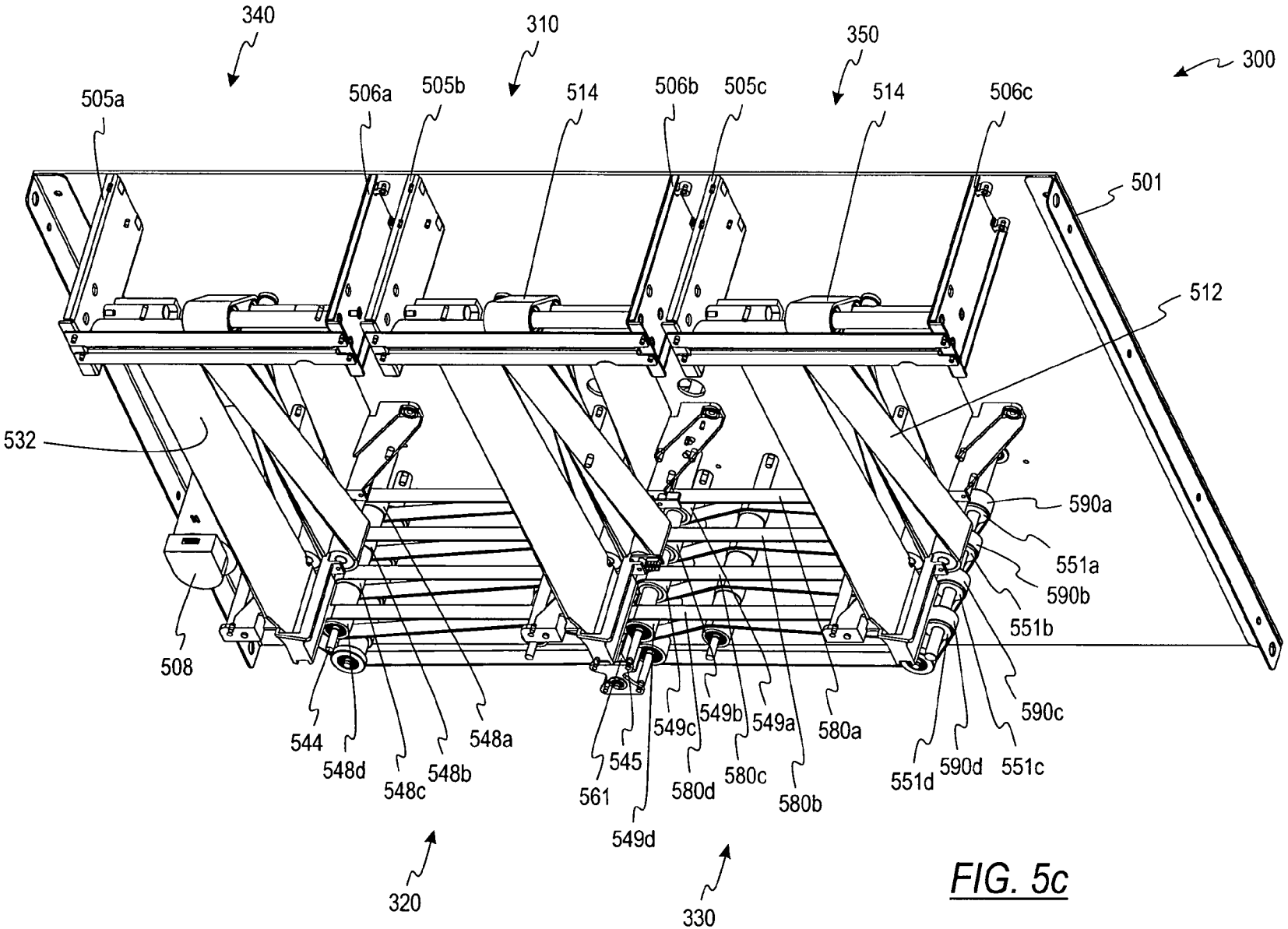
FIG. 5*c* is a frontal, downward looking perspective view of a portion of transport mechanism according to one embodiment.

Referring now to FIG. 5*b*, a side view of one embodiment of the horizontal left and right transport mechanisms 520, 530 is illustrated. Each horizontal transport mechanism comprises an upper belt unit 546 and a lower belt unit 556. A perspective view of alternative left and right transport mechanisms 320, 330 is shown in FIG. 5*c*. Each upper belt unit 546 comprises two shafts 544, 545 which are journalled in frames rigidly attached to an internal frame 601 (FIG. 5*c*). In FIG. 5*c*, the frames are only partially shown for clarity. According to some embodiments, there are three equally spaced continuous loop belts 580*a-c* which are looped around rollers 548*a-d* and 549*a-d* on the respective shafts 544 and 545. In some embodiments, such as shown in FIG. 5*c*, there are four equally spaced continuous loop belts 580*a-d* which are looped around rollers 548*a-d* and 549*a-d* on the respective shafts 544 and 545. Each lower belt unit 556 comprises a journalled shaft 552 which has equally spaced grooves to accept three continuous belts 590*a-c* (or four belts 590*a-d*). Each lower belt unit 556 also comprises rollers 551*a-c* and 555*a-c* (or 551*a-d* and 555*a-d*) disposed on journalled shafts 550 and 554, respectively. The continuous belts 590 are looped around the rollers 551 and 555 and in the grooves of the shaft 552.

The upper belt unit 546 and the lower belt unit 556 are disposed so that the opposing surfaces of each belt 580*a-c* (or 580*a-d*) of the upper unit 546 and 590*a-c* (or 590*a-d*) of the lower unit 556 come in contact with each other and form a currency bill transport path 558 therebetween. In the embodiment illustrated in FIG. 5*b*, the currency bills are transported horizontally between the belt assemblies 546 and 556 with their wide edges leading. The flow of the currency bills in the left-horizontal-transport mechanism 520 is from right to left as indicated by the arrow A1 and the flow of the currency bills in the right-horizontal-transport-mechanism 530 is from left to right also as indicated by arrow A2.

Although FIG. 5*b* depicts a space between the upper 546 and lower 556 units of the horizontal transport mechanisms 520 and 530 for clarity. According to some embodiments, the respective belts 580 and 590 are in frictional contact with each other. The frictional coupling between the belts 580 and 590 of the upper and lower units 546, 556 of the horizontal transport mechanism 520 and 530 (forming transport paths 558) and between the belts 512 and 514 of the rotating mechanisms (forming the transport path 516) of FIG. 5*a* transfer mechanical energy to currency bills being transported and according to some embodiments may also mechanically transfer drive energy through the apparatus.

Although FIGS. 5*a*-5*f* depict the transport mechanism comprising a system of belts, the transports systems can be comprised of a system of plates and rollers or vacuum belts or other types of transport systems. For example, the bills may be transported between two plates wherein driven rollers extend through apertures in one of the plates (e.g., a lower plate) and passive rollers extend through apertures in the other plate (e.g., an upper plate) that are in counter-rotating contact to drive a bill along a transport path defined by the two plates.

Figure 5D:
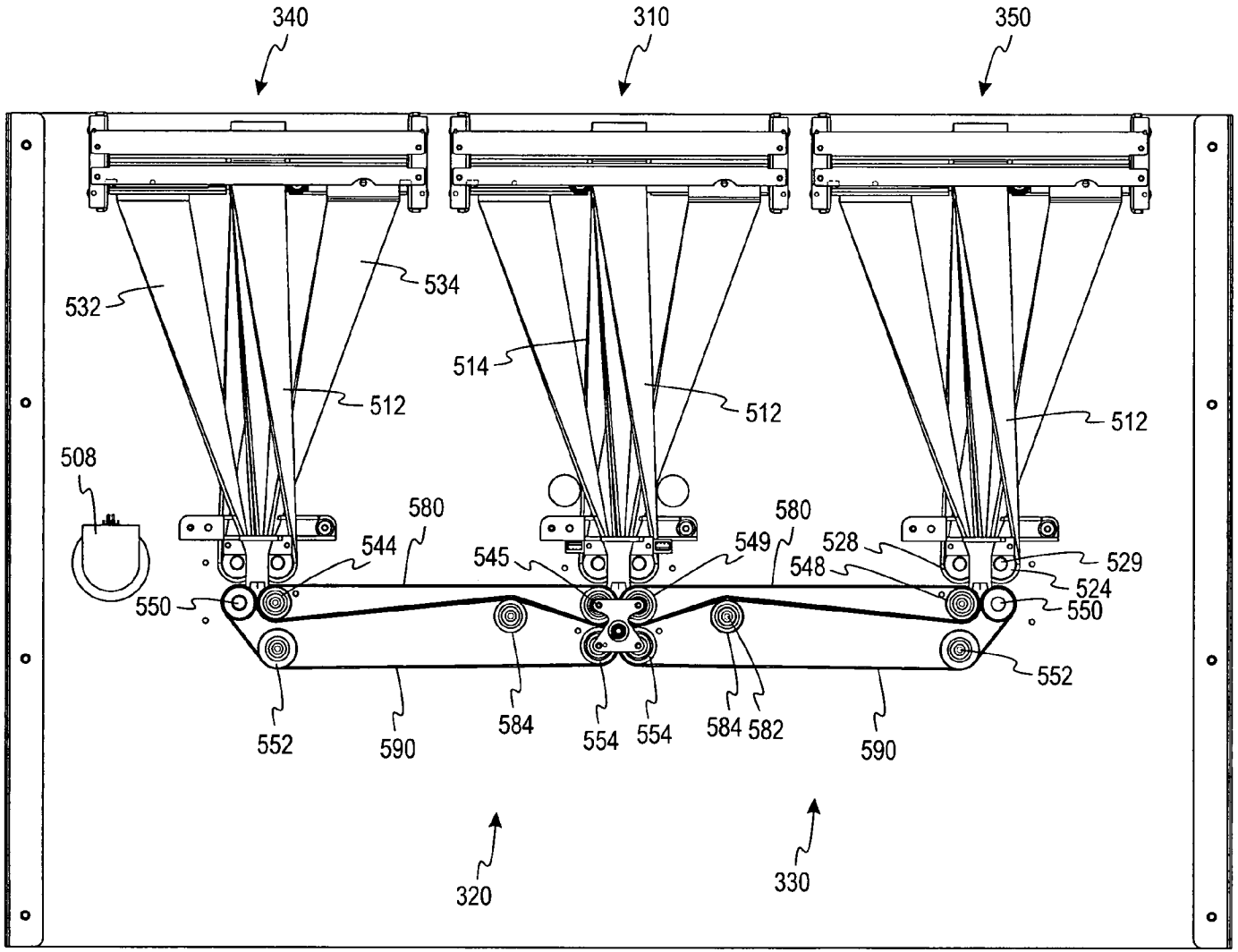
FIG. 5*d* is a front view of a portion of one embodiment of a transport mechanism.
Figure 5E:
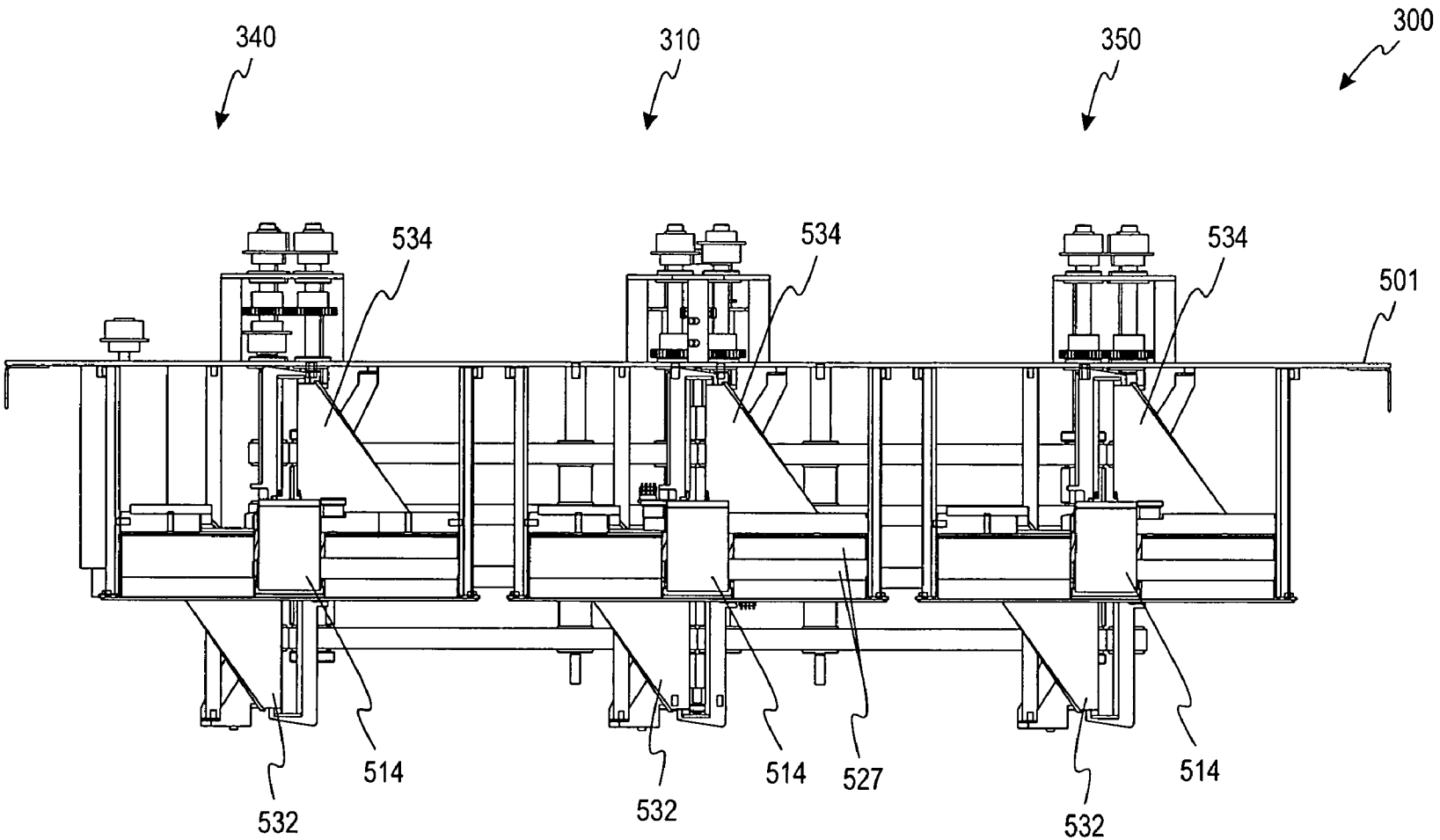
FIG. 5*e* is a top view of a portion of one embodiment of a transport mechanism.
Figure 5F:
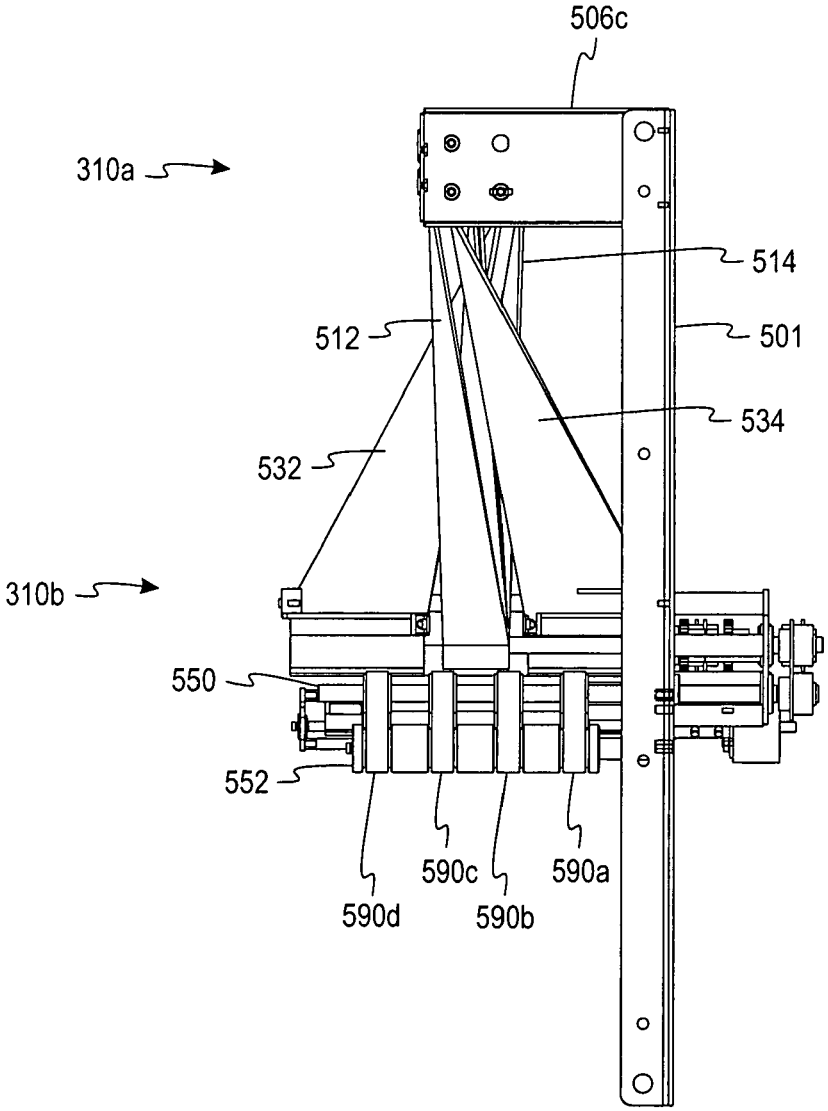
FIG. 5*f* is a side view of a portion of one embodiment of a transport mechanism.

Referring now to FIGS. 5*c*-5*f*, one embodiment of the transport mechanism 300 for transporting bills from the input receptacle (FIG. 1*a*) to an output receptacle 116*a-d* and 118*a-d* is illustrated and will be described. FIG. 5*c* is a frontal, downward looking perspective view of a portion of transport mechanism 300. FIG. 5*d* is a front view, FIG. 5*e* is a top view, and FIG. 5*f* is a side view of a portion of one embodiment of transport mechanism 300. Currency bills enter the portion of the transport mechanism 300 at the top of the middle rotating mechanism 310 as depicted above in FIG. 3. The leading edge of the currency bills, oriented parallel to the X-axis, are then fed downward by the rotating mechanism 310 where at the bottom, the leading edge of the currency bills are oriented parallel to the Y-axis. As the currency bills exit the bottom of the rotating mechanism 310 they encounter a diverter device 561. In the embodiment depicted, the diverter 561 includes a plurality of flanges mounted across the transport path between the rollers 549 of the left and right transport mechanisms 320 and 330 and aligned to the transport paths 558 of each transport mechanism 320 and 330. Note, the left and right transport mechanisms 320, 330 vary slightly from the embodiments of the horizontal transport mechanism 520, 530 of FIG. 5*d* in that the transport mechanisms 320, 330 comprise additional rollers 584 rotationally mounted on shaft 582. As a result of the positioning of roller 584, the transport paths 558 are no longer horizontal but contain some upward and downward direction. Referring to FIG. 5*d*, as a bill exits the rotating mechanism 310 and is directed to the right toward rotating mechanism 350, the bill first travels slightly upward and to the right until it reaches the location of roller 584 and then it travels slightly downward and to the right until it reaches roller 548.

There are sensors throughout the transport mechanism 300 which track the flow of the currency bills. In response to sorting criterion or criteria, a controller may generate a control signal causing the diverter 561 to divert a particular bill to either the left or right transport path. The control signal may be generated, at least on part, on data derived from one or more sensors which are employed to count, denominate, authenticate, determine fitness, image, and/or otherwise discriminate, evaluate, and/or analyze and/or image a particular bill. A currency bill diverted to the left transport mechanism 520 is depicted by bill 564 in FIG. 5*b*. The sensor tracking information is also used to direct a particular currency bill to the appropriate destination output receptacle pocket.

The currency bills are transported along the transport path 558 of the selected transport mechanism 320/520 or 330/530 as shown by, for example, bill 560 in FIG. 5*b*. The placement of the rollers 548 and 551 are such that the currency bill changes direction from a generally horizontal path to a vertical path where the lower rollers 524, 528 (FIG. 5*a*) of the respective rotating mechanisms 340, 350 make contact with the leading edge of the currency bill to transport the currency bill upwards as shown by bill 562 in FIG. 5*b*. The currency bills are then transported upwards and are re-oriented so that their leading edges 200*a* are parallel to the X-axis and then are directed downward toward output receptacles 116, 118 (FIG. 1).

According to some embodiments, the portion of the transport mechanism 300 depicted in FIG. 5*c* may be driven by a single motor 508, which imparts its energy through the frictional coupling of the belts and rollers of the mechanism. According to such embodiments, the motor 508 and all of the components of the transport mechanism 300, including the vertical rotating mechanisms 310, 340, 350 and the left and right transport mechanisms 320,330, are in frictional contact through the belts and rollers. Thus, a substantially constant speed is maintained for the transport of the currency bills throughout the transport mechanism 300. Due to the high transport rate several currency bills may be located at spaced intervals throughout the transport mechanism 300.

The input path (the path from location I to location II shown in FIG. 4*a*) includes the input receptacle 102, which in the embodiment depicted in FIGS. 1*a,b* is located in the center of the multi-pocket currency device 100. According to some embodiments, the currency bills are stacked wide leading edge forward in the input receptacle 102. The bills are fed upwards at an angle to the top where they are diverted by a curved diverter plate at location II (FIG. 4*a*) so that the wide leading edge is directed between rollers of the rotating mechanism 310.

According to some embodiments, one or more sensors which can be employed to count, denominate, authenticate, determine fitness, image, and/or otherwise discriminate, evaluate, and/or analyze the bills may be disposed between locations I and II. Examples of a variety of such sensors (e.g., magnetic sensors, thread sensors, ultraviolet/fluorescent sensors, image sensors, etc.) are described or referred to in U.S. Pat. Nos. 5,687,963; 6,311,819; 6,278,795 B1; 6,256,407; 6,363,164; and 6,661,910; as well as in U.S. patent application Ser. No. 10/379,365, which was filed Mar. 4, 2003 and entitled "Currency Processing System with Fitness Detection" and U.S. Ser. No. 10/684,027, which was filed Oct. 10, 2003 and entitled "Multi-Wavelength Currency Authentication System and Method"—all of which are incorporated herein by reference in their entireties. Fitness detection/evaluation may include the evaluation of a bill's limpness and/or the detection of the presence of soil, tape, holes, tears, missing corners, and/or graffiti.

Additionally or alternatively, the device may contain one or more imagers or image sensors adapted to retrieve the image of all or a portion or portions of one or both surfaces of passing currency bills. These image sensors may be co-located or remote from the other sensors described above. In other embodiments, the image sensors 108 may replace one or more of the various additional sensors.

Sensors which generate data which are used to count, denominate, authenticate, determine fitness and/or otherwise discriminate, evaluate, and/or analyze the bills, whether they are image sensors or non-image sensors, will collectively be referred to as bill or document characteristic sensors. The discriminating unit comprises one or more characteristic sensors.

According to some embodiments, data from the image sensors may be stored internally and/or externally to the device 100 such that the image of all or a portion of currency bills and/or other documents which have been imaged by the device 100 may be reproduced. For example, in some embodiments, where a bill has been imaged, a detailed image of the bill may be reproduced, for example, on a computer monitor and/or printed. According to some embodiments the image is of such quality as to be human readable, e.g., the image is similar in quality to that generated by a photocopier or facsimile machine.

Figure 1E:
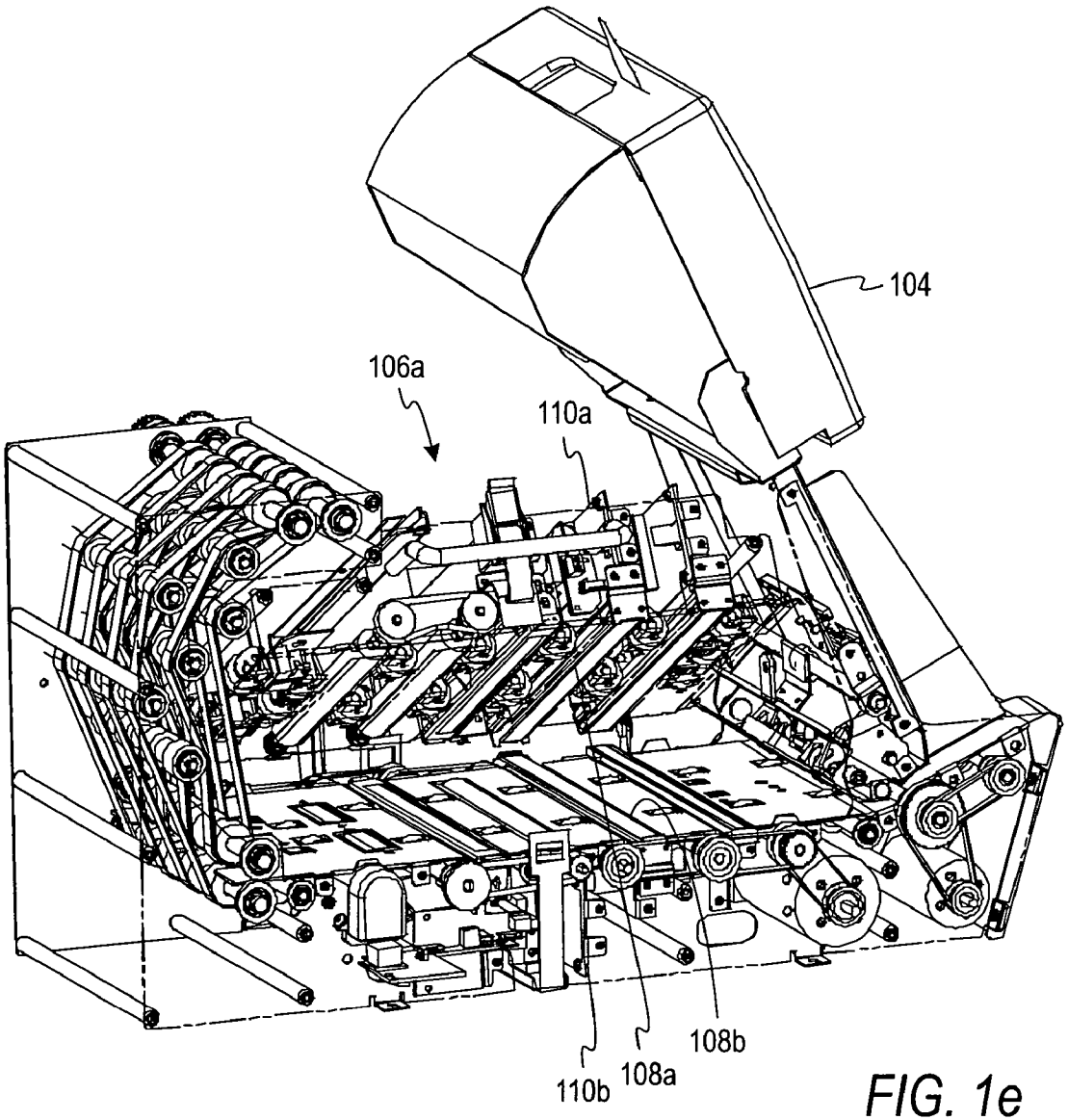
FIG. 1*e* illustrates a configuration of a portion of a device having an imager according to an embodiment of the present invention.

FIG. 1*d* is a block diagram of a device 100*b* such as device 100 or 100*a* having an imager 106*a*. Bills are transported from an input receptacle 102 past the imager 106*a* and to one of a plurality of output receptacles 117. The device 100*a* may have any of a variety configurations. For example, FIG. 1*e* illustrates a configuration of a device 100*b* having an imager 106*a* according to an embodiment of the present invention. In general, the device 100*b* may be configured as described in connection with FIGS. 1-17 and 20. Along these lines, the device 100*b* may be the device of any of FIGS. 1*a*, 1*b*, 1*f*, 8*a*-12*d*, 14*a*-15*c*, and 20.

The imager 106*a* may include one or more image sensors as discussed above. For example, the imager 106*a* may include one or more image sensors for recording images of the currency bills as they are passed through the transport mechanism. According to some embodiments, the imager 106*a* captures, via an imaging camera and/or scanner, an electronic image of all or part of one or both sides of a passing currency bill. The imager 106*a* may provide either raw image data or an image file to a controller or processor. Processing of the raw image data may be performed by the controller or at another location.

The electronic image may be analyzed by software for an indicia, such as a serial number, watermark, etc., to determine the validity, denomination, etc. of the currency bill. Once the validity, denomination, etc. is determined from the image, a control signal may be sent to various portions of the device 100, such as diverters, for routing the currency bill to the appropriate output receptacle. After processing, the electronic image may be stored on one or more storage media, such as hard drives, CD-ROMs, or DVDs, for example all of which may be co-located with the device 100, remote from the device 100, or pluggable/portable. Moreover, the image of a currency bill or other document may also be electronically indexed or cross-referenced, simplifying future image retrieval and archiving.

Once the image is captured, data may be extracted from the image and appended to the image file to aid in retrieval or searching of image files as noted above. In other embodiments, data such as transaction data, location data, time stamp data, employee ID data, currency bill serial numbers, etc. may be appended to the image file for indexing and searching purposes. In addition, the extracted data or additional data may be maintained separate from the image file and used by other portions of systems utilized in conjunction with the document processing device 100.

According to some embodiments, data derived from the imager 106*a* is used to denominate, authenticate, and/or otherwise discriminate, evaluate, and/or analyze the bills. Alternatively, according to some embodiments, data derived from the imager 106*a* is used, in conjunction with data derived from other sensors, to denominate, authenticate, and/or otherwise discriminate, evaluate, and/or analyze the bills. In some embodiments, the imager 106*a* is used to simply obtain images of passing documents, e.g., for storage and/or subsequent retrieval purposes, while other sensors obtain the data used to denominate, authenticate, and/or otherwise discriminate, evaluate, and/or analyze the bills. In some embodiments, the imager 106*a* is used to both obtain images of passing documents, e.g., for storage and/or subsequent retrieval purposes, and also to denominate, authenticate, and/or otherwise discriminate, evaluate, and/or analyze the bills, alone or in conjunction with data derived from other sensors.

FIG. 1*e* illustrates a detailed view of an imager 106*a* in accordance with some embodiments of the present invention. As noted above, the imager 106*a* may include one or more sensors 108 for capturing images of the currency bill. In the depicted embodiment, the imager 106*a* includes an upper image sensor 108*a* for capturing an image of all or part of the upper side of a currency bill and a lower image sensor 108*b* for capturing an image of all or part of the lower side of a currency bill. Additional or fewer image sensors 108 may be incorporated as desired. The image sensors 108 may be optical scanheads that may, for example, line or contact image scan an optical characteristic of the currency bill to identify the denomination. Associated with each image sensor 108 is an imaging sensor printed circuit board (PCB) 110. In the depicted embodiment an upper imaging sensor PCB 110*a* is associated with the upper image sensor 108*a* and a lower imaging sensor PCB 110*b* is associated with the lower image sensor 108*b*, although other arrangements are possible.

Figure 1F:
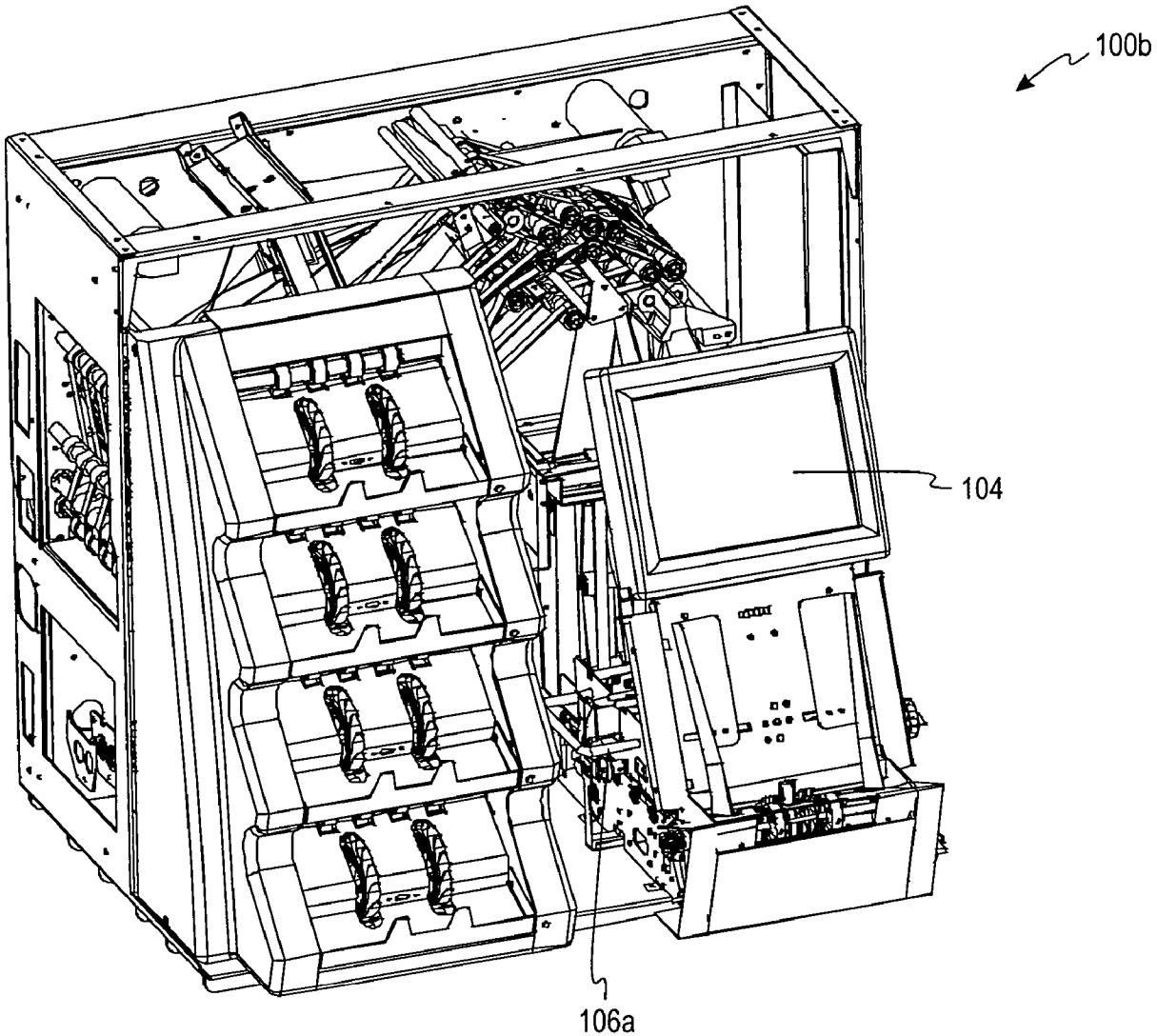
FIG. 1*f* is a perspective view illustrating a multi-pocket currency sorter having an imager according to one embodiment of the present invention.

FIG. 1*f* is a perspective view illustrating of a multi-pocket currency sorter 100*b* having an imager 106*a* according to one embodiment of the present invention.

Figure 1G:
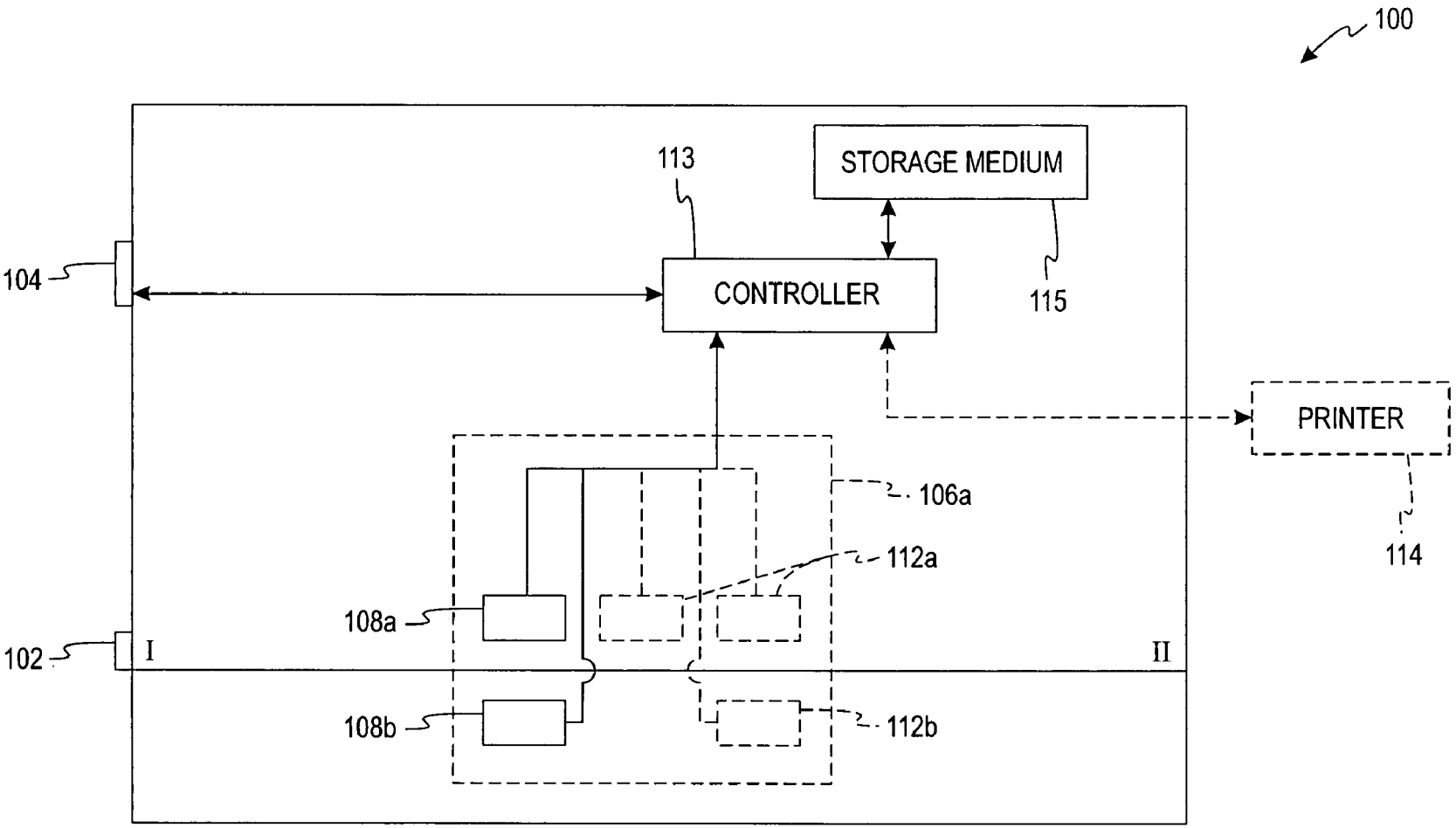
FIG. 1*g* is a block diagram of various components of a sorter according to an embodiment of the present invention.

FIG. 1*g* illustrates a block diagram of various components of the device 100*a*. The imager 106*a*, as noted above, may include one or more upper and/or lower image sensors 108. In addition, the imager 106*a* may include various additional sensors 112 that may also be located along an upper, lower, or both sides of the transport path between locations I and II as noted in more detail with reference to FIG. 4. The image sensors 108 and optional additional sensors 112 transmit information (e.g., a captured image, fitness data, denomination data, etc.) to a controller 113. The controller 113 may communicate the received data or images to the user interface 104, an optional printer 114, and/or a storage medium 115. The storage medium 115 may also store information allowing the controller 113 to evaluate the captured image. For example, the controller 113 may receive the captured image, retrieve data from the storage medium 115, and evaluate the denomination, fitness, etc. of the bill. The controller 113 may also direct the diverters (not shown) to pass the currency bill to a particular output receptacle based on the captured image and/or other data. The controller 113 may direct various portions of the device 100 based on control signals received from any one or more of the image sensors 108 and the additional sensors 112.

According to some embodiments, the currency bills inserted into an input hopper only need to be aligned along the wide edge of the currency bill for the compact multi-pocket device 100 to function correctly. According to other embodiments, the input hopper has adjustable side walls that remain centered with the center of the input hopper as the walls are adjusted so that bills placed therein are aligned with the center of the input hopper. In such an embodiment, each bill within a stack of bills placed in the input hopper does not need to be precisely aligned with the center of the input hopper. The transport mechanism will tolerate—be able to handle—some left/right shifting of the bills. Likewise, in some embodiments wherein bills are aligned with a left or right wall of the input hopper, precise aliment is not necessary as the transport mechanism will tolerate some shifting of the bills.

Figure 6B:
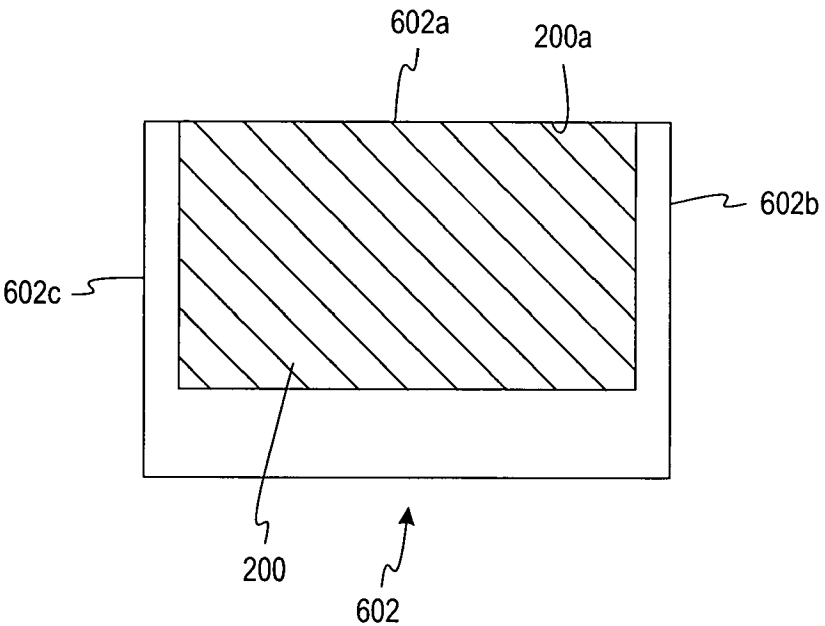
FIG. 6*b* is a top view of an input hopper showing a one-edge alignment of bills.
Figure 6A:
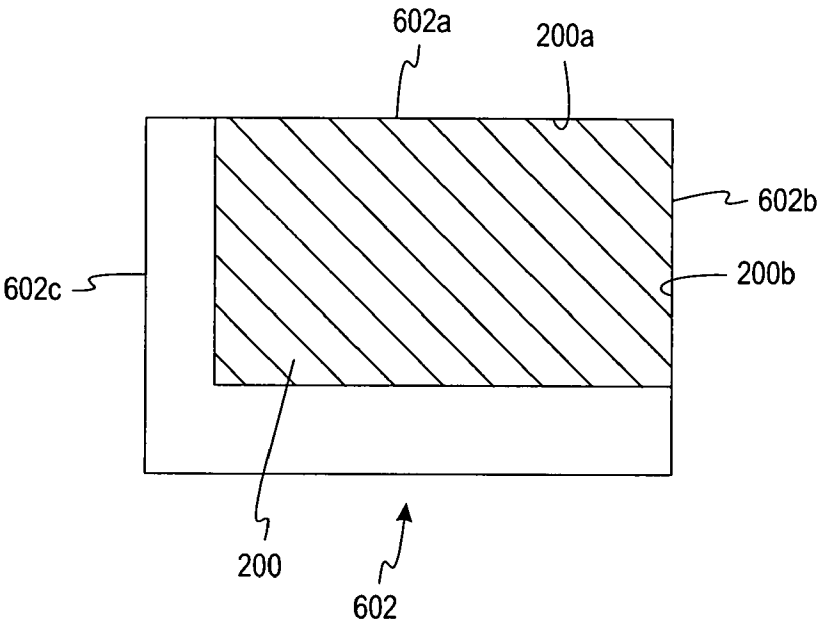
FIG. 6*a* is a top view of an input hopper showing a two-edge alignment of bills.

In some sorters, an operator is required to align two edges of bills placed into an input hopper 602 along two edges of the bills such as edges 200*a* and 200*b* shown in FIG. 6*a*. Referring to FIG. 6*a*, in some devices, in order to get the required two-edge alignment of bills, the operator may need to tap or push the stack of bills against a back 602*a* and a side 602*b* of the hopper 602. However, according to some embodiments of the present invention, bills need only be generally aligned along one edge such as the rear or leading edge 200*a*. Referring to FIG. 6*b*, an operator need only push or tap the bills against rear edge 602*a* of the input hopper. Of course, in both the embodiments shown in FIGS. 6*a* and 6*b* the stack of bills must be laterally positioned within the side walls 602*b* and 602*c* of the input hopper; however, in the embodiment of FIG. 6*a*, the bills must be pushed against or generally aligned with one of the side walls and the rear wall whereas in FIG. 6*b* the lateral positioning of the bills is allowed to shift left and right within the tolerances of the width of the input hopper (the distance between side walls 602*b* and 602*c*). According to some embodiments, a tolerance of four-tenths of an inch (4/10") is provided, that is, the width of the input hopper is dimensioned to be 4/10 inch wider than the width of the widest bill to be accommodated within the hopper. One embodiment of an input receptacle is described and illustrated in more detail in U.S. Pat. No. 5,687,963, entitled "Method and Apparatus for Discriminating and Counting Documents" which is incorporated by reference in its entirety.

According to some embodiments, the input hopper is adapted to accept bills with their wide edge parallel to the front of the machine. Such an arrangement does not require the operator holding a stack of bills about the middle of the bills with the palm of the hand extending over a wide edge of the bills to have to twist his or her wrist to insert the stack of bills into the hopper as would be the case if the input hopper required bills to inserted such that a narrow edge of the bills was parallel to the front of the machine.

According to other embodiments, the input hopper is adapted to accept bills with their narrow edge parallel to the front of the machine—see, e.g., FIG. 20 and the accompanying discussion below.

Figure 7:
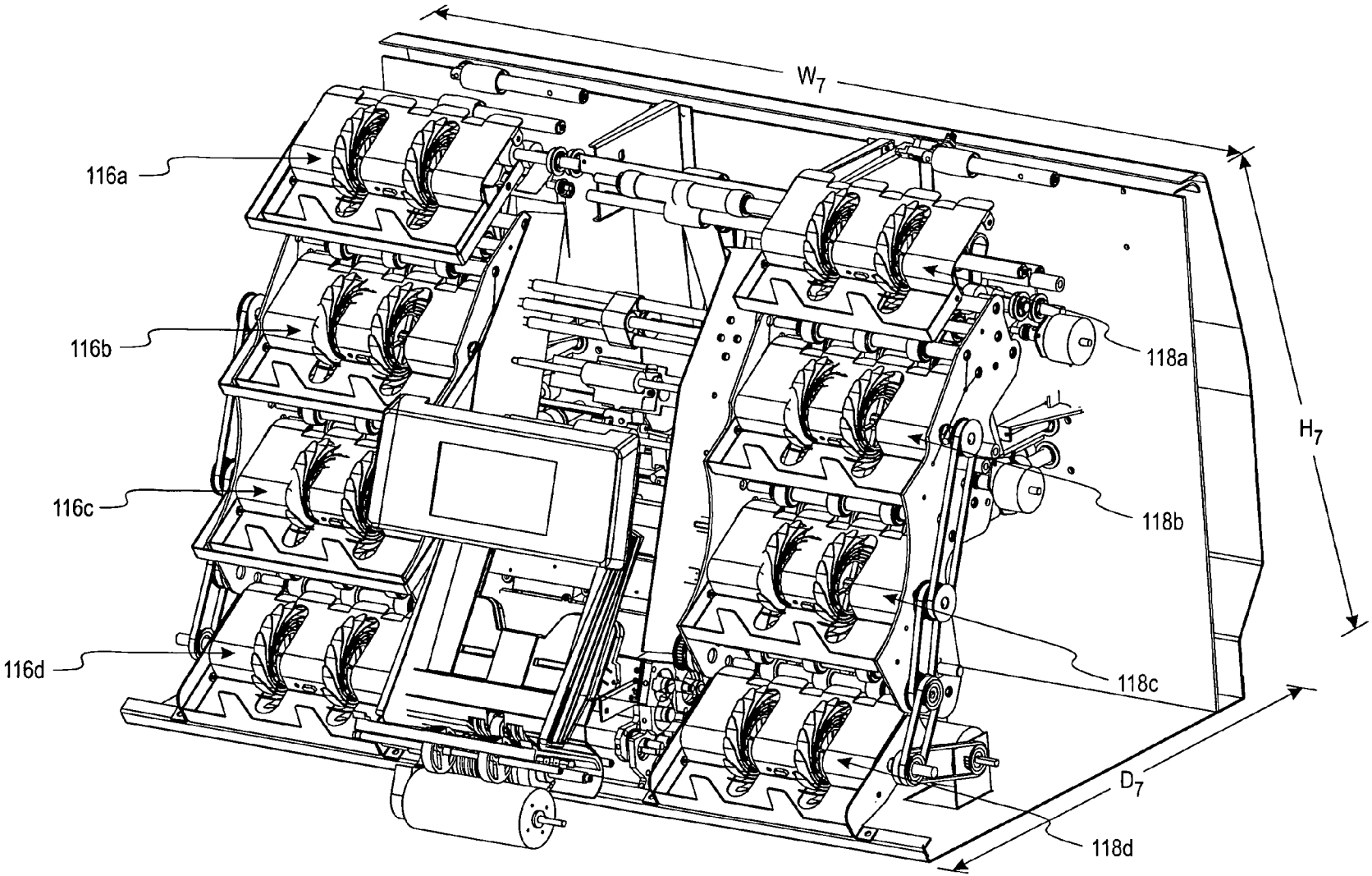
FIG. 7 is a perspective view of the currency sorter of FIG. 1*a* but with the covers removed and some internal components omitted.

FIG. 7 is a perspective view of the currency device 100 of FIG. 1*a* but with the covers removed and some internal components omitted. According to one embodiment of the present invention, the front and side covers of the sorter 100 open in a clam shell fashion, hinged along the top of the enclosure for easy front access to the internal mechanism for maintenance and clearing jams. Thus, an operator simply upwardly rotates the front cover or either side cover to access the internal components of the currency sorter.

Figure 8A:
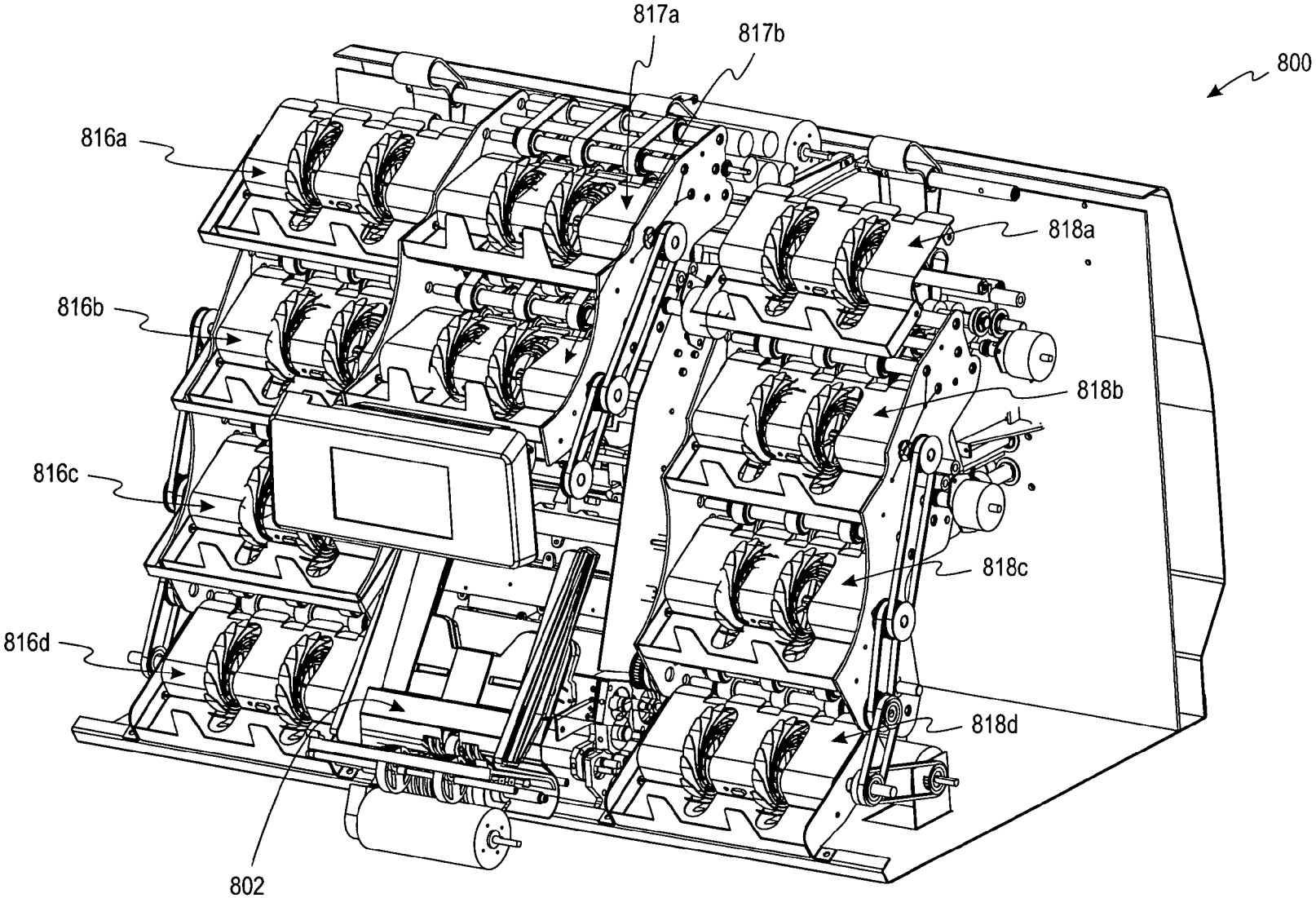
FIG. 8*a* is a perspective view of a ten output pocket currency sorter according to one embodiment.
Figure 8B:
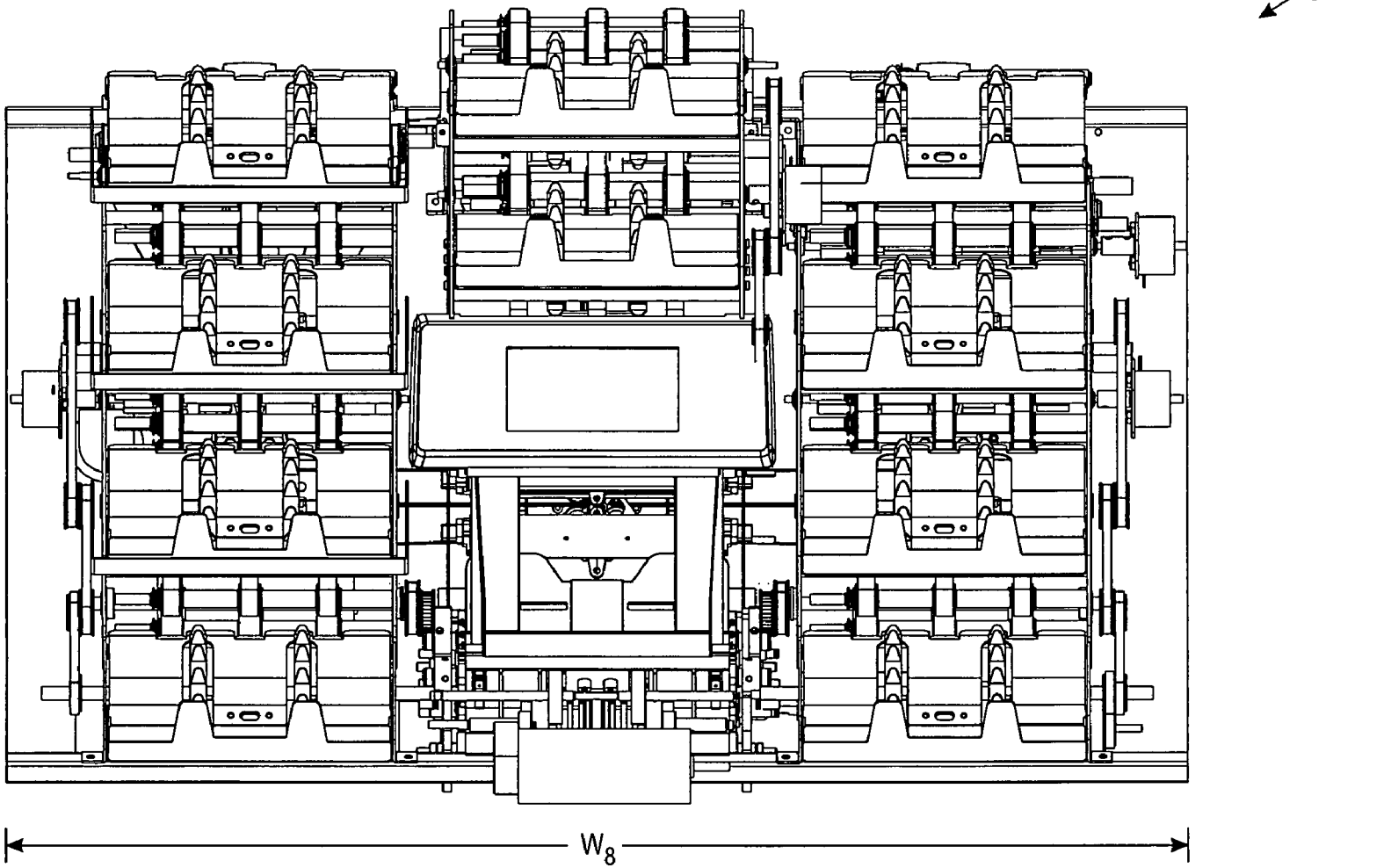
FIG. 8*b* is a front view of the sorter of FIG. 8*a*.
Figure 8C:
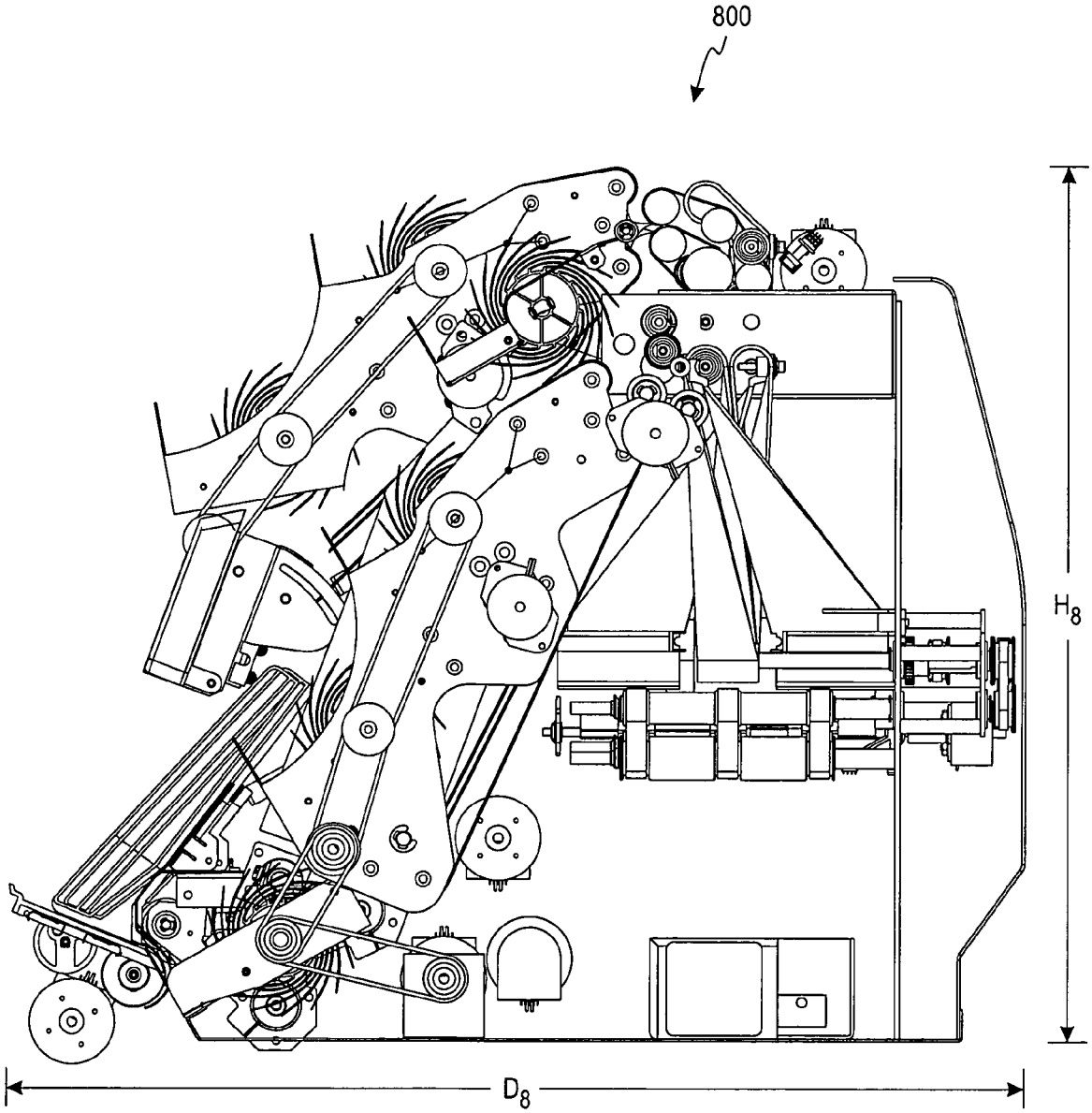
FIG. 8*c* is a side view of the sorter of FIG. 8*a*.

FIG. 8*a* is a perspective view, FIG. 8*b* is a front view, and FIG. 8*c* is a side view of one embodiment of a ten output pocket currency sorter 800 with its covers removed. The sorter 800 is similar to the device 100 of FIG. 1*a* and likewise has four left output receptacles 816*a*-816*d* and four right output receptacles 818*a*-818*d*. Sorter 800 additionally comprises two center output receptacles 817*a* and 817*b*. Such an embodiment can be referred to as a 4-2-4 arrangement (4 left, 2 center, and 4 right output receptacles). In a similar fashion, device 100 of FIG. 1*a* can be referred to as a 4-0-4 arrangement (4 left, 0 center, and 4 right output receptacles). According to some embodiments, the ten output receptacle sorter 800 has a width $W_8$ of about 34 inches (86 cm), a depth $D_8$ of about 25 inches (64 cm) and a height $H_8$ of about 22 inches (56 cm). According to some embodiments the sorter 800 weighs less than 250 pounds. (less than about 113 kg). Thus according to some embodiments a ten output receptacle sorter is provided which has a footprint (width×depth) of less than about 850 $in^2$ (6 $ft^2$) (about 5500 $cm^2$) and a volume of less than about 18,700 $in^3$ (11 $ft^3$) (about 0.3 $m^3$).

Figure 9:
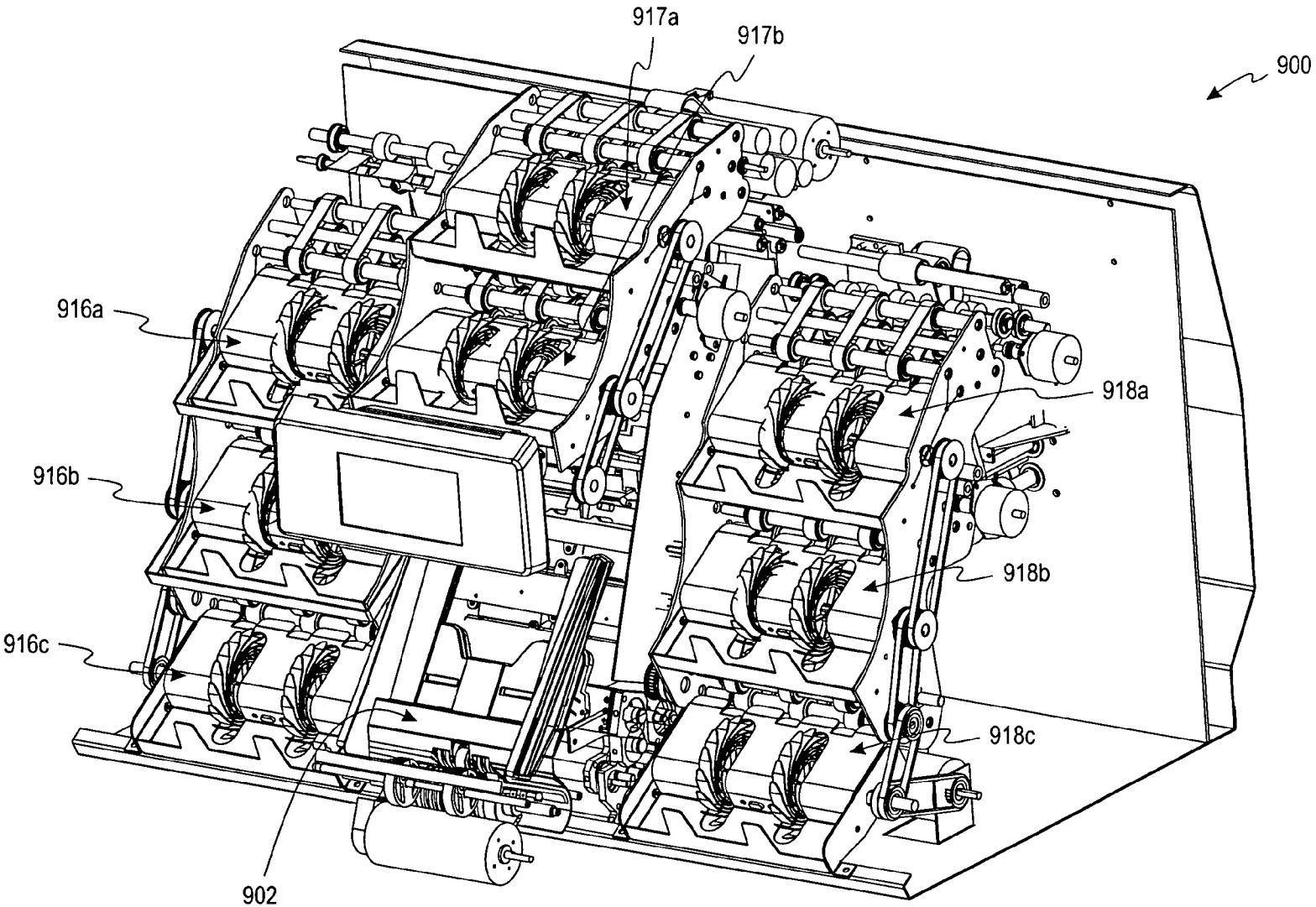
FIG. 9 is a perspective view of an eight output pocket currency sorter according to one embodiment.

FIG. 9 is a perspective view of one embodiment of an eight output pocket currency sorter 900 with its covers removed. The sorter 900 is similar to the sorters 100 of FIGS. 1*a* and 800 of FIGS. 8*a*-8*c* but has three left output receptacles 916*a*-916*c* and three right output receptacles 918*a*-918*c* and two center output receptacles 917*a* and 917*b*—a 3-2-3 arrangement. According to some embodiments, the eight output receptacle sorter 900 has a width $W_8$ of about 34 inches (86 cm), a depth $D_8$ of about 25 inches (64 cm) and a height $H_8$ of about 22 inches (56 cm). According to some embodiments the sorter 800 weighs less than 250 pounds (less than about 113 kg). Thus according to some embodiments a ten output receptacle sorter is provided which has a footprint (width×depth) of less than about 850 $in^2$ (6 $ft^2$) (about 5500 $cm^2$) and a volume of less than about 18,700 $in^3$ (11 $ft^3$) (about 0.3 $m^3$).

Figure 10B:
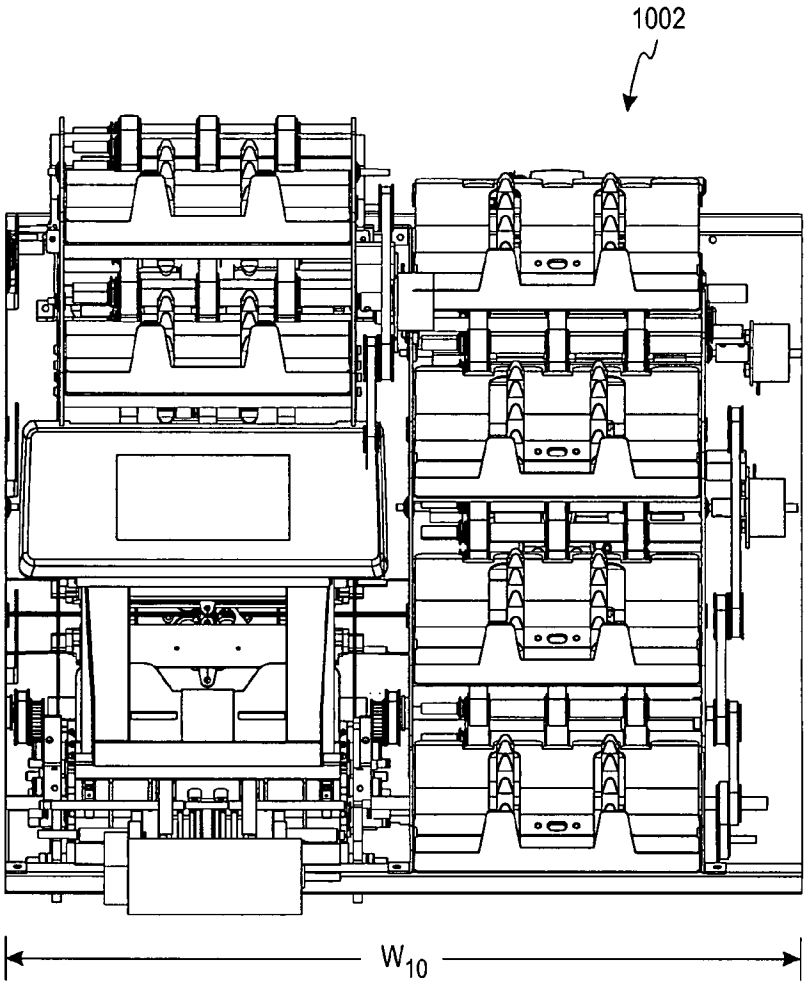
FIG. 10*b* is a front view of a six pocket sorter according to one embodiment.
Figure 10A:
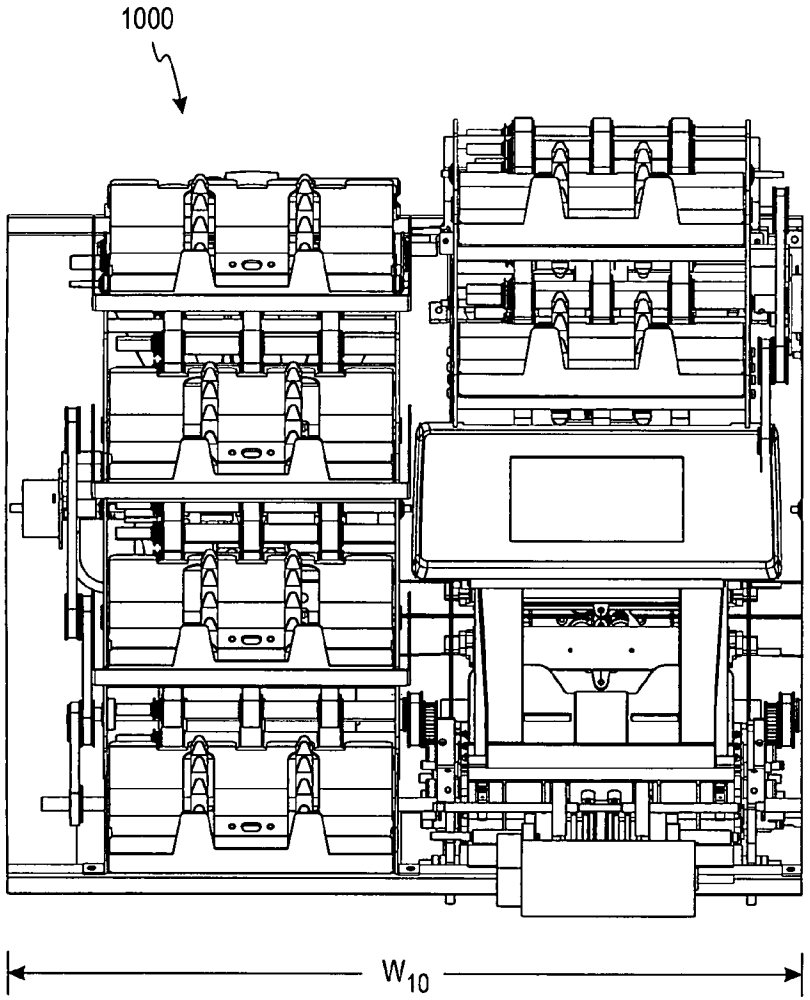
FIG. 10*a* is a front view of a six pocket sorter according to one embodiment.

Although not illustrated, other embodiments are also contemplated within the present invention. For example, starting with the ten pocket embodiment of FIGS. 8*a*-8*c*, the number of left output receptacles can be varied between zero and four, the number of center output receptacles can be varied between zero and two, and the number of right output receptacles can be varied between zero and four.

Where the number of left or right output receptacles is zero, the width, footprint, and volume of the overall device can be correspondingly reduced. For example, where no left output pockets are provided, the width $W_{1L}$ shown in FIG. 1*b* is avoided making the width of the overall device about 29 inches (about 73.7 cm), while the depth remains at about 25 inches (64 cm) and the height remains at about 22 inches (56 cm). Thus according to some embodiments an up to six output receptacle sorter (e.g., 0 left, 2 center, and 4 right output pockets—a 0-2-4 configuration) can be provided which has a footprint of less than about 739.5 $in^2$ (about 5.1 $ft^2$) (about 4771 $cm^2$) and a volume of less than about 19,967 $in^3$ (about 11.6 $ft^3$) (about 0.327 $m^3$). According to some embodiments the sorter 800 weighs less than 250 pounds (less than about 113 kg). Accordingly, in such embodiments, the input hopper is not located in the center column but may instead be located in a column at one end of the sorter. For example, FIG. 10*a* illustrates a front view of a six pocket sorter 1000 having two pockets above the input hopper and four pockets in a column to the left of the input pocket (4-2 arrangement). Likewise, FIG. 10*b* illustrates a front view of a six pocket sorter 1002 having two pockets above the input hopper and four pockets in a column to the right of the input pocket—a 2-4 arrangement. As mentioned above such embodiments may have a width $W_{10}$ of about 29 inches (about 73.7 cm).

Figure 11A:
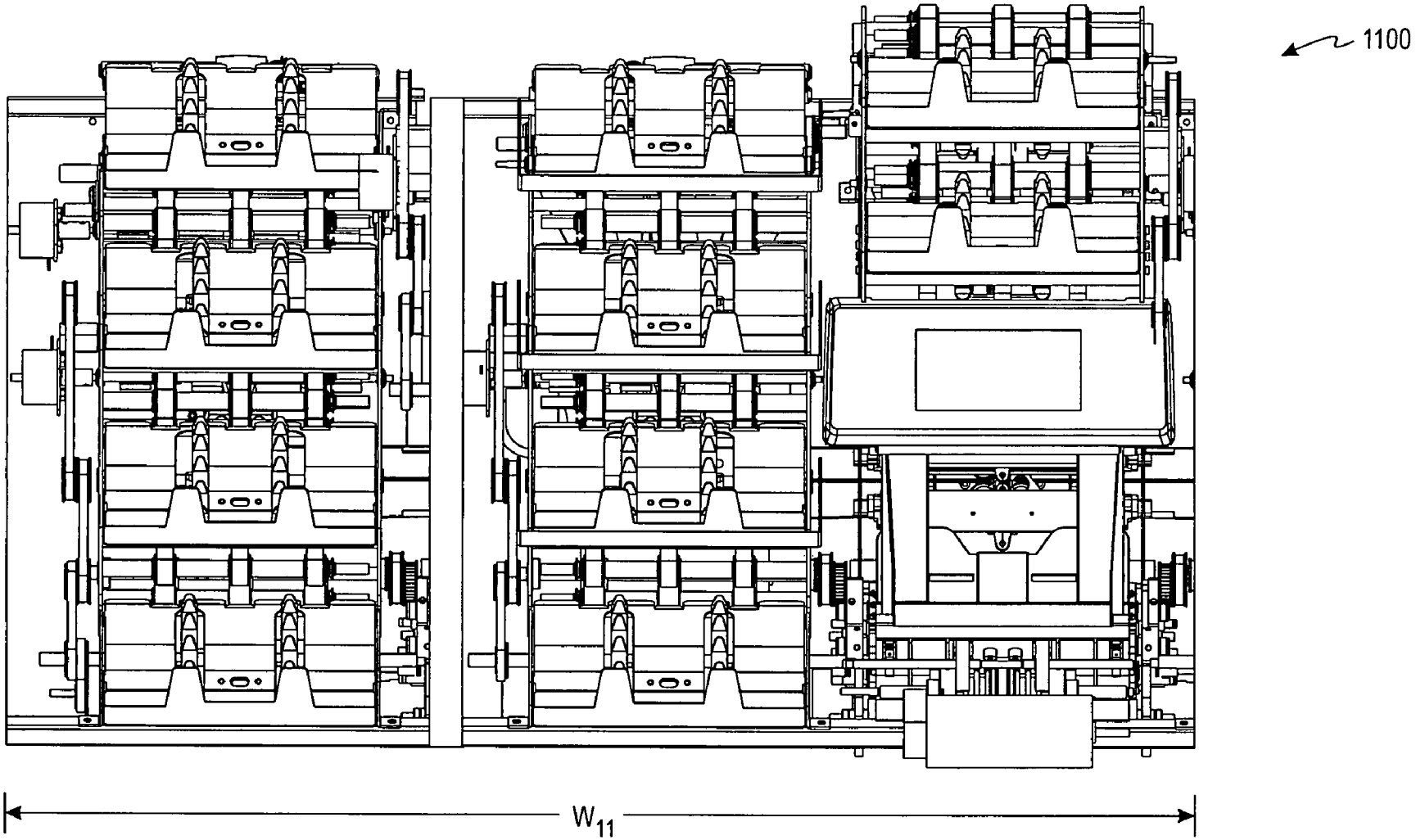
FIG. 11*a* is a front view of a ten pocket sorter according to one embodiment.
Figure 11B:
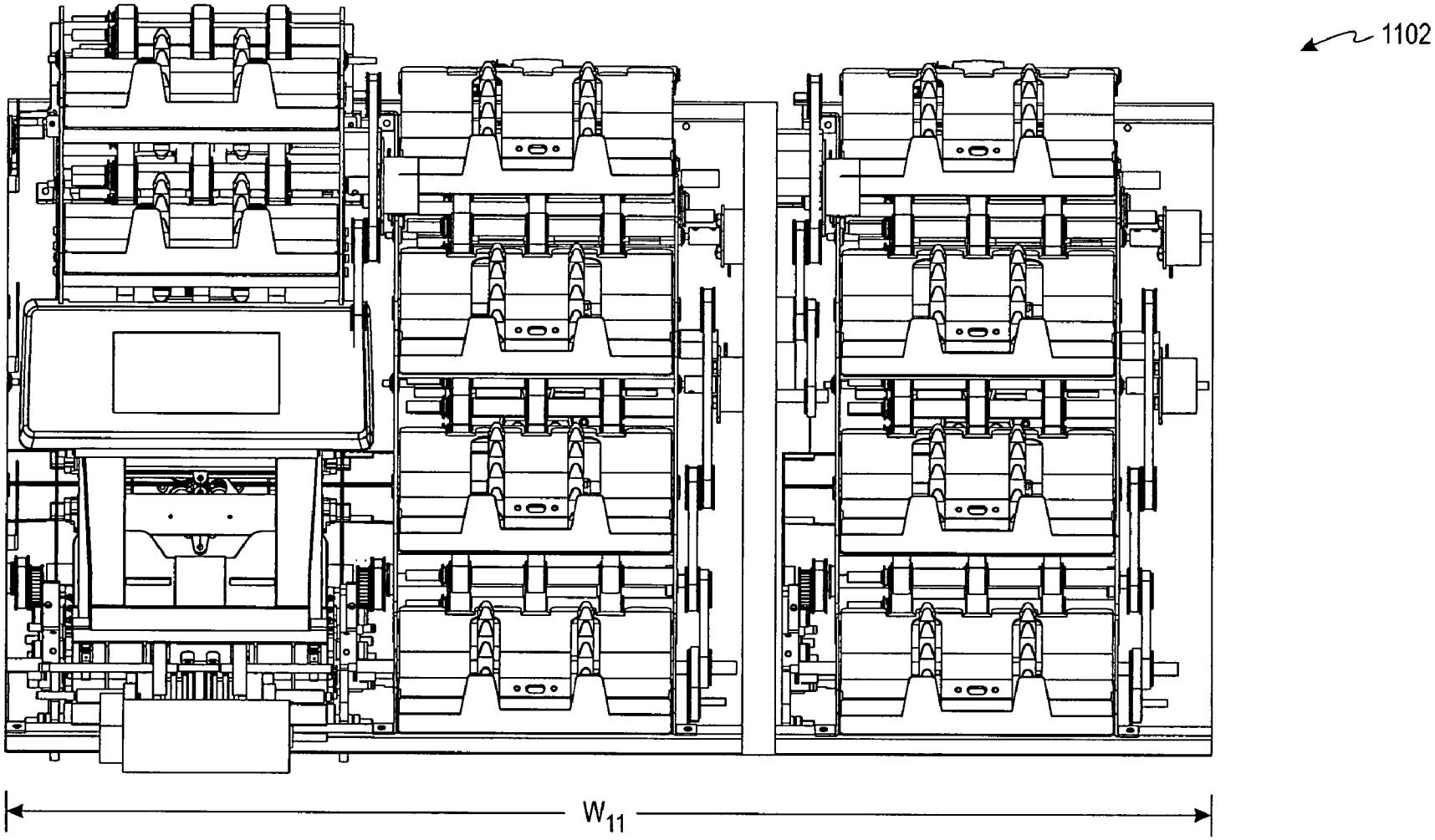
FIG. 11*b* is a front view of a ten pocket sorter according to one embodiment.

In other embodiments, two or more columns of pockets are provided to the left and/or right of the input hopper. For example, FIG. 11*a* illustrates a front view of a ten pocket sorter 1100 having two pockets above the input hopper and two columns of four pockets to the left of the input pocket—a 4-4-2 arrangement. Likewise, FIG. 11*b* illustrates a front view of a ten pocket sorter 1102 having two pockets above the input hopper and two columns of four pockets to the right of the input pocket (2-4-4 arrangement). According to some embodiments, such sorters 1100, 1102 may have a width $W_{11}$ of about 44 in (about 111.7 cm), while the depth remains at about 25.5 in (about 64 cm) and the height remains at about 27 in (56 cm). Thus according to some embodiments an up to ten output receptacle sorter can be provided which has a footprint of less than about 1122 $in^2$ (about 7.8 $ft^2$) (about 7240 $cm^2$) and a volume of less than about 30,300 $in^3$ (about 17.5 $ft^3$) (about 0.496 $m^3$).

Furthermore, more than four output receptacles may be included in a column of pockets. For example, by increasing the height of the sorter, five left and/or right and three center pockets may be included increasing the total number of pockets up to thirteen (5-3-5 arrangement). Likewise, six left and/or right pockets and four center pockets may be provided and thereby increase the total number of pockets up to sixteen (6-4-6 arrangement). Additional details of columns having from two to six pockets are provided in to in U.S. Pat. Nos. 6,311,819 and 6,278,795 B1; each of which is incorporated herein by reference in its entirety. More output receptacles per column are also contemplated such as, for example, columns containing seven or eight output receptacles.

Figure 12A:
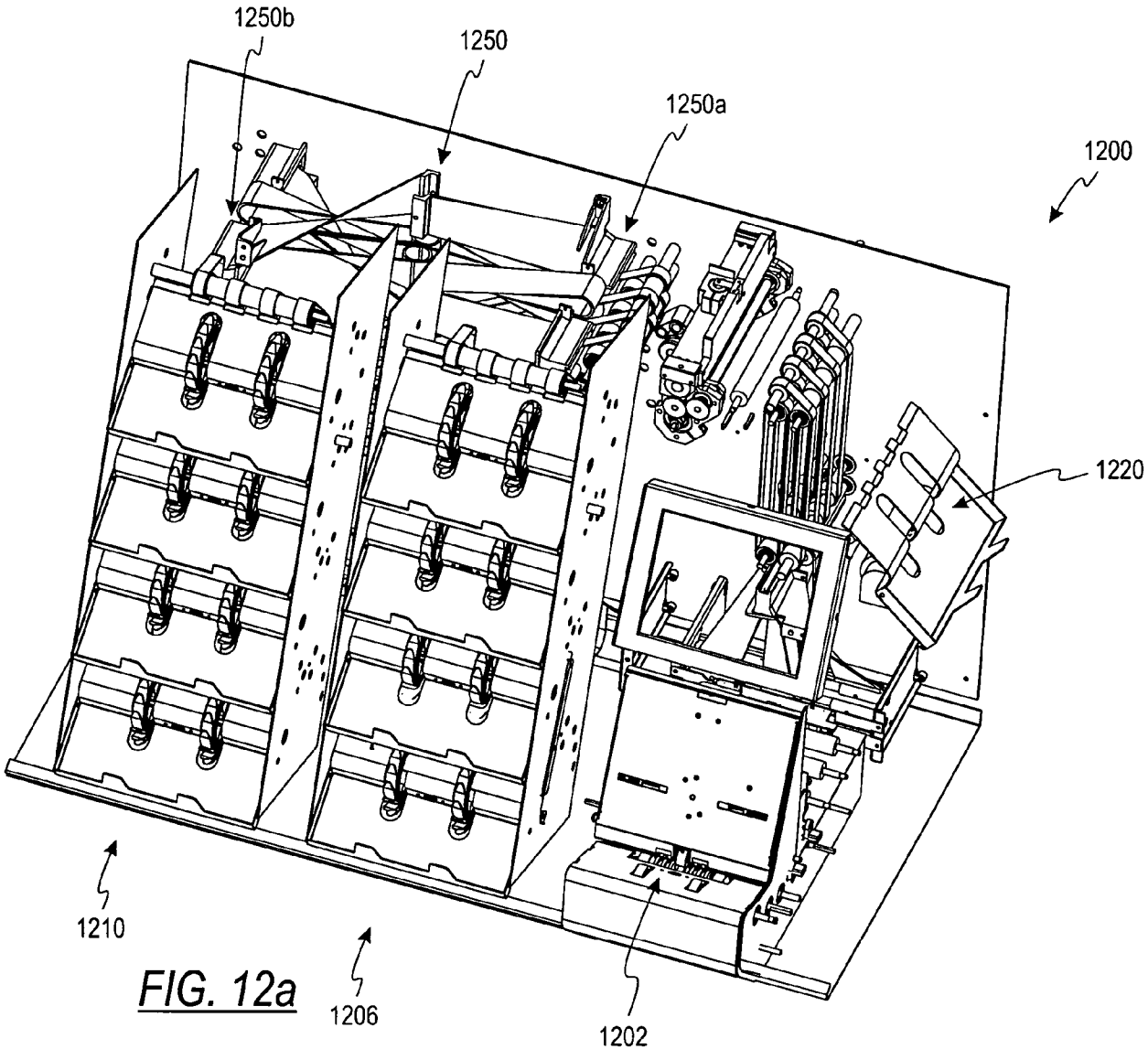
FIG. 12*a* is a perspective view of a nine pocket currency sorter according to one embodiment.
Figure 12B:
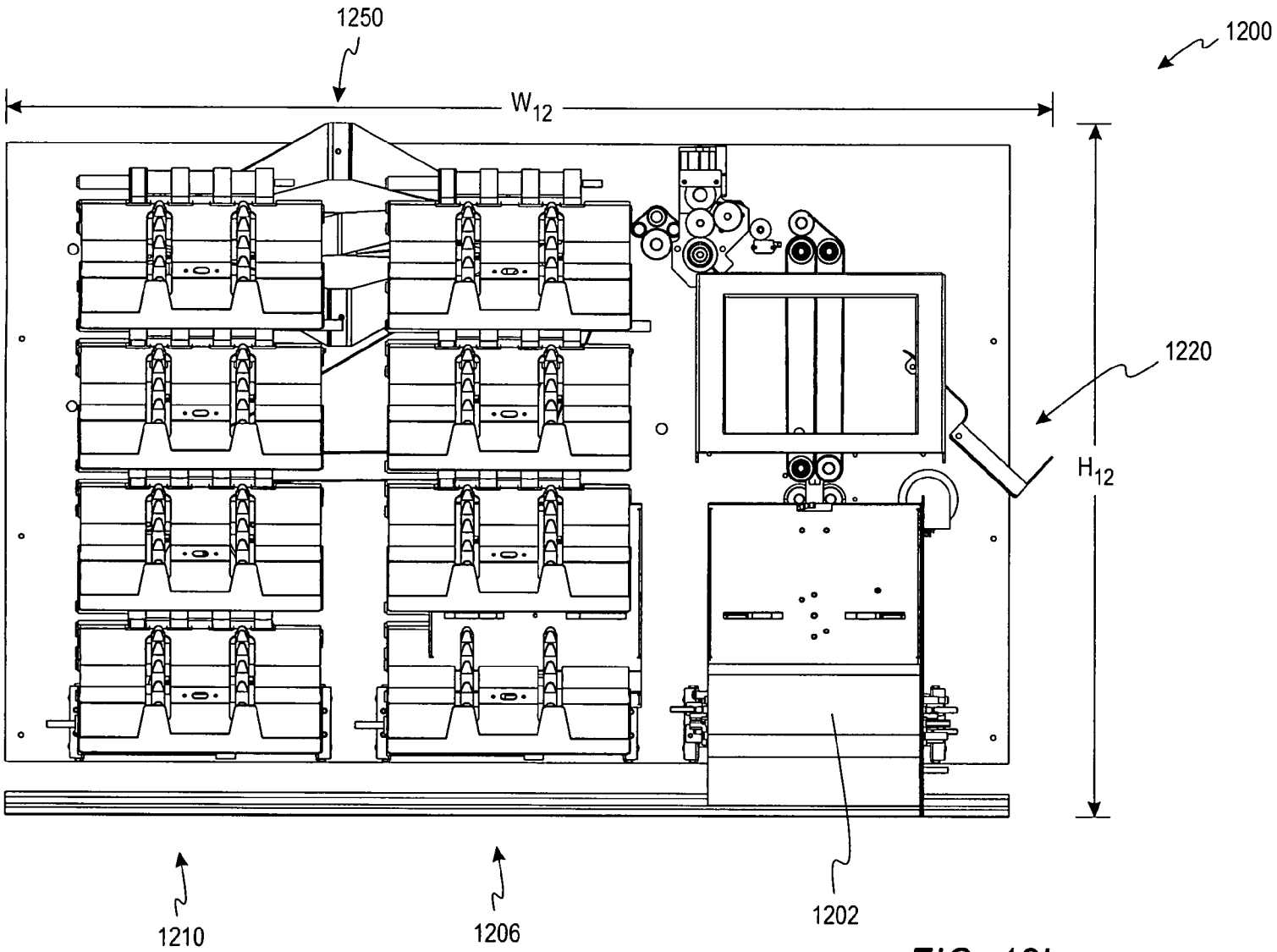
FIG. 12*b* is a front view of the sorter of FIG. 12*a*.
Figure 12C:
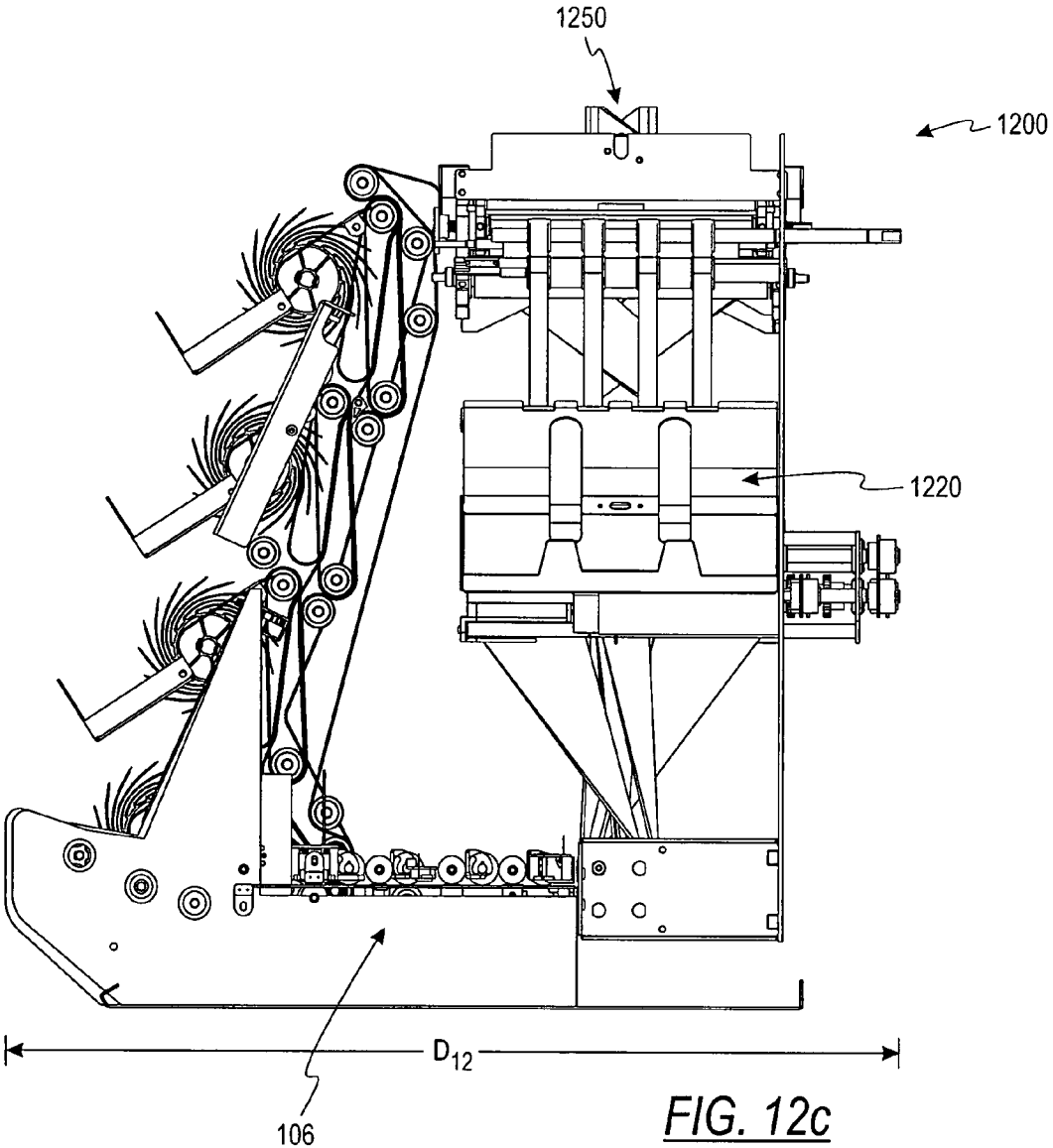
FIG. 12*c* is a right side view of the sorter of FIG. 12*a*.
Figure 12D:
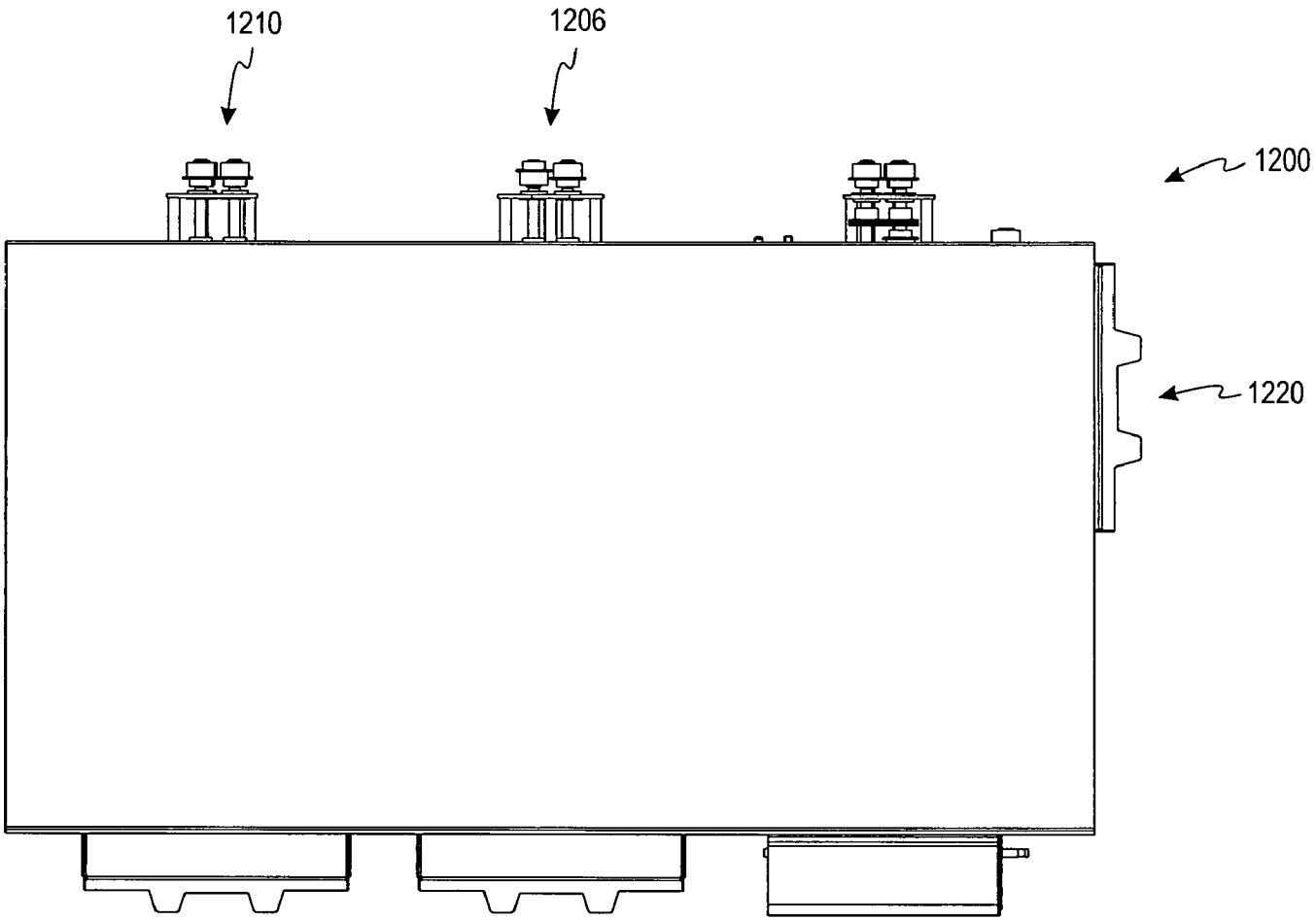
FIG. 12*d* is a top view of the sorter of FIG. 12*a*.

Additionally, not all or any of the output receptacles need to be on the same side of the sorter as the input hopper. FIG. 12*a* is a perspective view of a currency sorter 1200 having an input hopper 1202 and two columns 1206, 1210 of four output receptacles to the left of the input hopper 1202. Additionally, a ninth output receptacle 1220 is positioned on the right side of the sorter 1200. FIG. 12*b* is a front view, FIG. 12*c* is a right side view, and FIG. 12*d* is a top view of the sorter 1200. As can be seen, sorter 1200 illustrates an embodiment in which not all output receptacles are located on the front of the sorter 1200. According to some embodiments, sorter 1200 may have a width $W_{12}$ of 34 inches (86 cm), a depth $D_{12}$ of about 22 inches (56 cm) and a height $H_{12}$ of about 30 inches (about 76.2 cm). Thus according to some embodiments an up to nine output receptacle sorter can be provided which has a footprint of less than about 748 $in^2$ (about 5.2 $ft^2$) (about 4826 $cm^2$) and a volume of less than about 22,440 $in^3$ (about 13 $ft^3$) (0.368 $m^3$). In FIG. 12*c*, one exemplary location of one or more sensors of a discriminating unit 106 is shown. According to some embodiments the discriminating unit 106 comprises an imager 106*a*. According to some embodiments, the discriminating unit does not comprise an imager 106*a*.

Figure 13A:
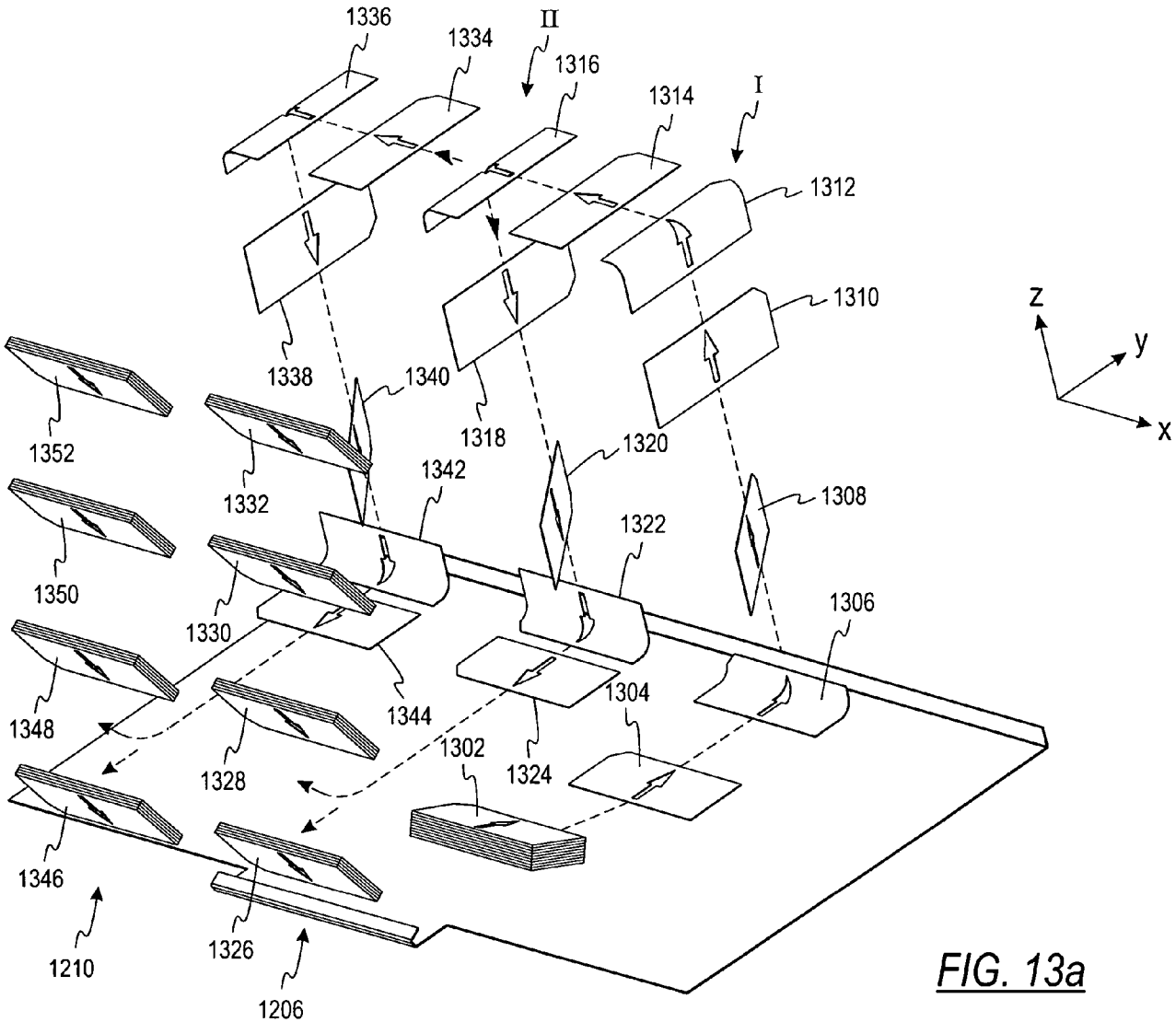
FIG. 13*a* is a perspective view of a currency bill flow sequence within the sorter of FIG. 12 according to one embodiment.
Figure 13B:
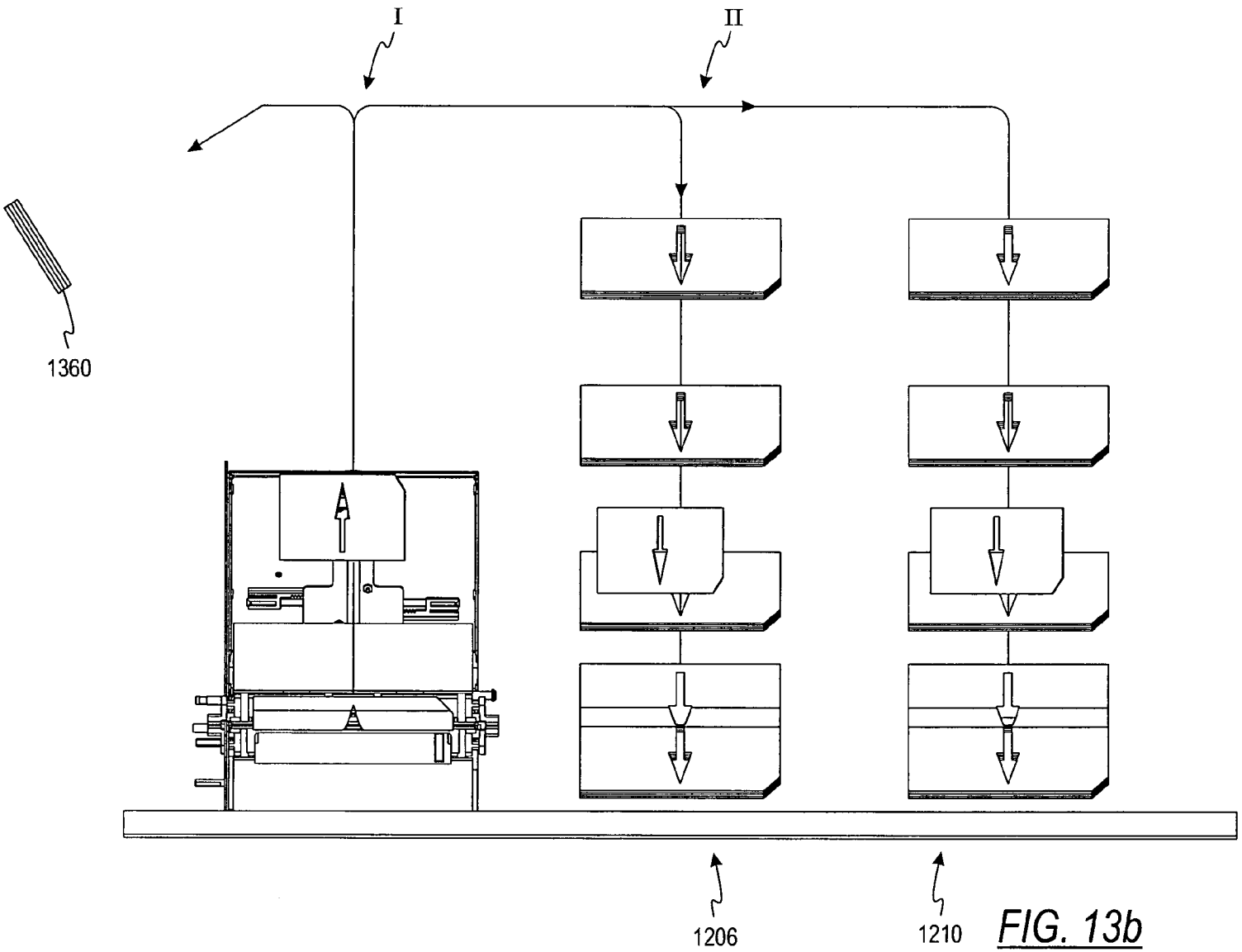
FIG. 13*b* is a rear view of a currency bill flow sequence within the sorter of FIG. 12 according to one embodiment.
Figure 13C:
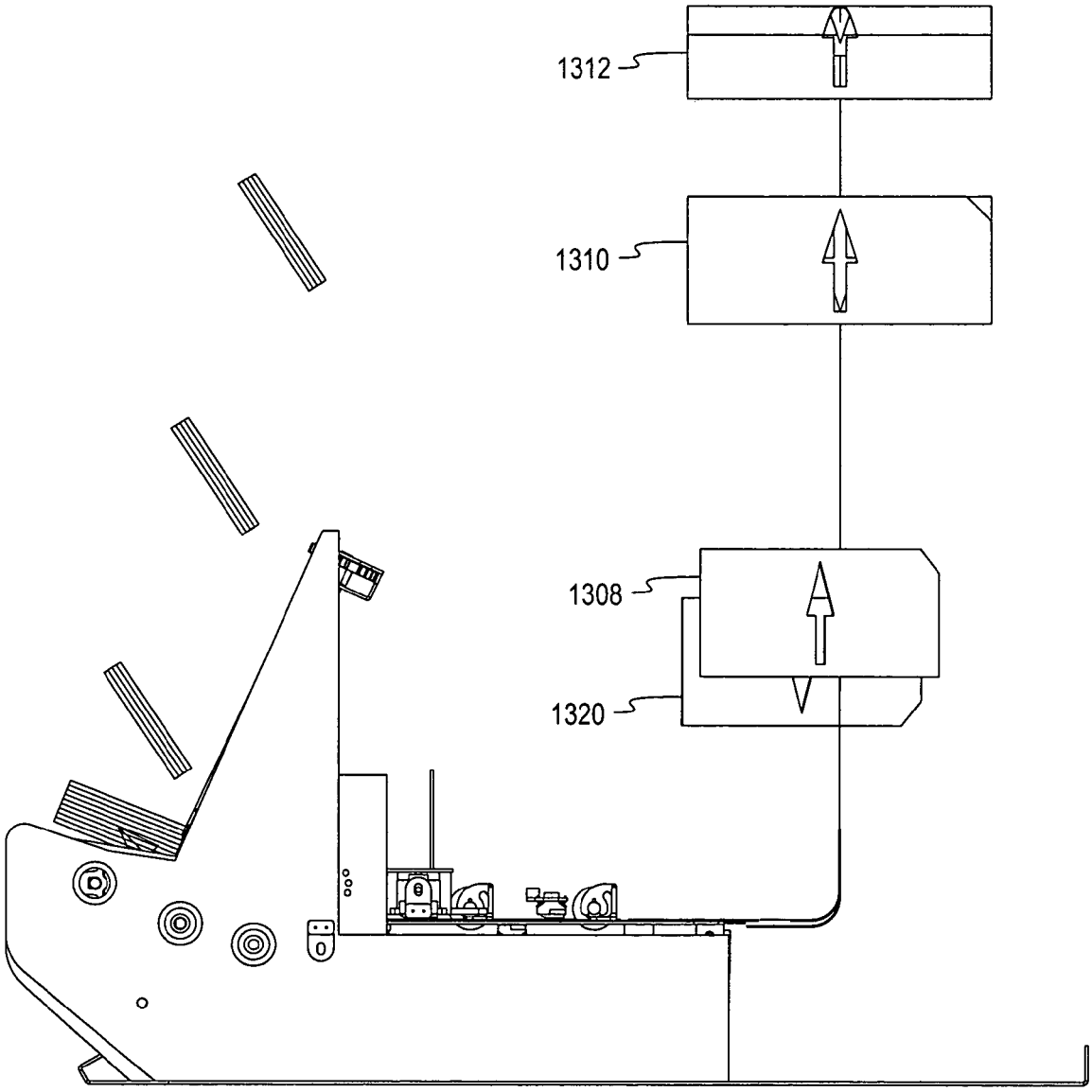
FIG. 13*c* is a side view of a currency bill flow sequence within the sorter of FIG. 12 according to one embodiment.
Figure 13D:
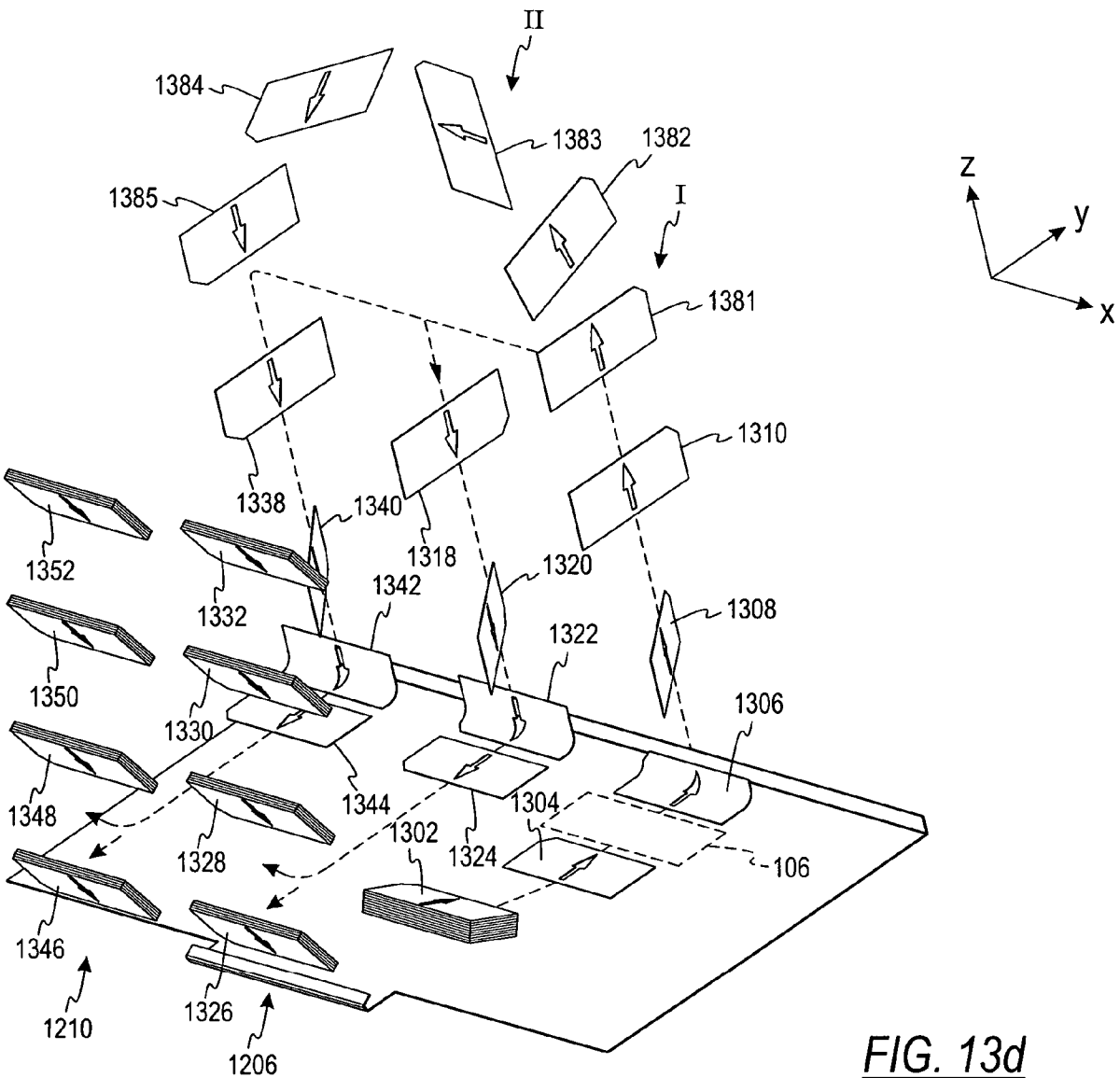
FIG. 13*d* is a perspective view of a currency bill flow sequence within the sorter of FIG. 12 through the optional bill facing mechanism according to one embodiment.

FIG. 13*a* is a perspective view, FIG. 13*b* is a rear view, and FIG. 13*c* is a side view depicting the path and orientation of currency bills according to the embodiment of FIG. 12. In FIG. 13*d*, one exemplary location of one or more sensors of a discriminating unit 106 is shown. According to some embodiments the discriminating unit 106 comprises an imager 106*a*. According to some embodiments, the discriminating unit does not comprise an imager 106*a*.

Referring primarily to FIG. 13*a*, a bill is feed from the input hopper at location 1302 generally backward to location 1304 and then directed upward at 1306. At locations 1304, 1306 the leading edge of a bill is generally parallel to the X-axis. While traveling upward, the bill is rotated as can be seen at location 1308 by a rotating mechanism. The rotating mechanism re-orients the leading edge of a bill from being generally parallel to the X-axis (location 1306) to being generally parallel to the Y-axis (location 1310). In some embodiments, the rotating mechanism re-orients the leading edge of a bill by 90°.

Having been re-oriented to have its leading edge be parallel to the Y-axis, the bill may be diverted left or right in the x-direction. As illustrated in FIG. 13*a*, a bill is diverted to be left at location 1312 (location I) toward location 1314. Although not illustrated in FIG. 13*a* for the purposes of clarity, as can be seen in FIG. 13*b*, a bill can also be diverted to the right (as seen from the front of the sorter) at location I and directed to location 1360, that is into pocket 1220. (Note that FIG. 13*b* is a rear view of the sorter 1200.) According to some embodiments, a moveable diverter directs bills at location I to either the left or to the right. The diverter may be controlled by a controller or processor that moves the diverter so as to direct a bill toward a desired output receptacle.

Returning to FIG. 13*a*, a bill moves from location 1314 to location II where it may be either diverted downward as shown by location 1316 or directed to the left to location 1334. A bill directed downward at location II is run through another rotating mechanism which re-orients a bill from having its leading edge being parallel to the Y-axis (location 1318) to having its leading edge being parallel to the X-axis (location 1322). A bill is then direction forward and then into one of the pockets in column 1206 as indicated by locations 1326-1332. Note in this arrangement, the first receptacle a bill comes to in column 1206 is the bottom pocket and the last receptacle along the transport path is the top pocket in column 1206.

If a bill is to be routed to one of the output receptacles in column 1210 it would not be directed downward at location II but rather would be directed to location 1334 and then downward at location 1336. A rotating mechanism then re-orients the leading edge of the bill from being parallel to the Y-axis (location 1338) to being parallel to the X-axis (location 1342). A bill is then routed to one of the output receptacles in column 1210 in the same manner as described in conjunction with column 1206.

FIG. 13*d* illustrates the movement of a currency bill through an optional bill facing mechanism 1250 (FIGS. 12*a-c*). The bill facing mechanism is used to rotate the orientation of a bill approximately 180°. For example, if a U.S. bill is initially presented (placed in the input hopper 1202) with the surface bearing a portrait of a president facing down, it may be directed to the bill facing mechanism 1250, whereupon it will be rotated 180° so that the bill surface with the portrait faces up when delivered to an output receptacle in the second column 1210. While other arrangements are contemplated, in the embodiments illustrated in FIGS. 12*a* and 13*d*, the bills that are feed into the bill facing mechanism 1250 are routed to one of the output receptacles in the second column 1210. The decision may be taken to send a bill to the facing mechanism 1250 when the selected mode of operation or other operator instructions call for maintaining a given face orientation of bills as they are processed by the currency processing device 1200. For example, it may be desirable in certain circumstances for all of the bills ultimately delivered to the output receptacles to have the same face orientation. In such embodiments of the currency handling device 1200, the device is capable of determining the face orientation of a bill, such that a bill not having the desired face orientation can first be directed to the bill facing mechanism 1250 before being delivered to the appropriate lower output receptacle. Face orientation may be determined using one or more of the bill characteristic sensors. In some embodiments, an imager is used to determine face orientation. In some embodiments, non-image sensor are used to determine face orientation.

According to one embodiment the bill facing mechanism 1250 comprises a part of twisted endless belts as described in U.S. Pat. No. 6,371,303 ("Two Belt Bill Facing Mechanism"), which is hereby incorporated by reference in its entirety. Referring to both FIGS. 12 and 13*d*, a bill's orientation is determined by one or more bill characteristic sensors of the currency device 1200. Pursuant to some modes of operation, a bill may be directed to the bill facing mechanism 1250 at location II in FIG. 13*d*—the bill is labeled with reference number 1381 at this position. Bills enter the facing mechanism 1250 at an inlet 1250*a* (see FIG. 12*a*). Once within the facing mechanism 1250, the orientation of the bill is rotated 180° while its leading edge remains constant. In FIG. 13*d*, the bill is shown being rotated 180° through bill positions 1381-1385 while the leading edge of the bill remains constant as the bill moves through the bill facing mechanism 1250. At the output 1250*b* of the bill facing mechanism (see FIG. 12*a*), the bill is directed towards the second column 1210 of output receptacles.

While the bill facing mechanism 1250 has been shown and described as a facing mechanism consisting of a pair of belts for rotating the orientation of the bills, other types of facing mechanisms may be used in alternative embodiments of the currency processing device of the present invention. For example, the document facing mechanism of U.S. Pat. No. 6,074,334 ("Document Facing Method and Apparatus"), which is hereby incorporated by reference in its entirety, may be implemented in connection with alternative embodiments of the present invention.

Figure 14B:
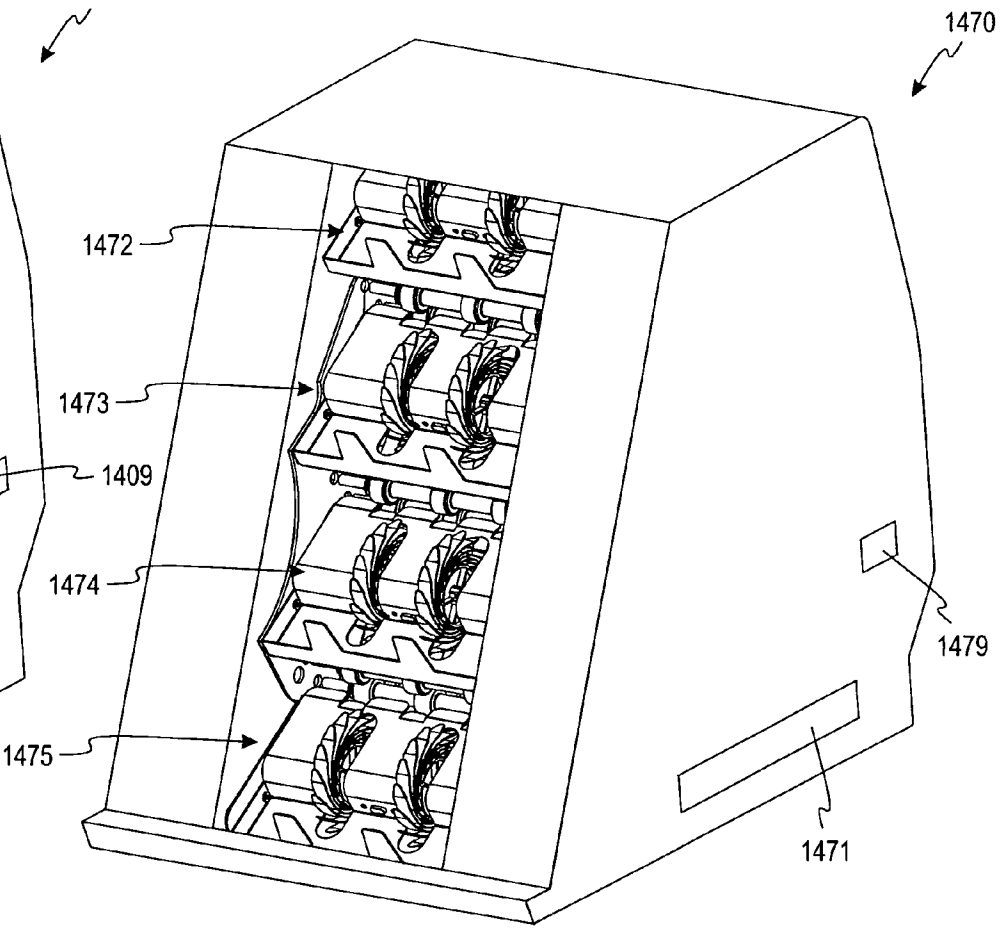
FIG. 14*b* is a perspective view of a modular output receptacle unit.
Figure 14A:
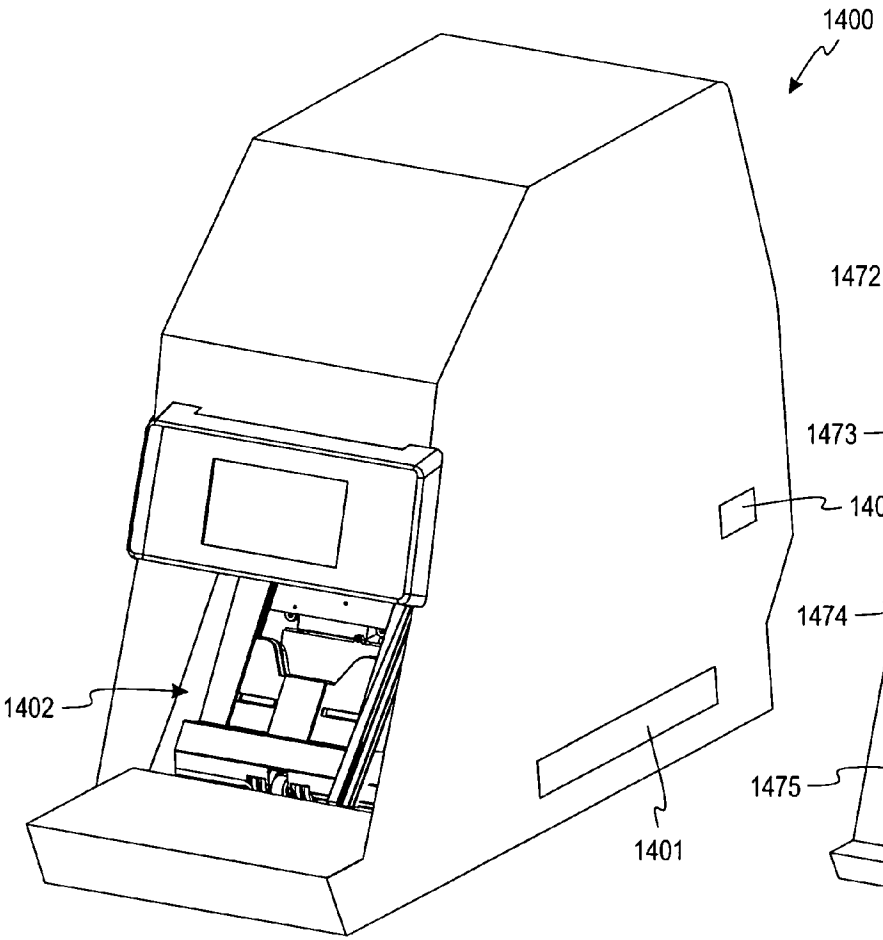
FIG. 14*a* is a perspective view of a currency evaluating unit adapted to be coupled to modular output receptacle units.

FIG. 14*a* is a perspective view of a currency evaluating unit 1400 adapted to be coupled to one or more modular output receptacle units 1470. FIG. 14*b* is a perspective view of a modular output receptacle unit or output receptacle module

1470. The modular-ready currency evaluating unit 1400 comprises an input receptacle 1402 adapted to receive a stack of bills to be processed. As discussed above, the currency evaluating unit 1400 comprises one or more bill characteristic sensors which can be employed to count, denominate, authenticate, and/or otherwise discriminate, evaluate, and/or analyze the bills. In the illustrated embodiment, the evaluating unit 1400 contains no output receptacles. However, in other embodiments, the currency evaluating unit 1400 may comprise one or more output receptacles such as the two output receptacles 817*a* and 817*b* illustrated in FIG. 8*a*. The modular-ready currency evaluating unit 1400 also comprises one or more currency delivery ports 1401. For example, one delivery port 1401 can be seen on the right side of the evaluating unit 1400. In some embodiments, the evaluating unit 1400 has delivery ports 1401 on both left and right sides, only the right side, or only the left side.

In the embodiment illustrated in FIG. 14*b*, the modular output receptacle unit 1470 has a delivery port 1471 on both its left and right side. The delivery ports 1471 of modular output receptacle unit 1470 are adapted to mate with the delivery ports 1401 of the currency evaluating unit 1400 and/or the delivery ports 1471 of additional modular output receptacles. In other embodiments, modular output receptacle units have delivery ports on only a single side. In the illustrated embodiment, the output receptacle unit 1470 has four output receptacles 1472-1475. In other embodiments, the number of output receptacles varies from one output receptacle to more than one output receptacle. For example, the output receptacle unit may have three output receptacles such as illustrated by output receptacles 918*a*-918*c* of FIG. 9.

The currency evaluating unit 1400 is adapted to be coupled to one or more modular output receptacle units 1470 and thereby deliver bills to the output receptacles contained in the modular output receptacle unit(s). For example, if modular output receptacle unit 1470 were coupled to the right side of currency evaluating unit 1400, port 1401 would mate with a port 1471 on the left side of unit 1470 so as to permit bills to be transported from the evaluating unit 1401 to unit 1470. Units 1400 and 1470 may also comprise mating structural couplings to facilitate a strong physical coupling between the units. Units 1400 and 1470 may also comprise means for electrically coupling the two units so as to at least provide a means for the evaluating unit 1400 to send control signals to the output receptacle unit 1470 to indicate to which output receptacle within the output receptacle unit 1470 a particular bill is to be directed. One example of such an electronic coupling means is illustrated as jack 1409 which may be adapted to mate with a jack 1479 of an output receptacle unit 1470. As illustrated in FIGS. 14*a* and 14*b*, jacks 1409 and 1479 are both illustrated on the right side of the respective units 1400 and 1470, it being understood the such jacks may be located on either or both sides. Likewise, in some embodiments, the electrical coupling may be accomplished via the delivery ports 1401 and 1471. The electrical coupling may permit one-way or two way communication between the two units 1400 and 1470. For example, encoder and/or bills tracking information may be supplied from an output receptacle unit 1470 to the evaluating unit 1400. In some embodiments, the electrical coupling also comprises power coupling so that the currency evaluation unit 1400 may be connected to a power supply (e.g., a wall receptacle) and then supply any needed power to any output receptacles units 1470 coupled thereto-thereby eliminating the need to separately couple the output receptacle unit(s) to a power supply.

In some embodiments, additional modular output receptacle units may be added as needed. For example, two, three, or more output receptacle units 1470 may be coupled in series to either the left or the right of a currency evaluating unit 1400. Likewise, a series of one or more modular output receptacle units 1470 may be added to both sides of a currency evaluating unit 1400. Likewise, in some embodiments, delivery ports are included in the previously described embodiments (e.g., those described in connection with FIGS. 1-13) to permit modular output receptacles to be coupled thereto. For example, a base currency evaluating and sorting unit may be in the form illustrated in FIG. 10*a* or 10*b* which may be adapted to be coupled with one or more modular output receptacle units. Furthermore, the modular output receptacle units may comprise more than one column of receptacles within a modular unit such as a modular unit comprising two columns of four output receptacles.

While in the illustrated examples discussed above, the input receptacle is shown as residing in the bottom of the sorter, in some embodiments the input receptacle is positioned near of the top of the sorter. Furthermore, such embodiments may include one, two, or more output receptacles below in the input receptacle. In other embodiments, the input receptacle may be positioned in a vertically middle part of the sorter with or without one or more output receptacles positioned above and/or below the input receptacle.

In a similar vein, the location of one or more user interfaces of a sorter may be varied. For example, a user interface may be positioned in a column above or below the input receptacle or above or below and one or more output receptacles. A user interface may be positioned in a column above both the input receptacle and one or more output receptacles or below both the input receptacle and one or more output receptacles. A user interface may be positioned in a column and have an input hopper above the user interface and zero, one or more output receptacles below the user interface or a user interface may be positioned in a column and have an input hopper below the user interface and zero, one or more output receptacles above the user interface. A user interface may be positioned in a column having one or more output receptacles but not the input receptacle. Furthermore, a user interface may be positioned on top of or on the side of a sorter or be separate from and electrically coupled to the sorter, e.g., a separate keyboard or touchscreen.

According to some embodiments of the present invention, sorters may comprise an operator or user interface adapted to receive information from and/or provide information to an operator or user. According to some embodiments, such as illustrated in FIG. 1*a*, the interface includes a touch screen. The touch screen may display appropriate "functional" keys when appropriate. Alternatively or additionally physical keys, switches or buttons may be employed. Some embodiments of user interfaces are described and illustrated in more detail in U.S. Pat. No. 6,311,819, which is incorporated herein by reference in its entirety.

According to some embodiments, by means of an interface the operator can select an operational mode of a compact multi-pocket sorter including, but not limited to sorting, denominating, authenticating, fitness evaluating, counting and/or combinations of operations. For example, the operator, via the interface may assign a denomination (or other bill criterion/criteria including rejected or unrecognized notes) to each output receptacle pocket and/or change the output receptacle assignment for a denomination (or other bill criterion/criteria). Alternatively or additionally, the operator may select a dynamic mode assignment for assigning denominations (or other criterion/criteria) to output receptacles as described in more detail in U.S. patent application Ser. No. 10/068,977, which was filed on Feb. 8, 2002 and published as U.S. Patent Publication No. 2003-0015395A1 entitled "Multiple Pocket Currency Processing Device and Method," incorporated herein by reference by its entirety.

The interface may act as a routing interface and/or flagging control interface as described in more detail in U.S. Pat. No. 6,311,819, which is incorporated herein by reference in its entirety. For example, via the interface, the operator may select an operation mode wherein the operation of the sorter will be suspended based on certain conditions, for example, the detection of a counterfeit bill or a bill in a damaged condition. According to some embodiments, during operation a bill may be flagged, for example, by presenting the bill in one of the output receptacles (delivering the bill to one of the receptacles and suspending operation of the device) or by off-sorting the bill to a different output pocket and continuing to process other bills.

According to some embodiments, a compact multi-pocket sorter has a routing interface. The routing interface has a data retrieval device such as a touch screen that receives information from a user of the device specifying into which output receptacle bills are to be delivered based on one or more criteria.

According to another embodiment, a compact multi-pocket sorter has a flagging control interface. The flagging control interface has a data retrieval device such as a touch screen that receives information from a user of a multi-pocket sorter of the present invention specifying if operation should be suspended based on detection of a bill meeting, or failing to meet, one or more criteria. Furthermore, where the operation is to be suspended upon detecting a bill to be flagged (e.g., a suspect), the sorter may stop with the flagged bill residing within the transport mechanism (before reaching a pocket), being the last bill delivered to an output receptacle, or being at some other location such as being two or three bills down in an output receptacle. The sorter could provide an appropriate notification to the operator and the operator could evaluate the flagged bill and take appropriate additional action (e.g., hit a denomination key, remove the bill and hit continue)—see e.g., U.S. Pat. No. 5,790,697. Routing and flagging control interfaces are described in greater detail in U.S. Pat. No. 6,311,819, which is incorporated herein by reference in its entirety.

Thus, according to some embodiments, the operation of the sorter is configurable by the customer. For example, the customer can define to which pocket various types of bills are to be directed and whether the operation of the device should stop or not and if the device is programmed to stop, where the bill which is to be flagged should be located when the machine stops—see e.g., U.S. Pat. No. 6,311,819. Specific designations of operating modes can be defined by the user and stored in a memory of the sorter so as to permit subsequent and repeated recall. For example, a customer may define one mode of operation and name it "American Bank Mode 1" and define a second mode of operation and name it "ATM sorting mode." The customer could then easily switch between these modes and any factory-defined modes thereby facilitating efficient use of the sorter—see e.g., U.S. Pat. No. 6,311,819.

According to some embodiments, a sorter may be configurable such that an operator may designate any pocket as a reject pocket. According to some embodiments, a sorter may be configurable such that an operator may designate any pocket for any purpose, e.g., any pocket may be assigned to receive $1 bills, $1 fit bills, $1 face-up bills, $1 face-up fit bills, $1 forward oriented bills, etc.—see e.g., U.S. Pat. No. 6,311,819. Such configurations or assignments may be changed at will according to some embodiments. For example, at the beginning of the day, $1 bills may be assigned to Pocket 1 only. Later in the day, Pocket 1 may be assigned to face-up $1 bills and Pocket 2 assigned to face-down $1 bills. Still later in the day, Pocket 1 may be assigned to received $100 bills. Such configurations could be programmed as user-defined modes as discussed above. According to some embodiments, an operator is able to switch between a plurality of user-defined modes via a single keystroke or via a single selection element—see e.g., U.S. Pat. No. 5,790,697, which is incorporated herein by reference in its entirety.

For embodiments employing stopping (e.g., presenting flagged bills as the last bill in an output receptacle), a given output pocket may be used for two purposes, e.g., receiving $100 bills (not stopping) and flagged suspect bills (stopping). Similarly, there are not very many $2 bills in circulation. Thus in some applications, it may not be desirable to dedicate an entire output pocket to receive $2 bills. Instead, according to some embodiments, a sorter may be programmed to route $2 bills to a pocket assigned to a different denomination, such as $100 bills. When a $100 bill is delivered to that pocket, the machine may continue to process remaining bills in the stack as normal. However, when a $2 bill is detected, the sorter may be programmed to deliver the $2 bill to the $100 bill pocket and suspend operation such that the $2 bill is the last bill delivered to the $100 bill pocket. The sorter may signal the operator that a $2 bill has been delivered to the $100 bill pocket and the operator may then remove the $2 bill and restart the operation of the sorter.

According to some embodiments, suspect bills are "presented" in a first pocket of the sorter, that is, the suspect bill is delivered to the first pocket and the transport mechanism is stopped so that the suspect bill is located at a predetermined position within the first pocket, such as being the last bill transported to one of the output receptacles. No calls (bills whose denomination could not be determined with sufficient certainty) are presented in a second pocket.

According to some embodiments, a sorter may be used for facing. For example, in an eight pocket sorter, four denominations may be faced in one pass. A face up and a face down pocket could be assigned to each of four denominations, e.g., Pocket 1: face-up $1 bills; Pocket 2: face-down $1 bills; Pocket 3: face-up $5 bills; Pocket 4: face-down $5 bills; Pocket 5: face-up $10 bills; Pocket 6: face-down $10 bills; Pocket 7: face-up $20 bills; and Pocket 8: face-down $20 bills.

According to some embodiments, more than one denomination can be assigned to a single pocket, e.g., $1, $10, and $50 bills could all be assigned to Pocket 1—see, e.g., U.S. patent application Ser. No. 10/068,977 filed Feb. 8, 2002 and published as U.S. Patent Application Publication No. 2003-0015395A1.

The sorter may also permit network connectivity for the purpose of printing reports or otherwise sharing the results of the currency bill processing operations externally to the sorter.

According to some embodiments of the present invention, such as that illustrated in FIGS. 1*a* and 8-12, the input receptacle is positioned in close proximity to a number of output receptacles. For example, with respect to the embodiments wherein the input receptacle in positioned between two columns of output receptacles such as those embodiments illustrated in FIGS. 1 (4-0-4 arrangement), 8 (4-2-4 arrangement), and 9 (3-2-3 arrangement), an operator sitting or standing in front of the input receptacle can easily reach the input receptacle and up to ten output receptacles without having to move. For example, as described above the width of some of the embodiments described above is less than 3 feet and the height is less than 2 feet. Accordingly someone sitting in front of a device resting on a counter or table can easily reach the input receptacle and the numerous output receptacles.

Figure 15A:
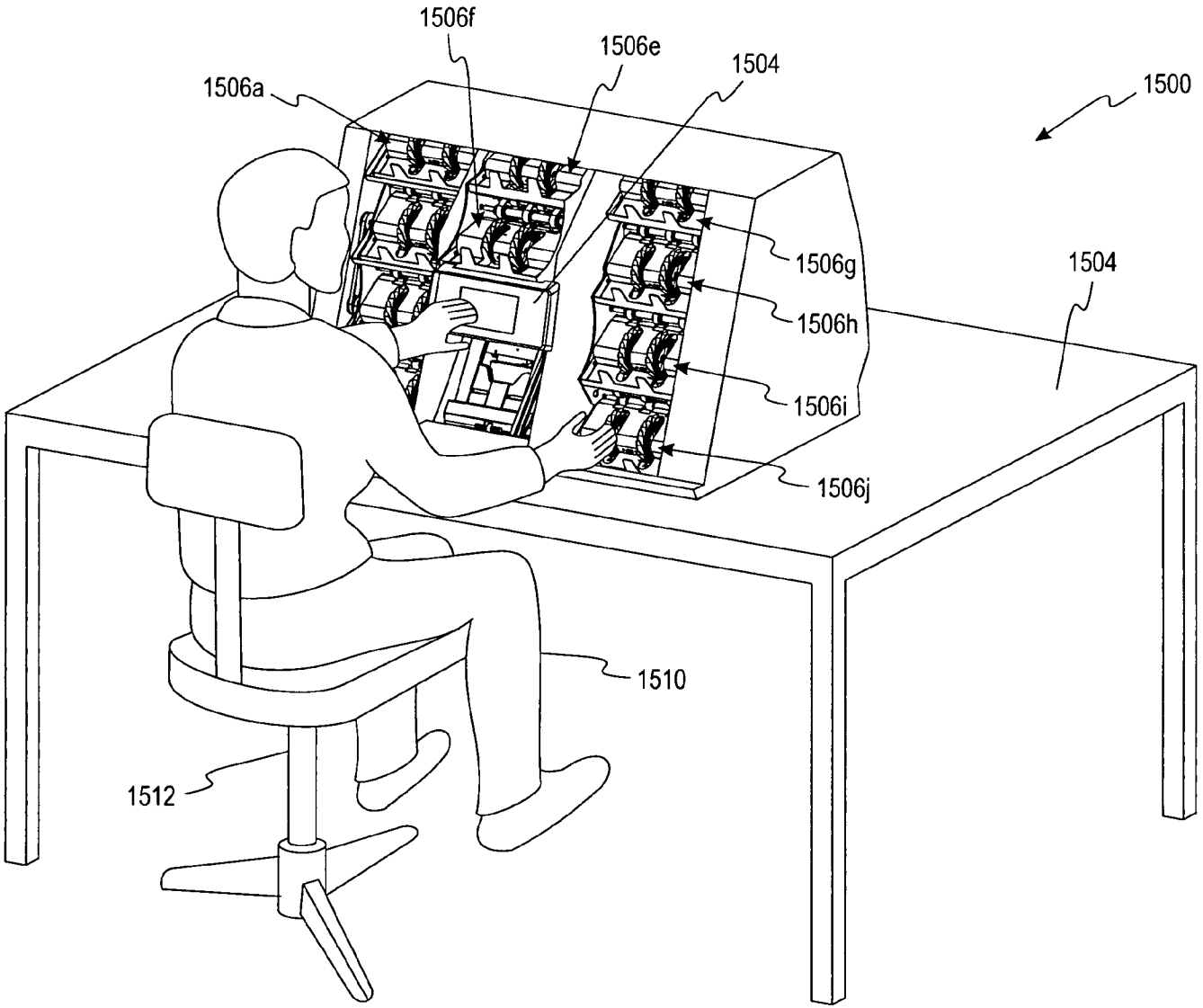
FIG. 15*a* is a perspective view of an operator sitting in front of one embodiment of a sorter according to the present invention.

FIG. 15*a* illustrates an operator 1510 sitting in front of a sorter 1500 such as sorter 800 of FIG. 8 which is resting on a table 1504. As can be seen, the operator can easily reach the input receptacle 1502 and all the output receptacles 1506*a-j* without having to get up from his seat 1512. Likewise the user interface 1504 is easily seen and reachable by the operator 1510. Such embodiments are especially beneficial in permitting a single person to efficiently and effectively operate the sorter. Accordingly, according to some embodiments, a very ergonomic currency sorter device is provided.

In some embodiments, the sorter is positioned so that an operator stands in front of the sorter. In some such embodiments, the input hopper, the output receptacles, and user interface are positioned in close proximity to each other and the position at which the operator will stand. According to some of such embodiments, the operator can easily reach the input receptacle and all the output receptacles and see and reach the user interface without having to move. Such embodiments are especially beneficial in permitting a single person to efficiently and effectively operate the sorter.

According to some embodiments, an ergonomic sorter is provided wherein all output receptacles are positioned at or above the level of the input hopper. Such embodiments permit an operator to position herself in front of the sorter at a level at which she may comfortably reach the input receptacle. According to such embodiments, because all output receptacles are positioned at or above the level of the input hopper, the operator need not bend over to remove the contents of an output receptacle which is positioned below the level of the input hopper. In some embodiments, some output receptacles are positioned slightly below the input hopper but at a height which can still be comfortably reached by the operator. For example, one or more output receptacles may be positioned one to two inches below the level of the input hopper.

According to some embodiments, the input hopper is positioned near the bottom of the sorter so that it is close to the level of the counter or table upon which the sorter rests.

According to some embodiments, one or more output receptacles residing in the same column or lateral position as the input receptacle, e.g., above or below the input receptacle, are used as reject receptacles. For example, with reference to FIG. 8 according to some embodiments output receptacle 817*a* and/or 817*b* is used as a reject receptacle to collect damaged or unfit bills (e.g., bills having missing corners, folds, tears, holes, and/or bills failing one or more fitness tests such as bills which are too limp and/or bills which too soiled, bills having tape thereon or other foreign objects). By routing damaged or unfit bills to an output receptacle which may be reached without having to be transported through a routing mechanism, the chance of such bills becoming snagged, torn, jammed, or skewed in or by the routing mechanism is avoided. Similarly routing damaged or unfit bills to the output receptacles located most upstream along the transport path minimizes the opportunity for such bills to become snagged, torn, jammed, or skewed in the transport mechanism.

Figure 15B:
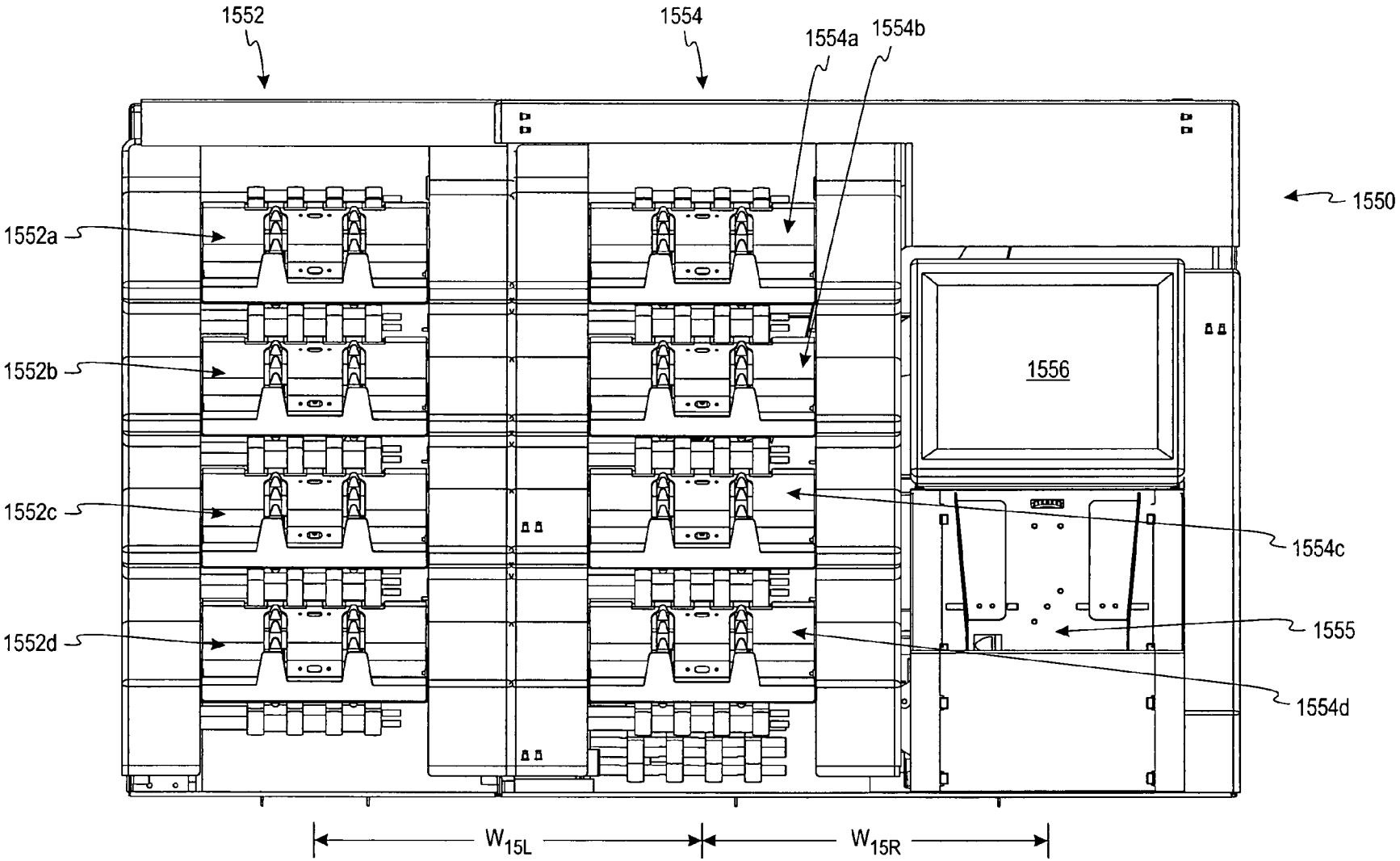
FIG. 15*b* is a front view of the sorter of FIG. 15*a*.
Figure 15C:
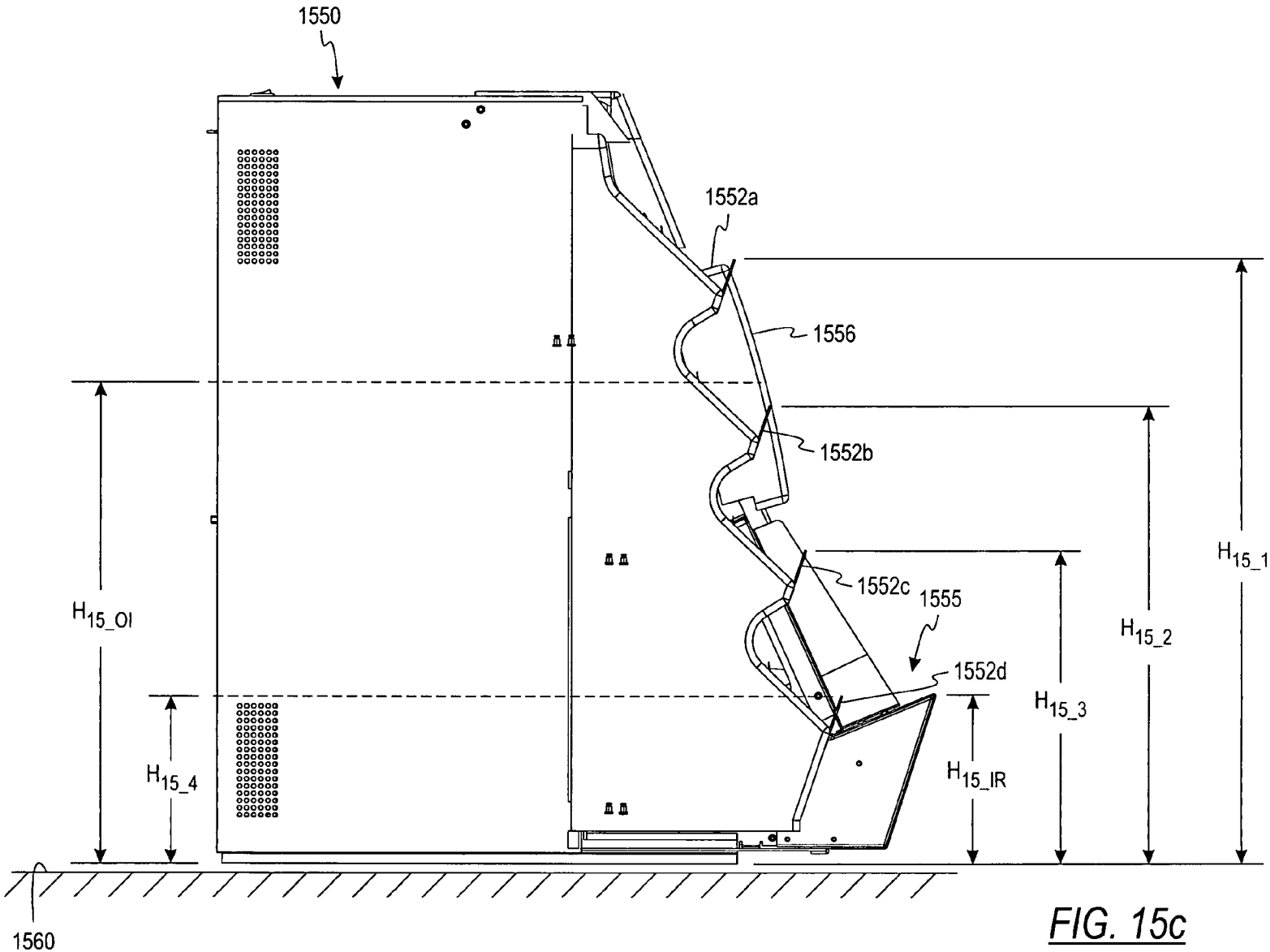
FIG. 15*c* is a side view of the sorter of FIG. 15*a*.

FIGS. 15*b* and 15*c* illustrate the dimensions of a currency sorter 1550 having a 4-4-0 arrangement having a first column 1552 of output receptacles 1552*a-d*, a second column 1554 of output receptacles 1554*a-d*, an input receptacles 1555, and a touch-screen-operator interface 1556. Referring first to FIG. 15*b*, the distance $W_{15L}$ between the horizontal center of the first column 1552 and the horizontal center of the second column 1554 is about 15 in (about 38 cm). The distance $W_{15R}$ between the horizontal center of the second column 1554 and the horizontal center of the operator interface 1556 is about 13 in (about 33 cm). Thus, an operator seated at about the horizontal center of the second column 1554 of output receptacles 1554*a-d* has to reach about 15 inches (about 38 cm) to the operator's left to reach the first column 1552 of output receptacles 1552*a-d* and about 13 in (about 33 cm) to the operator's left to reach the operator interface 1556.

Referring to FIG. 15*b*, the center of the operator interface 1556 is disposed about a distance $H_{15_OI}$ from a surface 1560 upon which the sorter 1550 rests of about 15.5 in (about 42 cm). The input receptacles 1555 is disposed a distance $H_{15_IR}$ of about 5.8 in (about 14.7 cm) from the surface 1560. The upper-most output receptacles 1552*a*,1554*a* are disposed a distance $H_{15_1}$ of about 20.8 in (about 52.8 cm) from the surface 1560. The second-upper-most output receptacles 1552*b*,1554*b* are disposed a distance $H_{15_2}$ of about 15.8 in (about 40 cm) from the surface 1560. The third-upper-most output receptacles 1552*c*,1554*c* are disposed a distance $H_{15_3}$ of about 10.8 in (about 27.4 cm) from the surface 1560. And the lower-most output receptacles 1552*d*,1554*d* are disposed a distance $H_{15_4}$ of about 5.8 in (about 14.7 cm) from the surface 1560.

According to some embodiments including the various embodiments described above including those described in connection with FIGS. 1-15, currency bills are transported and processed (e.g., denominated, authenticated, and/or fitness evaluated) at high rates of speed such as between 800 and 1600 bills per minute. In some embodiments, currency bills are transported and processed at a rate equal to or greater than 600 bills per minute. In other embodiments currency bills are transported and processed at a rate equal to or greater than 800 bills per minute. In some embodiments, currency bills are transported and processed at a rate equal to or greater than 1000 currency bills per minute. In some embodiments, currency bills are transported and processed at a rate equal to or greater than 1200 currency bills per minute. In some embodiments, currency bills are transported and processed at a rate equal to or greater than 1400 currency bills per minute. In some embodiments, currency bills are transported and processed at a rate equal to or greater than 1600 currency bills per minute.

According to some embodiments, the above transport speeds are maintained constant throughout the transport path. In some embodiments, the above transport speeds are maintained nearly constant (+/−5%) throughout the transport path.

According to some embodiments, the spacing between notes along a substantial portion of the transport path does not change. For example, according to some embodiments, the spacing between notes along the transport path does not change between, e.g., the location of the discriminating or bill chararectistic sensors (e.g., denominating sensors, fitness sensors, authentication sensors, image sensors) and the point where the bills are directed to a particular output pocket. According to some embodiments, the spacing between adjacent notes along the transport path being directed to the same output receptacle does not change between a point just after the bills are removed from the input hopper and the point where the bills are directed to the particular output pocket.

Conversely, according to some prior currency processing machines, bills are slowed down or stopped along the transport path, e.g., at the location of one or more discriminating sensors or to change the direction of transport of the bills. Accordingly in such prior devices the transport speed is not constant because the bills are stopped along the transport path. Likewise, bill separation varies along the transport path. For example, as a bill is being slowed down, an upstream bill which is not being slowed down is gaining on the bill being slowed down and hence the separation between the bills does not remain constant.

According to various embodiments of the present invention, the direction of bills is able to be varied in three dimensions without slowing down the speed at which the bills are transported and without stopping the transport of the bills. According to various embodiments of the present invention, the direction of bills is able to be varied in three dimensions while maintaining a constant or nearly constant surface transport speed of the bills and while maintaining a constant or nearly constant separation between adjacent bills.

According to some embodiments of the present invention, bills are able to be transported from an input hopper to a laterally offset output receptacle while maintaining a single leading edge of the bill throughout the transportation process. For example, according to some embodiments bills are able to be transported from an input hopper to a laterally offset output receptacle while maintaining a wide edge of the bill leading throughout the transportation process.

According to some embodiments of the present invention, bills are able to be both removed from an input hopper (i.e., transported from) and deposited into a laterally offset output receptacle with a single leading edge of the bill, such as a wide edge of the bill. According to some embodiments of the present invention, bills are able to be removed from an input hopper and deposited into a laterally offset output receptacle without having two perpendicular edges of a bill (i.e., both a narrow edge and a wide edge) be leading edges during the process of moving bills from the input hopper to a laterally offset output receptacle.

According to some embodiments of the present invention, bills placed into an input hopper with a given orientation (e.g., wide edge parallel to the front of the sorter and/or the front of the input hopper) and having edges of the bills in the input hopper perpendicular to the front of the input hopper (e.g., the narrow edges of the bills) are able to be moved to an output receptacle laterally offset to the left or the right of the input hopper without transporting the bills such that an edge of a bill which was perpendicular to the front of the input hopper serves as a leading edge.

According to some embodiments of the present invention, sorters comprise a rectangular input receptacle having a front side having an opening to permit an operator to insert a stack of bills in the input receptacle and having a left side and a right side relative to the front side. The sorter has at least one output receptacle positioned to the left of the left side of the input receptacle and/or at least one output receptacle positioned to the right of the right side of the input receptacle. Rectangular bills are inserted into the input receptacle with two opposing edges parallel to the left and right sides of the input receptacle. According to some such embodiments, a bill is transported from the input receptacle to a laterally offset output receptacle without either of the two opposing edges of a bill which were parallel to the left and right sides of the input receptacle serving as a leading edge during the transportation of the bill from the input receptacle to the output receptacle.

According to some embodiments a reduction in size (height, width, depth, footprint, or volume) of the machine having a large number of output receptacles is obtained by utilizing three dimensions of transport. For example, for the same number of pockets, the overall height of a device may be reduced according to the principles of some embodiments of the present invention as all the output pockets need not reside in the same column as the input hopper and/or other output receptacles.

In a similar manner, the distance between the input hopper and the output receptacles can be reduced according to the principles of some embodiments of the present invention. For example, in prior sorters which accommodated additional output receptacles by adding such additional output receptacles in series with existing output receptacles, each additional output receptacle would be located farther away from the input receptacle than the existing output receptacles. Accordingly, the distance between the input receptacle and the farthest output receptacle tended to increase in a linear fashion with the addition of each additional output receptacle. The increase in distance between the input hopper and the farthest output receptacle made it difficult for a single operator to operate such sorters as such an operator would have to move during the operation of the machine among positions in front of the input hopper and various output receptacles.

However, according to some embodiments of the present invention, additional output receptacles can be added without increasing the distance between the input receptacle and the farthest output receptacle or without increasing such distance at the linear rate of some prior art devices. For example, a six output receptacle sorter in a 4-2 arrangement comprising four left column output receptacles and two output receptacles in the same column or lateral position as the input hopper (see e.g., FIG. 10*a*) can be increased to contain as many as four more additional output receptacles by the addition of a column of output receptacles positioned to the right of the column containing the input receptacle without any increase in the distance between the input hopper and the farthest output receptacle (see, e.g., the ten output receptacle 4-2-4 arrangement of FIG. 8).

Furthermore, where an additional column or module of pockets is to be added to a sorter farther away from the input hopper, such as, for example, when moving from the six pocket sorter of FIG. 10*b* to the ten pocket sorter of FIG. 11*b*, while the distance between the farthest output receptacle and the input hopper increases, the increase is not limited to a linear rate per additional pocket. Rather, for about the same increase in distance between the input hopper and the farthest output receptacle, an entire column of pockets can be added. In the example, of moving from the six pocket sorter of FIG. 10*b* to the ten pocket sorter of FIG. 11*b*, up to four additional pockets can be added for about the same increase in distance.

According to some embodiments, some of the principles of the present invention permit a reduction in manpower required to operate a currency sorter. As discussed above, the input and output receptacles may be positioned so that a single operator can reach, fill, and empty them. Accordingly, the need to have separate personnel to load the input hopper and one or more personnel to empty output receptacles is reduced.

According to some embodiments, some of the principles of the present invention permit a reduction in cost of a machine having a large number of output receptacles.

The reduction in cost, operator personnel and/or size of the machines contributes to making many output receptacle sorters (e.g., sorters having four, six, eight, ten, or more output receptacles) available at more locations. For example, some of the principles of the present invention will permit banks to provide the sorting act, which may currently be available only a bank's central vault which has a large sorter, to the bank's branch locations.

For example, in the context of U.S. currency, there are currently seven denominations in circulation ($1, $2, $5, $10, $20, $50, and $100 bills). Furthermore, the quantity of circulating $2 is limited and hence only a substantial quantity of six denominations are in circulation. Accordingly, many large sorters in the central vaults of U.S. banks have only six output pockets dedicated to the six most common denominations of circulating U.S. notes, namely, a $1 pocket, a $5 pocket, a $10 pocket, a $20 pocket, a $50 pocket, and a $100 pocket. Such machines may have an additional reject pocket as well.

According to some embodiments of the present invention, banks will be able to perform a per denomination sorting act, which may currently be able to be performed only at a bank's central vault which has a large sorter, to the bank's branch locations by placing in the branches sorters according to the present invention having six or more output receptacles. According to some embodiments of the present invention, six of the six or more output receptacles may be dedicated to specific denominations of circulating bills, e.g., a dedicated $1 pocket, a dedicated $5 pocket, a dedicated $10 pocket, a dedicated $20 pocket, a dedicated $50 pocket, and a dedicated $100 pocket. According to some embodiments of the present invention, sorters having six or more output receptacles may be configurable by selection of an operating mode so that in a particular operating mode, six of the six or more output receptacles become dedicated to specific denominations of circulating bills, e.g., a dedicated $1 pocket, a dedicated $5 pocket, a dedicated $10 pocket, a dedicated $20 pocket, a dedicated $50 pocket, and a dedicated $100 pocket. In other operating modes, the pockets may be re-assigned based on other criterion or criteria—see, e.g., U.S. Pat. No. 6,311,819 and U.S. patent application Ser. No. 10/068,977, filed Feb. 8, 2002, and published as U.S. Patent Application Publication No. 2003-0015395A1, all of which are incorporated herein by reference in their entireties.

For embodiments which incorporate fitness detection (see e.g., U.S. patent application Ser. No. 10/379,365, referred to above), sorting based on fitness may also be moved from a central location to distributed locations such as at bank branches. For embodiments which incorporate fitness detection and denomination determination, sorting based on fitness and denomination may also be moved from a central location to distributed locations such as at bank branches. For example, according to some embodiments of the present invention, sorters having six or more output receptacles may be factory dedicated or user configurable by selection of an operating mode so that six of the six or more output receptacles become dedicated to specific denominations of fit circulating bills, e.g., a fit $1 pocket, a fit $5 pocket, a fit $10 pocket, a fit $20 pocket, a fit $50 pocket, and a fit $100 pocket. The use of such machines permits such sorting action to be moved from being performed solely in a centralized location such as a bank's central vault to distributed locations such as bank branches.

In similar manner, according to some embodiments, currency authentication is additionally or alternatively incorporated into sorters thereby by providing sorters capable of sorting based on authenticity, fitness, and/or denomination. For embodiments which incorporate fitness detection, and which authenticate and denominate bills, sorting based on fitness, authenticity, and denomination may also be moved from a central location to distributed locations such as at bank branches. For example, according to some embodiments of the present invention, sorters having six or more output receptacles may be factory dedicated or user configurable by selection of an operating mode so that six of the six or more output receptacles become dedicated to specific denominations of authenticated, fit circulating bills, e.g., a genuine, fit $1 pocket; a genuine, fit $5 pocket; a genuine, fit $10 pocket; a genuine, fit $20 pocket; a genuine, fit $50 pocket; and a genuine, fit $100 pocket. The use of such machines permits such a sorting act to be moved from being performed solely in a centralized location such as a bank's central vault to distributed locations such as bank branches.

Currently, in the operation of businesses handling large volumes of cash such as banks and other financial institutions, large volumes of currency are transported between remote locations such as bank branches and a main location such as a bank's central or main vault. Using the example of a bank having a main vault and several bank branch locations, an example of the daily operation of such a bank will be described. Typically, each bank branch attempts to keep a target inventory of currency on hand at the bank branch for use in servicing its customers and any ATMs (automatic teller machines) for which the bank branch is responsible. Additionally, each bank branch has target inventories for each denomination of currency bills. During the day, money including currency bills is provided to customers (e.g., via tellers or ATMs) thereby reducing the amount of money held by the bank branch. Additionally, during the day, customers deposit money including currency bills at the bank branch (e.g., via tellers, ATMs, or deposit drop boxes). Typically at the end of business each day, a bank branch will determine how much cash it has paid out including how much of each denomination of currency bills it has paid out (or how much of each denomination it has left in its vault at the end of the day). The bank branch then orders the money it needs to replenish its inventories from the bank's main vault and/or sends any excess currency to the main vault.

For example, a bank branch may target inventories of $20,000 of $100 bills, $10,000 of $50 bills, $40,000 of $20 bills, $10,000 of $10 bills, $5,000 of $5 bills, $100 of $2 bills, and $10,000 of $1 bills and desire to have these levels of currency each morning when the branch opens. At the end of the day, if the branch has only $5,000 of $100 bills, $5,000 of $50 bills, $20,000 of $20 bills, $10,000 of $10 bills, $5,000 of $5 bills, $100 of $2 bills, and $1,000 of $1 bills on hand (excluding any money it has received during the day), the bank will order $15,000 of $100 bills, $5,000 of $50 bills, $20,000 of $20 bills, no $10 bills, no $5 bills, no $2 bills, and $9,000 of $1 bills from its main vault. During the night or in the morning, an armored car picks up the money from the main vault and delivers it to the branch so that the branch may replenish its inventory to the desired levels.

As for the money coming into a bank branch each day, all or much of such currency would be sent to the main vault at the end of each day for sorting. Accordingly, each night an armored car takes money from each branch to the main vault. The transportation of currency is dangerous and hence expensive armored car services must be employed.

According to some embodiments, the method of operating a bank system is provided wherein a bank branch uses an on-site multiple pocket sorter to process currency received at a branch. According to some embodiments, the sorter is used to separate the bills received by denomination. According to some embodiments, the sorter is alternatively or additionally used to separate bills received by fitness (e.g., separate bills between fit and unfit bills or separate bills as to being ATM fit, fit, or unfit). Bills which are found to be unfit are collected to returned to the main vault for their eventual return to the Federal Reserve. Alternatively, according to some embodiments, unfit bills are returned by a branch directly to the Federal Reserve. According to some embodiments, the sorter also sorts fit bills between ATM quality and non-ATM quality. Typically, ATMs require bills to be dispensed therefrom to be of a very high quality or fitness, e.g., very stiff without folds, tears, wrinkles, or holes, low soil levels, etc. Fit non-ATM quality bills may be used by the bank to provide to its customers by means other than ATMs such as by tellers.

According to some embodiments, a method of operating a bank branch is provided wherein a bank branch uses an on-site multiple pocket sorter to sort currency received at a branch between fit and unfit bills and/or among ATM fit, fit, and unfit bills. The branch may then use the bills determined to be fit to replenish its on-site currency bill inventories and thereby eliminate or reduce its need or the frequency it needs to order currency bills from the bank's main vault. Likewise, where ATM fitness sorting is performed, the branch may then use the bills determined to be ATM fit to replenish the bill inventories of the ATMs for which the branch is responsible and thereby eliminate or reduce its need or the frequency it needs to order ATM fit currency bills from the bank's main vault. For example, using the above processes, a branch may be able to reduce the frequency with which it orders currency bills from the bank's main vault from daily to every other day, to every few days, to once a week, etc.

Building on the above example, according to some embodiments where a branch would otherwise need to order $15,000 of $100 bills, $5,000 of $50 bills, $20,000 of $20 bills, and $9,000 of $1 bills from its main vault, some or all of this need may be eliminated by using an on-site currency sorter and the resulting sorted currency to replenish the bank branch's inventory. For example, assume during the day the branch took in $17,000 in $100, $5,000 in $50 bills, $18,000 in $20 bills, and $10,000 in $1 bills. During the day or at the end of the day, bills received at the bank branch from its customers may be processed by the on-site currency sorter. In such a case, the branch would have an excess of $2000 of $100 notes, a shortfall of $2000 of $20 bills, and an excess of $1,000 of $1 bills. Assuming all the bills are fit, these deviations in inventory may fall within an acceptable range thus eliminating the need to either send currency to or order currency from the main vault on the given day. Accordingly, the costs associated with two armored car deliveries would be avoided.

In the above example, if the $17,000 in $100 processed by the sorter comprised $16,000 of fit $100 bills and $1,000 of unfit $100 bills, the inventory of fit $100 bills would exceed the target inventory of $20,000 of fit $100 bills by $1,000 ($5,000 remaining from initial inventory+$16,000 in received fit $100 bills=$21,000). The excess $1,000 of fit $100 notes may also fall within an acceptable range. As for the $1,000 of unfit $100 bills, these bills would need to be returned to the bank's main vault or to directly to the Federal Reserve. However, due their small volume, the branch may decide to keep these bills at the branch until some future time when it is determined that a delivery from the branch to the main vault is needed, e.g., when on hand volumes of different denominations of bills moves out of an acceptable range from target levels which may occur a day or more later. Alternatively, when things run smoothly, perhaps a branch could reduce the number of armored deliveries from being daily to once a week.

Further in conjunction with the above example, the branch's $40,000 $20 bill target level may be composed of a $25,000 target of fit $20 bills and a $15,000 ATM quality $20 bill target. For embodiments of sorters which also comprise ATM fitness level sorting, bills may also be sorted as being unfit, fit, or ATM fit. If the ATMs serviced by the branch dispense only one or a few denominations, then the ATM fitness sorting would have to be conducted only for such denominations, e.g., $20 bills. If during the day, the branch dispensed $10,000 of fit and $10,000 of ATM fit $20 bills, it would have a need for $10,000 of fit and $10,000 of ATM fit $20 bills to replenish its inventories to their target levels. If the $18,000 of received $20 bills comprised $10,000 of ATM fit and $8,000 of fit $20 bills, the branch's $20 ATM fit level would exactly equal its target levels and thus the branch would not need to order any ATM quality $20 bills from its main vault. The branch, however, would be $2,000 short of its $20 fit target level. If this deviation is within the tolerance range of the branch, no $20 fit bills would have to be ordered from its main vault. If this deviation was not within the acceptable tolerance range then additional fit $20 bills could be ordered from the bank's main vault.

Figure 16:
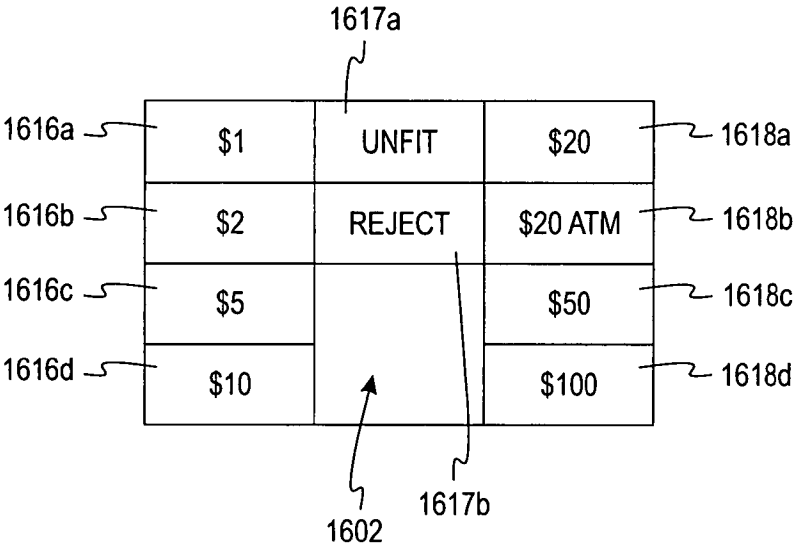
FIG. 16 is a schematic drawing of one embodiment of a ten pocket sorter.

One configuration that may be employed in the branch in the above examples could be the ten pocket sorter illustrated in FIG. 8. An exemplary operating configuration of such a sorter having a 4-2-4 configuration is illustrated schematically in FIG. 16. As shown in FIG. 16 left column or module output receptacles 1616*a-d* could be programmed to receive $1, $2, $5, and $10 fit bills, respectively, and right column or module output receptacles 1618*a-d* could be programmed to receive $20 fit, $20 ATM fit, $50 fit, and $100 fit bills, respectively. Center pocket 1617*a* could be programmed to accept denominated and genuine but unfit bills and pocket 1617*b* could be used as a reject pocket receiving, e.g., suspect bills, no calls, etc. Bills to be processed by the sorter are inserted into input receptacle or hopper 1602. Such an embodiment may be useful where ATMs dispense $20 bills, and hence there is a need for ATM quality $20 bills.

Figure 17:
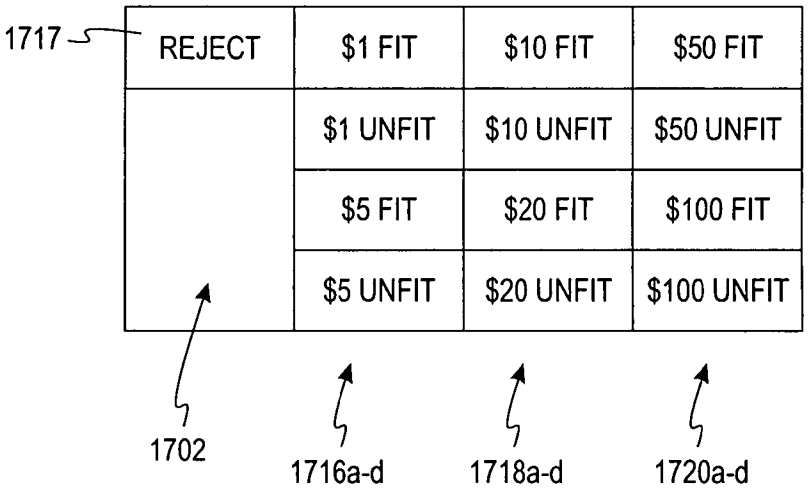
FIG. 17 is a schematic drawing of one embodiment of a thirteen pocket sorter.

Another exemplary configuration is depicted in FIG. 17 for a thirteen pocket sorter in a 1-4-4-4 configuration. Bills to be processed by the sorter are inserted into input receptacle or hopper 1702. Reject bills are routed to pocket 1717. In this configuration, each of six denominations has both a fit and an unfit pocket associated therewith. In this embodiment, the sorter could be programmed to send $2 bills to, for example, the reject pocket 1717 (with or without stopping). Pockets 1716*a-d* are assigned to $1 fit, $1 unfit, $5 fit, and $5 unfit bills, respectively. Pockets 1718*a-d* are assigned to $10 fit, $10 unfit, $20 fit, and $20 unfit bills, respectively. Pockets 1720*a-d* are assigned to $50 fit, $50 unfit, $100 fit, and $100 unfit bills, respectively.

Another advantage from a branch having such a sorter on its premises is that the inventory levels of bills and the breakdown of those inventories e.g., by denomination, fit, ATM fit, and unfit, counterfeit, etc. may be counted and/or determined automatically by the sorter. The sorter may be coupled to a printer to provide reports on the branch's inventory levels and/or or the breakdown of types of currency bills received over a given time period (such as each day). In some embodiments, the sorter may additionally or alternatively be coupled or networked to a computer or computer system and provide such information to the computer or computer system. Such a process eliminates the need for a human (e.g., bank teller or branch manager) to manually count the types of such currency and/or enter such information into the branch's computer system.

According to some embodiments, sorters may be used to strap down loose currency by denomination. For example, when larger retail customers such as grocery stores or other retailers deposit large volumes of currency, an operator using a sorter at the branch could run the deposit through the sorter and sort the bills by denomination, e.g., $1 bills into Pocket 1, $5 into Pocket 2, $10 into Pocket 3, etc. Furthermore, strap limits could be set for each pocket or denomination, e.g., 100 bills per denomination. Then as a strap limit is reached, the operator could remove the bills and place an appropriate strap around the set of bills, e.g., a set of 100 $20 bills may be physically bound with a strap labeled "$20" and/or "$2000" and/or having an appropriate color, e.g., blue. Then the branch's inventory could more readily be kept via straps of currency rather than as loose currency. This procedure would facilitate the branch's ability to keep track of its inventory as it easier and faster to manually count straps of currency rather than manually count loose currency.

Additionally, maintaining inventories of straps of currency also facilitates the bank's ability to provide currency to its customers especially its large retail customers who typically order straps of currency from the bank branch. When its customers order straps of currency, the orders can be quickly and easily filled as the sorter has enabled the bank to maintain inventories of strapped currency in advance of receiving the orders. Currently, bank branches often have to order such inventories of strapped currency from a downtown location and pay an armored car service to transport the strapped currency.

According to some embodiments wherein the sorter is used to facilitate a branch's ability to maintain its inventory in straps, at the end of the day because the inventory is broken down and strapped, the head teller for a branch can more easily and quickly determine if there is any excess inventory of any denomination to sell to the main vault. Likewise, this method enables the branch to more quickly and easily determine if the branch is short of a given denomination and then order the appropriate denominations and volumes of currency from the bank's main vault. By reducing the amount of currency that it transported to and from the branch (and the main vault) to just the volume of excess and/or shortage of currency, the volume of currency being transported is reduced thereby reducing the transportation and handling costs.

According to some embodiments, sorters in a plurality of bank branches are networked with a bank's computer system. For example, the sorters may be networked over a bank's internal network or over the Internet. In some embodiments, the networking is accomplished by coupling the sorter or sorters in a bank branch to a computer within the bank branch wherein that computer is networked with a bank computer system. According to some embodiments, information about the bills processed by each sorter connected to the network is automatically transmitted to the bank's computer system and may be provided to a home office. Alternatively, a branch teller at a branch may enter information about the branch's inventories into the computer system (which operation may be facilitated where the sorter is used to help the branch maintain strapped currency inventories) and this information could be maintained at a home office.

The home office can then maintain inventory information for each of a plurality of branches and use this information to send orders to branches and/or armored car services directing currency bills to be sent to and from the bank's main vault and/or among the branches. According to some embodiments, the networked system may automatically generate such orders. According to some embodiments, the information may be used to accomplish cash settlement over the network including in some examples over the Internet. For example, cash settlement software running on the computer system may use the information provided by the sorters and/or regarding the various inventories of currency (e.g., per denomination) at each branch to accomplish cash settlement. For example, at the end of each day the cash settlement software may generate any necessary instructions concerning the transfer of money among the branches and the main vault. Such systems would also enable the home office to know what excess currency to expect to be sent by each branch and/or received at the main vault and vice versa.

In some embodiments, ATMs are also connected to the network and they provide information to the central office concerning how much money has been dispensed, their need for currency replenishment, and/or how full their deposit bins are. Software running on the system can then also generate any necessary instructions concerning the transfer of money among the branches and ATMs and the main vault.

Figure 18:
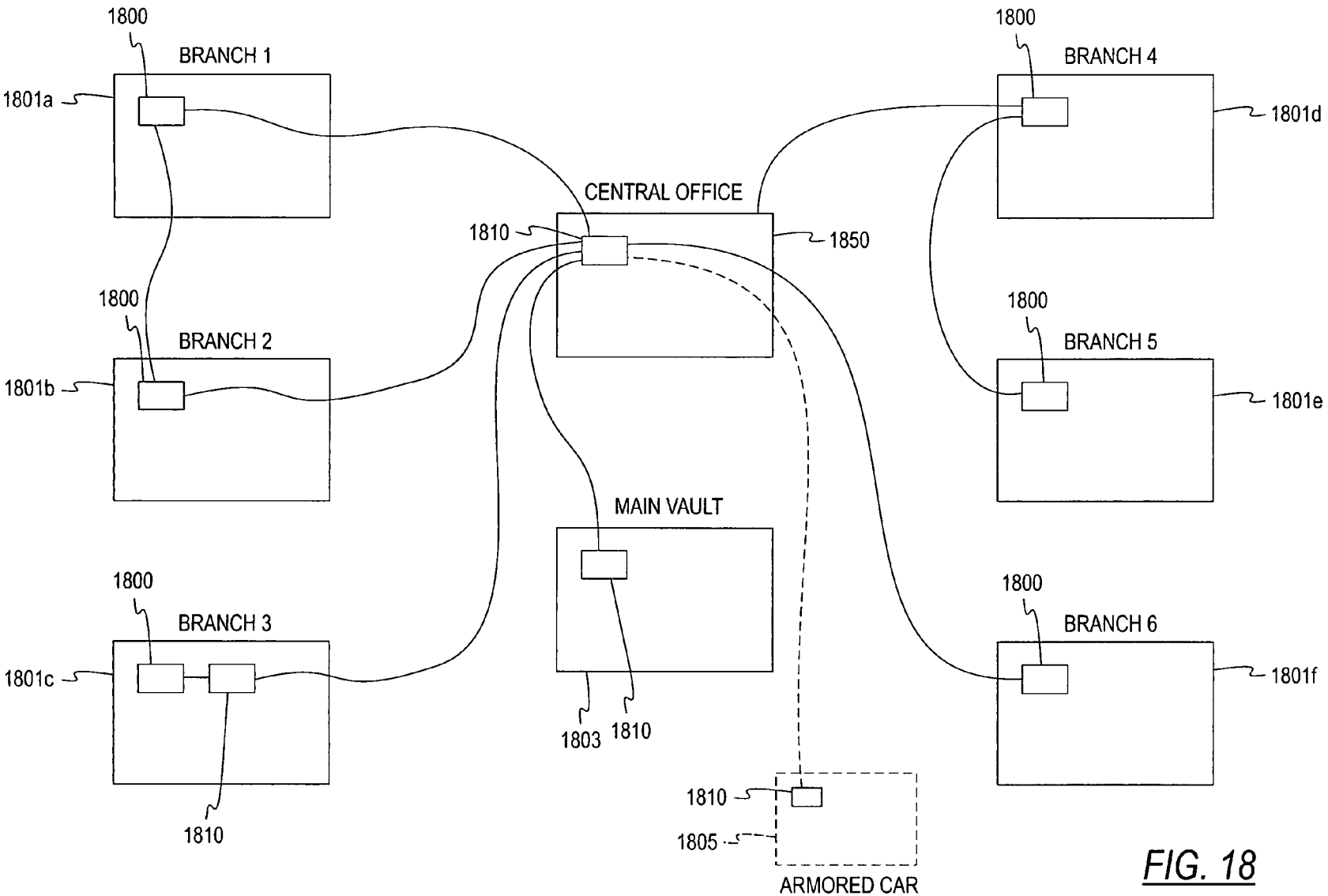
FIG. 18 is a schematic representation of one embodiment of a networked sorting system.

An example of a networked sorting system is illustrated in FIG. 18. The system comprises a plurality of currency sorters 1800 residing in a plurality of bank branches 1801*a-f*. The sorters 1800 are networked to the bank's computer network and thereby are connected to a computer 1810 in a central office 1850 of the bank. In some embodiments the sorters 1800 are coupled directly to the banking network such as the sorter in Branch 6 (1801*f*). Alternatively, in some embodiments the sorters are coupled to the banking network via a computer residing in a bank branch such as computer 1810 residing in Branch 3 (1801*c*). The banking network may comprise any of the many known topologies. Thus, according to some embodiments, no central office 1850 may be present and the acts otherwise performed by the central office may be performed elsewhere or in a distributed manner. The networked sorting system may also comprise an connection to the bank's main vault 1803 and/or a connection to one or more armored car service companies 1805.

Figure 19:
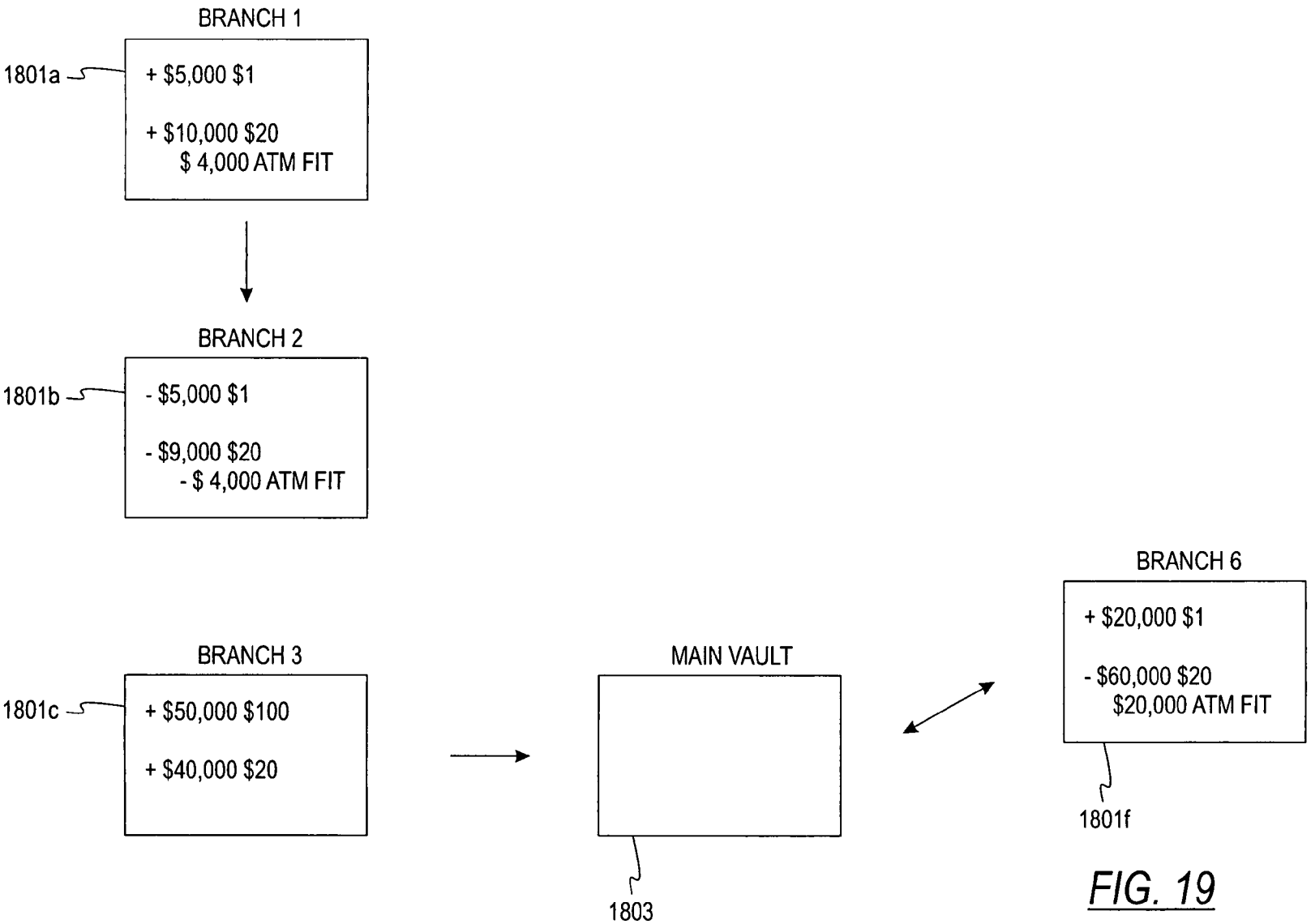
FIG. 19 illustrates a process of redistributing currency among bank branches and a main vault according to one embodiment of the present invention.

FIG. 19 illustrates a process of redistributing currency among the bank branches and main vault according to one embodiment of the present invention. In the illustrated example, the networked sorting system determines that Branch 1 (1801*a*) has $5,000 in excess $1 bills and $10,000 in excess $20 bills. Of the $10,000 in excess in $20 bills, $4,000 are of ATM fit quality. The system also determines that Branch 2 (1801*b*), which may be physically close to Branch 1 has a shortage of $1 and $20 bills. More specifically, the system determines that Branch 2 needs $5,000 in $1 bills and $9,000 in $20 bills including $4,000 in ATM quality $20 bills. Using this information, the system, such as via a processor within the system, determines that $5,000 in $1 bills, $4,000 in ATM fit $20 bills, and $5,500 in $20 bills should be transferred from Branch 1 to Branch 2 and sends instructions to that effect to Branches 1 and 2 and to the armored car service. Such a transfer leaves Branch 1 with an excess of $500 of $20 bills and Branch 2 with a shortfall of $500 of $20 bills but in the present embodiment the system determines that such discrepancies are within the inventory tolerance levels of Branches 1 and 2 and thus no additional currency transfer is required. In some embodiments, the system makes the required currency transfer decisions and/or generates the appropriate instructions to Branches 1 and 2 and the armored car service automatically (such as via the network or other means such as automatically generated faxes). Because Branches 1 and 2 are in close proximity the cost of transporting the currency between Branches 1 and 2 may be less expensive than if currency had to be routed between the branches and the main vault.

Furthermore, the system may determine that Branch 3 has an excess of $90,000 ($50,000 in $100 bills and $40,000 in $20 bills) and direct Branch 3 to return this money to the main vault and direct an armored car service to pick up this money from Branch 3 and delivery it to the main vault. Similarly, the system may determine that Branch 6 has an excess of $20,000 in $1 bills and a shortfall of $60,000 in $20 bills (including a shortfall of $20,000 in ATM quality $20 bills). The system then directs Branch 6 to send $20,000 in $1 bills to the main vault and instructs the main vault to send $60,000 in $20 bills consisting of at least $20,000 in ATM quality $20 bills to Branch 6. In some embodiments, the system may also contact an armored car service to make this transfer. As discussed above, in some embodiments, the system makes the required currency transfer decisions and/or generates the appropriate instructions to the branch, the main vault and/or the armored car service automatically.

According to some embodiments, a sorter could be used to keep track of branch currency inventory and provide such information to the bank's home office. For example, at the beginning of the day, a branch employee such as the head teller could enter the inventory on hand at the branch into a sorter according to some embodiments of the present invention and the sorter could store that information in a memory contained in the sorter. Then when loose money is received throughout the day, the sorter would automatically update its inventory. For example, before running incoming currency through the sorter, an incoming button or selection element could be selected by the operator to inform the sorter that the bills to be processed are incoming bills and that the data about such bills should be added to the branch's inventory totals. According to some embodiments, information about the source of the incoming currency could also to entered into the sorter and stored therein, e.g., "Betty's Retail Store No. 6", or "Account 123". Additionally, when strapped currency is received, the user interface could permit information about the number of straps of each denomination which has been received to be entered into the sorter and the sorter could update the inventories based on such information.

In a similar fashion, when currency is to be sold or disbursed such as to a commercial account (e.g., a local gas station), an outgoing button or selection element could be selected by the operator to inform the sorter that the bills to be processed are outgoing bills and that the data about such bills should be subtracted from the branch's inventory totals. Information about where the money is going could also be entered into the sorter. Likewise, when strapped currency is disbursed, the user interface could permit information about the number of straps of each denomination which is outgoing to be entered into the sorter and the sorter could update the inventories based on such information. Accordingly, the sorter could keep a running total of the branch's inventories and periodically send this information to the bank's home office. For example, such data could be sent to the home office at night. A networked system could keep a running total of the inventories of each branch and the main vault. According to some embodiments, software on the networked computer system monitors inventory levels at the branches and the main vault and determines when an inventory level for one or more denominations falls below an associated minimum level and re-orders currency as required to replenish inventories at associated branches.

According to some embodiments, inventory levels of a branch are maintained on a computer system and one or more sorters according to the present inventions are networked to that computer system. Alternatively or additionally, other currency processing machines such as those discussed in U.S. Pat. Nos. 5,687,963; 6,311,819; and 6,278,795 as well as in U.S. patent application Ser. No. 10/068,977 filed Feb. 8, 2002 (U.S. Patent Application Publication No. 2003-0015395A1) and/or note counters are networked to the computer system. Additionally, ATMs for the branch may also be coupled to the computer network. As described above, the currency bills processed by such machines can be added to or subtracted from the branch's inventory levels being maintained by the computer system. For example, a deposit from a commercial account received at the branch's night deposit box could be processed by a compact multi-pocket sorter as described above (e.g., the device of FIG. 1*a*), and the breakdown of received bills could be sent to the computer system where the inventory levels may be correspondingly increased. Likewise, using a single or dual-pocket currency denominating device at a teller window, a teller could run bills received from a walk up customer through such devices and the information determined by those machines (e.g., the breakdown by denomination) could be sent to the computer system and the inventory levels updated. In similar manner, a teller could run bills to be disbursed to a customer through a networked currency processing machine (e.g., a one or two pocket currency denominating device or a note counter) and the information determined by those machines (e.g., the breakdown by denomination) could be sent to the computer system and the inventory levels updated, in this case reduced accordingly. Similarly, networked ATMs could provide, for example, information about the amount of currency which is dispensed and/or the remaining inventory in the ATMs. Furthermore, the branch's computer system could be part of a bank computer network including other branches, the main vault, and remote ATMs so data from all these sources could be shared and monitored.

The above principles are applicable to environments other than bank branches. For example, retail stores having a sorter according some embodiments of the present invention may be able to track and maintain their inventories of currency bills and reduce the need for the transportation of currency as well. For example, instead of shipping money received from customers to its bank and ordering replacement money needed for its operation from its bank, using a sorter according to some embodiments of the present invention, an operator located at the store could sort the received money and easily extract the bills needed for the store's operation. Accordingly, only excess money would need to be sent to the store's bank and the need to order currency from the bank may be reduced or eliminated. For example, as described in more detail in some of the other patents and applications incorporated by reference above, see, e.g., U.S. patent application Ser. No. 10/068,977 filed Feb. 8, 2002 and published as U.S. Patent Application Publication No. 2003-0015395A1, the sorters according to some embodiments of the present invention may be configurable to permit the operator to set strap limits per denomination.

For example, a store's daily inventory needs for currency bills may be as indicated in Table 1 below.

TABLE 1

| Denomination/Type | Amount | Number |
|---|---|---|
| $1 | $5,000 | 5,000 |
| $5 | $2,000 | 400 |
| $10 | $2,000 | 200 |
| $20 | $1,000 | 50 |
| $20 ATM Fit | $2,000 | 100 |
| $50 | $1,000 | 20 |
| $100 | $0 | 0 |

Accordingly, the operator of the store's sorter may be able to set the strap limits for these denominations as follows: 5,000 for $1, 400 for $5 bills, 200 for $10 bills, 50 for non-ATM fit $20 bills, 100 for ATM fit $20 bills (to service, e.g., an ATM located in the store), and 20 for $50 bills. Alternatively, strap limits maybe set in dollars rather than units. Then during operation of a sorter so configured, the sorter would provide an indication to the operator, e.g., via a sound and/or a visual indication such as via a user interface, that a given strap limit has been reached. Thus while totaling up a batch of money (e.g., all the money received during a day), with the sorter's help, the operator could easily set aside the desired amounts of each denomination and then bundle any additional money for delivery to the store's bank.

In the above example, where a strap limit exceeded a pocket limit (i.e., the maximum number of bills which may be accommodated in a given pocket, e.g., 200 or 400), then when a pocket limit was reached before a strap limit for the denomination associated with the full pocket, the user interface could notify the operator to remove the bills from the full pocket and set them aside for retention by the store. As additional pocket limits or the strap limit for that denomination are reached, the user interface could direct the operator to add such currency to that previously set aside.

An exemplary configuration for a sorter designed to handle the sorting in the above example may comprise a sorter having seven or more output receptacles with a first pocket being assigned to receive $1 bills, a second pocket being assigned to received $5 bills, a third pocket being assigned to received $10 bills, a fourth pocket being assigned to received non-ATM quality $20 bills, a fifth pocket being assigned to received ATM quality $20 bills, a six pocket being assigned to received $50 bills, and a seventh pocket being assigned to received $100 bills. Such a machine may have one or more reject pockets as well and/or rejects may be handled by delivering a reject bill to one of the seven dedicated pockets and suspending the operation of the machine. An appropriate indication such as via a message display via the user interface may also be provided to the operator (e.g., "Suspect bill in Pocket 7-Remove and Press Continue"). For sorters having more pockets, additional pockets may be assigned to high volume or high strap limit denominations, e.g., $1 bills in the above example.

Sorters according to embodiments of the present invention may also be employed at central vaults of banks or other locations which currently use large, expensive sorters. Currently most commercial vaults are set up with two stations for currency processing. At the first station, there is usually a one or two output receptacle currency denominating device. At the first station, a teller accepts currency associated with deposits, for example, the deposits of large retail customers. For each deposit, the teller processes the mixed denominations of currency and verifies the total deposit amount. The currency is then placed, mixed, into a tray and the teller verifies the next deposit. From time to time, the teller sells the full trays to the second station. At the second station, the currency is sorted down by denomination on large expensive multi-pocket currency denominating machines that range anywhere from $100,000 to $1 million or more. These large expensive sorters have pockets dedicated to individual denominations, e.g., a dedicated $1 pocket, a dedicated $5 pocket, a dedicated $10 pocket, a dedicated $20 pocket, a dedicated $50 pocket, and a dedicated $100 pocket.

According to some embodiments, a method comprises performing the acts of the first and second stations on a compact multi-pocket currency sorter according to the present invention. For example, using one of the sorters described above, e.g., see FIGS. 1-15, a teller could verify the amount of individual deposits and sort down the deposit by denomination at the same time.

Figure 20A:
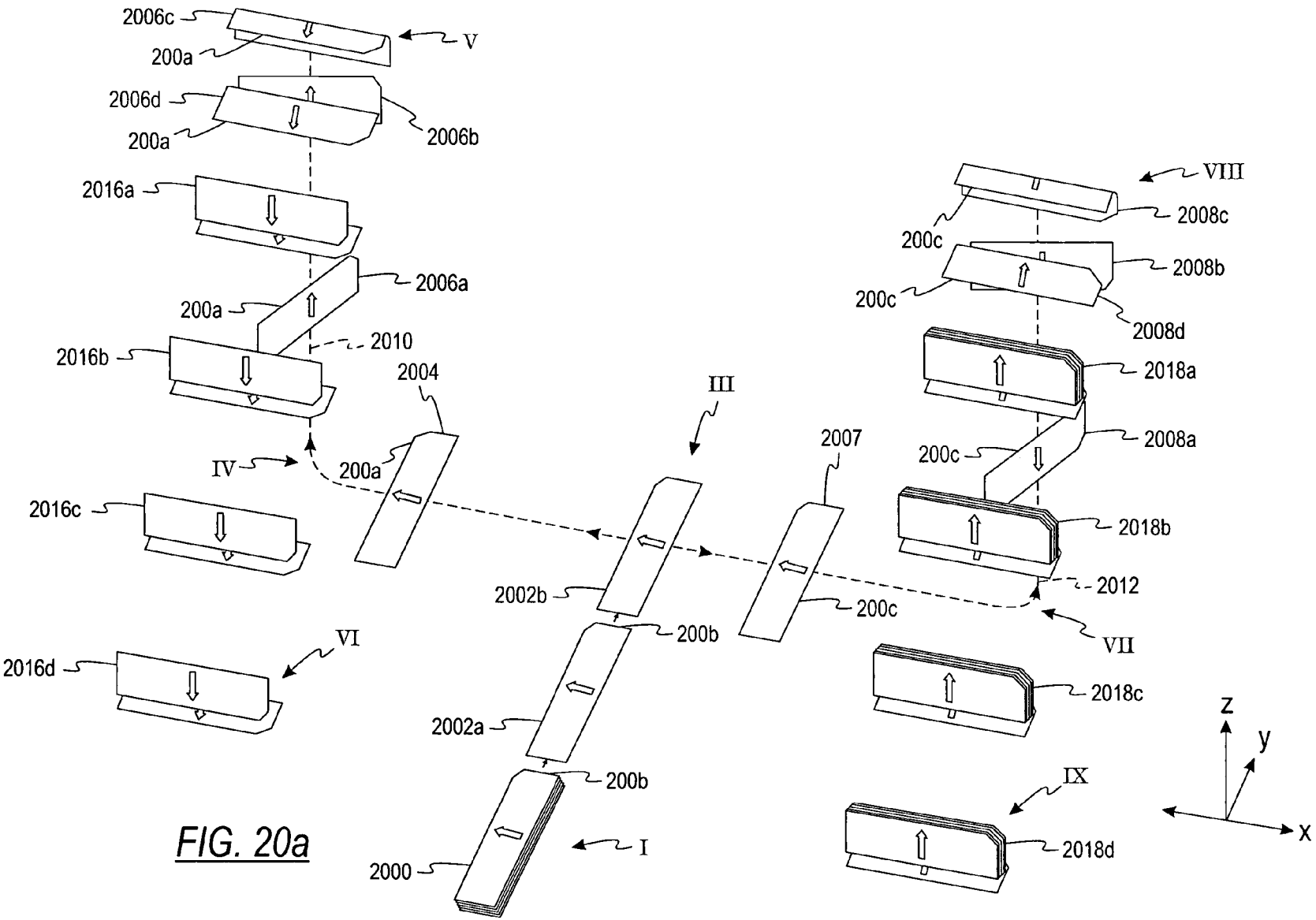
FIG. 20*a* is a perspective view of the currency bill flow sequence of an embodiment through a sorter wherein the leading edge of a bill changes.

FIG. 20*a* illustrates an embodiment wherein bills are fed through the transport mechanism of a sorter wherein the leading edge changes. The input hopper is adapted to accept a stack of bills 2000 with their narrow edge parallel to the front of the machine. Bills are then fed from the input hopper as indicated by location I to location III with a narrow edge 200*b* leading. According to some embodiments evaluating or bill characteristic sensors are positioned along the transport path between locations I and III. At location III, a bill is stopped momentarily and then feed either to the right toward position 2004 or to the left toward position 2007. After a bill is stopped at locations III, it is fed either to the right toward position 2004 or to the left toward position 2007 with a wide edge leading—wide edge 200*a* for bills fed to the left toward position 2004 and wide edge 200*c* for bills fed toward position 2007. The transportation then proceeds as described above in connection with FIG. 4*a*, e.g., proceeding through a rotating mechanism to re-orient the bills so that a wide edge of the bills is parallel to the front of the sorter and feeding the bills wide edge leading into one of the output receptacles. In some alternative embodiments, output receptacles are located only to one side of the input hopper so that from position III bills would be fed only to the right or only to the left. As with the above embodiments, the number of output receptacles in a given column may be one, two, three, four, five, six, seven, or more and more than one column may be coupled together, see, e.g., FIGS. 11*a* and 11*b*. The column containing the input hopper and the columns containing output receptacles may be of modular construction as described above in connection with FIGS. 14*a* and 14*b*. Other than the orientation of the input hopper, various embodiments of the initial narrow edge feed sorters would have the outside appearance of the various sorters described above.

Figure 20B:
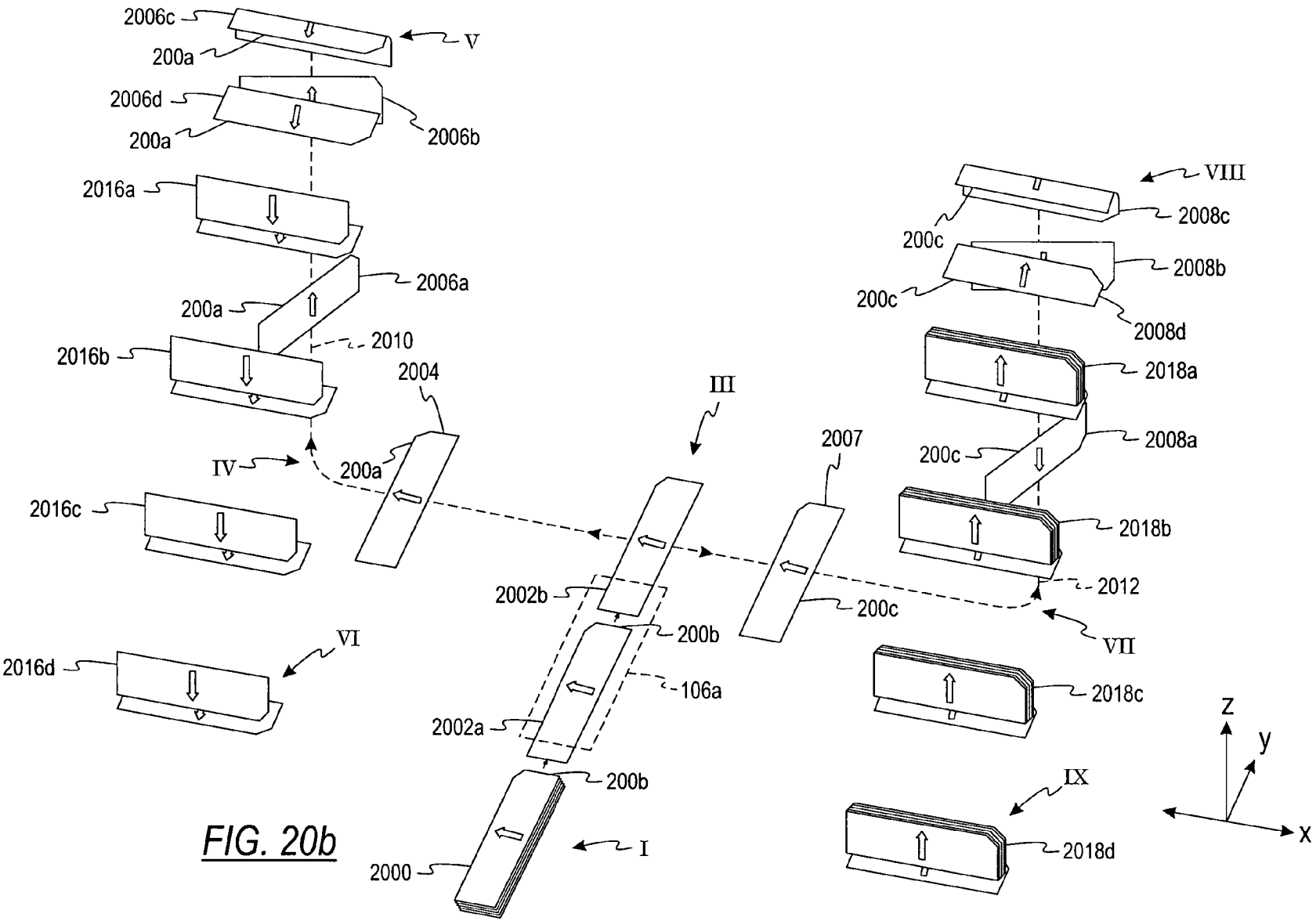
FIG. 20*b* is a perspective view of the currency bill flow sequence of an embodiment through a sorter wherein the leading edge of a bill changes illustrating an exemplary location of an imager.

FIG. 20*b* illustrates an alternate embodiment wherein bills are fed through the transport mechanism of a sorter wherein the leading edge changes. FIG. 20*b* illustrates an exemplary location of an imager 106*a* in the sorter. The input hopper is adapted to accept a stack of bills 2000 with their narrow edge parallel to the front of the machine. Bills are then fed from the input hopper as indicated by location I to location III with a narrow edge 200*b* leading. According to some embodiments image sensors such as imager 106*a*, are positioned along the transport path between locations I and III. At location III, a bill is stopped momentarily and then feed either to the right toward position 2004 or to the left toward position 2007. After a bill is stopped at locations III, it is fed either to the right toward position 2004 or to the left toward position 2007 with a wide edge leading—wide edge 200*a* for bills fed to the left toward position 2004 and wide edge 200*c* for bills fed toward position 2007. The transportation then proceeds as described above in connection with FIG. 4*a*, e.g., proceeding through a rotating mechanism to re-orient the bills so that a wide edge of the bills is parallel to the front of the sorter and feeding the bills wide edge leading into one of the output receptacles. In some alternative embodiments, output receptacles are located only to one side of the input hopper so that from position III bills would be fed only to the right or only to the left. As with the above embodiments, the number of output receptacles in a given column may be one, two, three, four, five, six, seven, or more and more than one column may be coupled together, see, e.g., FIGS. 11*a* and 11*b*. The column containing the input hopper and the columns containing output receptacles may be of modular construction as described above in connection with FIGS. 14*a* and 14*b*. Other than the orientation of the input hopper, various embodiments of the initial narrow edge feed sorters would have the outside appearance of the various sorters described above.

Although described in the context of U.S. bills, other embodiments of the present invention process Euros, British pounds, Canadian dollars, Japanese Yen, or some combination of U.S. bills, Euros, pounds, Yen, and/or Canadian dollars. The principles of the present invention are applicable to currency bills of other countries as well.

In some embodiments of the current invention, four output receptacles are located to the left of the input receptacle, and four output receptacles are located to the right of the input receptacle. One set of four output receptacles is arranged vertically on the left side of the input receptacle and a second set of four output receptacles is arranged vertically on the right side of the input receptacle so that there is only one width of output receptacle on each side of the input receptacle. This allows a machine to have eight output receptacles, while its width is not significantly greater than the width of the input receptacle and two output receptacles. The height of this machine is not significantly greater than that of a machine with four vertically stacked output receptacles.

According to other embodiments of the current invention, three output receptacles, in a vertical stack, are located to the left side of the input receptacle, and three output receptacles, in a vertical stack, are located to the right side of the input receptacle. This allows a machine to have six output receptacles and not be significantly wider than the width of the input receptacle and two output receptacles. The height of this embodiment is not significantly greater than that of a machine with three vertically stacked output receptacles.

According to some embodiments of the present invention, the device comprises a housing that is used to hold a control panel, an input receptacle and an output receptacle bay, which accepts modules, of one, two, three or four output receptacles to one side of an input receptacle. A transport mechanism and any sensors used to denominate, authenticate, and determine the fitness of the bills and to control the flow of the currency bills reside within the housing.

According to another embodiment of the present invention, the device contains a housing that is used to hold a control panel, an input receptacle, two symmetric module bays for output receptacle modules, one to the right and one to the left of the input receptacle and control panel, a transport mechanism, and any sensors used to denominate, authenticate, and determine the fitness of the bills. The transport mechanism is designed so that the bills can be transported through either the left or right module bay of the housing where the output receptacle modules may contain one or more output receptacles.

The modular unit of output receptacles in some embodiments contain four output receptacles and is located on only one side of the input receptacle. According to other embodiments, the modular output unit contains three output receptacles and is located on only one side of the input receptacle. In further embodiments the modular output unit may have two output receptacles. In yet further embodiments the modular output unit may have only one receptacle.

According to other embodiments, the device contains one modular output unit having three output receptacles, and one modular unit having four output receptacles. One of these modular units will be located to the left of the input receptacle, and the other modular unit will be located to the right of the input receptacle, depending on how the modules are installed.

According to another embodiment of the present invention, a currency processing device comprises an input receptacle, an evaluation unit and a plurality of output receptacles laterally offset from the input receptacle.

According to yet another embodiment of the present invention, a currency processing device comprises an input receptacle, an evaluation unit, a transport path that transports currency bills in three-dimensions, and a plurality of output receptacles laterally offset from the input receptacle.

According to a further embodiment of the present invention, a currency processing device comprises a transport mechanism adapted to transport currency bills in three-dimensions.

According to another embodiment of the present invention, a currency processing device comprises an input receptacle positioned to receive a stack of bills to be processed, a discriminating unit adapted to determine the denomination of the bills, a first modular column of output receptacles having a plurality of output receptacles laterally offset from the input receptacle, a second modular column of output receptacles having a plurality of output receptacles laterally offset from the input receptacle, and a transport mechanism for transporting bills, one at a time, from the input receptacle to one of the output receptacles.

According to yet another embodiment of the present invention, a currency processing device comprises an input receptacle positioned to receive a stack of bills to be processed, a discriminating unit adapted to determine the denomination of the bills, a first modular column of output receptacles having a plurality of output receptacles laterally offset from the input receptacle, a second modular column of output receptacles having a plurality of output receptacles laterally offset from the input receptacle, wherein the first and second modular columns of output receptacles are both laterally offset in the same direction from the input receptacle, and a transport mechanism for transporting bills, one at a time, from the input receptacle to one of the output receptacles.

According to yet a further embodiment of the present invention, a currency processing device comprises an input receptacle positioned to receive a stack of bills to be processed, a discriminating unit adapted to determine the denomination of the bills, a first modular column of output receptacles having a plurality of output receptacles laterally offset from the input receptacle, a second modular column of output receptacles having a plurality of output receptacles laterally offset from the input receptacle, wherein the first and second modular columns of output receptacles are laterally offset in opposite directions of each other from the input receptacle, and a transport mechanism for transporting bills, one at a time, from the input receptacle to one of the output receptacles.

Figure 21:
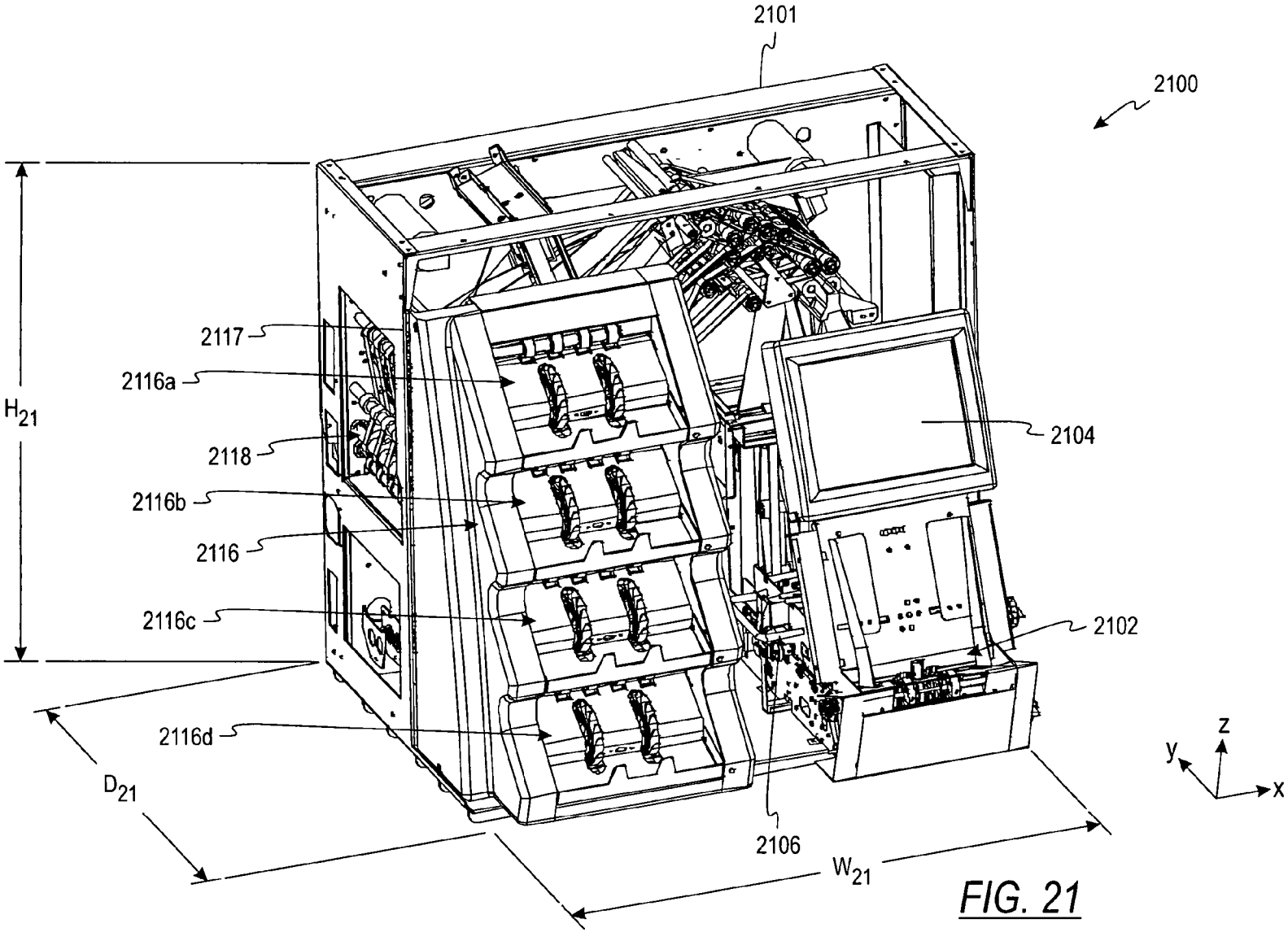
FIG. 21 is a perspective view of a multi-pocket currency sorter device having four output receptacles according to an embodiment of the present invention.
Figure 22:
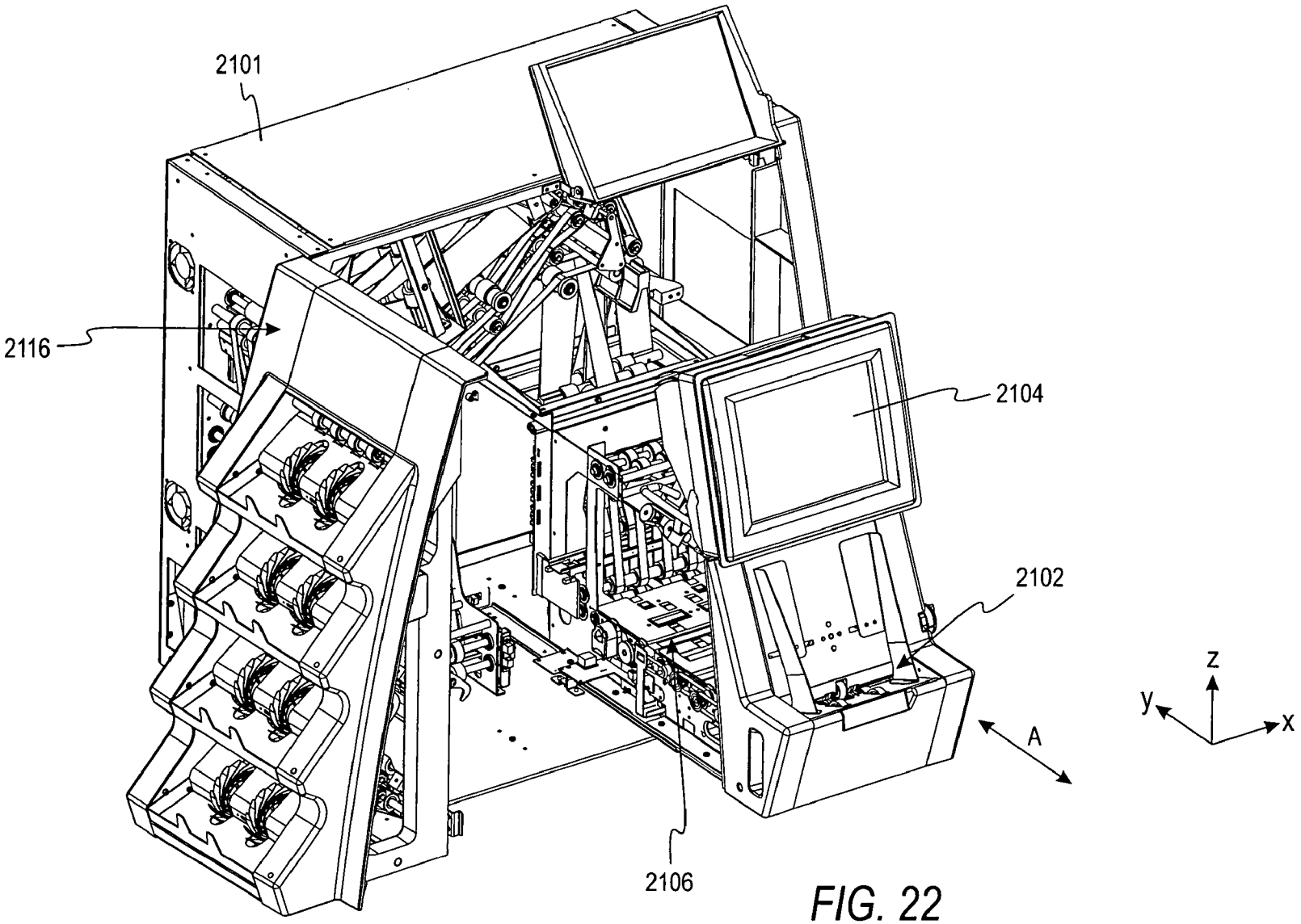
FIG. 22 is a perspective view of the sorter of FIG. 21 in with the sorter opened for servicing.

Turning now to FIG. 21, a perspective view of another embodiment of a multi-pocket currency sorter or processor 2100 is shown. The device 2100 features a housing 2101 for supporting the various components comprising the device 2100. The device 2100 has an input hopper or receptacle 2102 adapted to receive a stack of currency bills to be processed. In some embodiments the input receptacle 2102 has a capacity of approximately 700 to approximately 800 currency bills. The input receptacle 2102 is adapted to receive bills as previously described in relation to FIGS. 2*a* and 2*b*. The device 2100 also comprises a stacking unit 2116 holding a plurality of output receptacles, such as output receptacles 2116*a*-2116*d* that are laterally offset from the input hopper 2102. The bills are transported to the stacking unit 2116 by a transport mechanism 2500 (FIG. 25) that includes at least two bill-rotating-mechanisms such that a bill placed in the input receptacle 2102 with a portrait side facing generally in the direction of the z-axis, and having a portrait plane generally parallel to the portrait side of the bill, such that the portrait plane will be generally parallel to the xy-plane while the bill is in the input hopper 2102. The processor 2100 transports the bill through a discriminating unit 2106 and the portrait plane of the bills remains generally parallel to the xy-plane. After passing through the discriminating unit 2106 the bills are rotated about the x-axis approximately 90° such that the portrait plane is generally parallel to the xz-plane and generally normal to the yz-plane. The bill will be rotated approximately 90° by a first bill-rotating-mechanism such that the portrait plane rotates from being generally normal to the yz-plane, to being generally normal to the xz-plane and generally parallel to the yz-plane, so that the bill may be displaced along the x-axis. The bill is rotated approximately 90° about the y-axis prior to being displaced along the x-axis, such that the portrait plane of the bill is generally parallel to the xy-plane. After beign displaced abiut the x-axis, the bill is the rotated approximately 90° about the y-axis such that the portrait plane is generally parallel to the yz-plane. A second bill-rotating-mechanism will rotate the bill such that the bill with the portrait plane generally parallel to the yz-plane, generally normal to the xz-plane, is rotated approximately 90° to being generally parallel to the xz-plane, generally normal to the yz-plane, so that the bill may be displaced along the y-axis. As shown in FIG. 21, the four output receptacles 2116*a*-2116*d* are shown to the left of the input hopper 2102. The stacking unit 2116 is hingedly connected to the housing 2101 via at least one hinge 2117, allowing a user to swing the stacking unit 2116 away from the housing (FIG. 22). The currency processor 2100 may also comprise an operator or user interface 2104 adapted to receive information from and/or to provide information to an operator or user. In the embodiment shown in FIG. 21, the interface 2104 is in the form of a touch screen. A controller coupled to the control panel and the discriminating unit 2106 causes the sorter 2100 to operate in a number of modes in response to the operational instructions from the user received via the user interface 2104.

According to one embodiment, the discriminating unit 2106 comprises an imager and other sensors or detectors to count, denominate, authenticate, determine fitness, and/or otherwise discriminate, evaluate, and/or analyze the currency bills. Examples of a variety of such sensors (e.g., magnetic sensors, thread sensors, ultraviolet/fluorescent sensors, image sensors, etc.) are described or referred to in U.S. Pat. Nos. 5,687,963; 6,311,819; 6,278,795 B1; 6,256,407; 6,363,164; and 6,661,910; as well as in U.S. patent application Ser. No. 10/379,365, which was filed Mar. 4, 2003 and entitled "Currency Processing System with Fitness Detection" and U.S. Ser. No. 10/684,027, which was filed Oct. 10, 2003 and entitled "Multi-Wavelength Currency Authentication System and Method"—all of which are incorporated herein by reference in their entireties. Fitness detection/evaluation may include the evaluation of a bill's limpness and/or the detection of the presence of soil, tape, holes, tears, missing corners, and/or graffiti. The at least one imager, detector, or sensor generates at least one output signal used to determine the denomination of the bills.

For example, the device 2100 may be adapted to determine the denomination of the bills placed into the input hopper and then sort the bills into the various output receptacles 2116*a*-*d* based on their denomination, e.g., $1 bills may be routed to pocket 2116*a*, $5 bills and $10 bills to pocket 2116*b*, $20 bills, $50 bills, and $100 bills to pocket 2116*c*. In some embodiments, pocket 2116*d* may be used as a reject pocket and may be used to receive bills or documents which cannot be denominated as having one of the above seven U.S. denominations, bills suspected to be counterfeit (suspect bills), and/or bills or documents meeting or failing to meet some other criterion.

Additionally, the device 2100 may comprise a modular output region 2118 that allows the expansion of the number of output receptacles of the processing device to include additional output receptacles similar to the output receptacles 2116*a*-2116*d* shown in FIG. 21, such as described in connection with FIGS. 25-27.

According to one embodiment the device 2100 is compact, having a width $W_{21}$ of about 29 inches (about 74 cm), a height $H_{21}$ of about 29 inches (about 74 cm), and a depth $D_{21}$ of about 26 inches (about 66 cm). Thus, according to some embodiments, a sorter is provided that has a footprint (width× depth) of less than about 754 in. (about 4864 $cm^2$) and a volume of less than about 21,866 $in.^3$ (about 358492 $cm^3$).

According to other embodiments the currency processor has a width of about 30 inches (76 cm), a height of about 30 inches (76 cm), and a depth of about 30 inches (76 cm). Thus, according to some embodiments a sorter is provided that has a footprint of less than about 900 $in.^2$ (5800 $cm^2$) and a volume of less than about 27,000 $in.^3$ (440,000 $cm^3$).

Turning now to FIG. 22, the device 2100 is shown with the stacking unit 2116 swung away from the front of the housing 2101. Additionally, a sildably mounted unit 2160 comprising the discriminating unit 2106, the user interface 2104, and the input receptacle 2102 slidably mounted to tracks 2300 (FIG. 23) have been slidably moved forward along the y-axis (the negative y direction). As shown in FIG. 22 a user may access the interior of the device 2100 with ease. The ease of access to the interior of the device allows a user to more easily resolve minor errors, such as a bill that does not feed properly, and allows for easier service and updating of the device 2100.

Figure 23A:
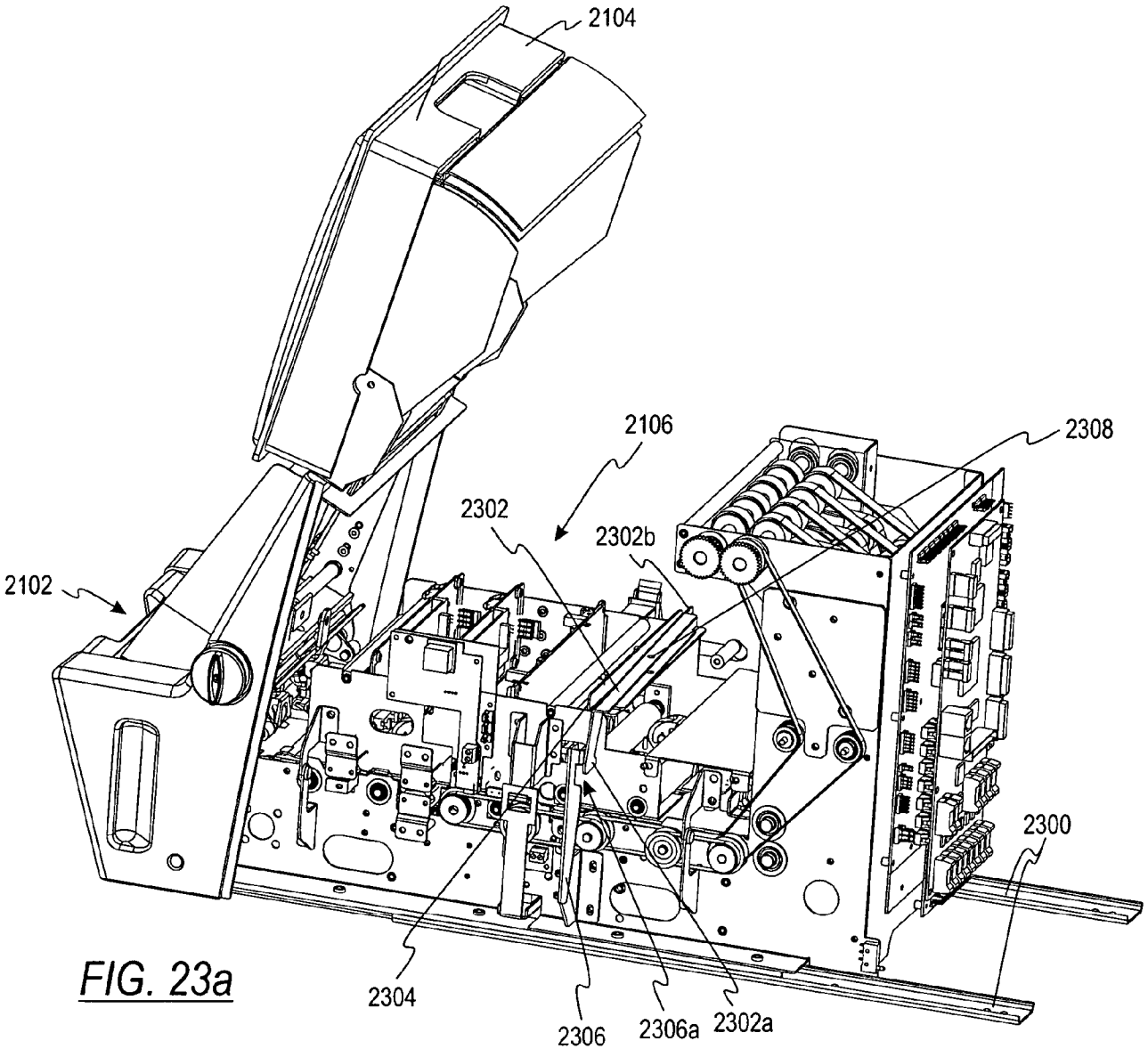
FIG. 23*a* is a perspective view of the discriminating unit of the sorter of FIG. 21 in a closed position.
Figure 23B:
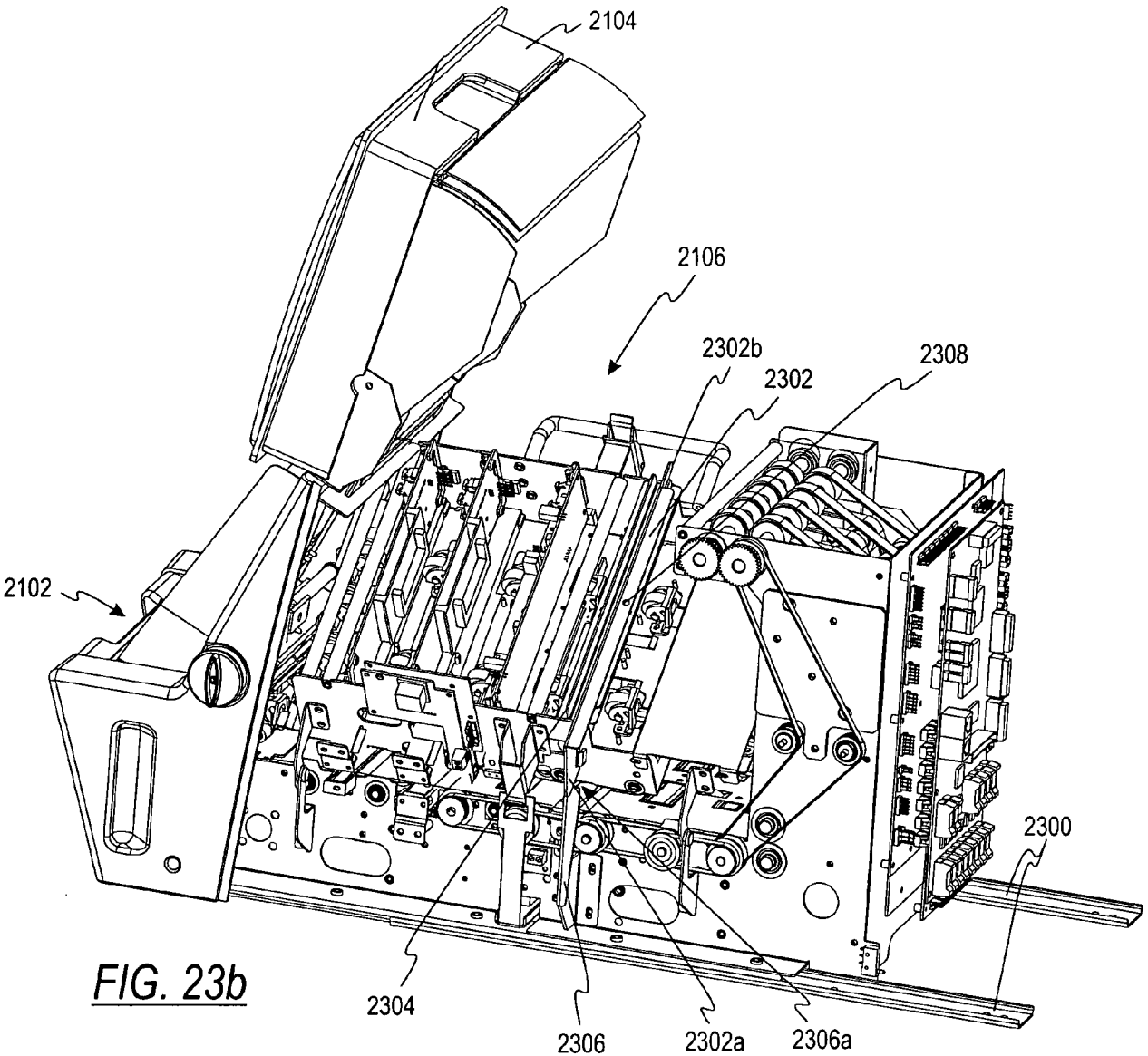
FIG. 23*b* is a perspective view of the discriminating unit of the sorter of FIG. 21 in an open position.

FIG. 23*a* and FIG. 23*b* depict the slidably mounted unit 2160 comprising the discriminating unit 2106, the user interface 2104, and the input receptacle 2102 after it has been slidably moved along tracks 2300 along the y-axis in the negative y direction. FIG. 23*a* depicts the discriminating unit 2106 in a closed position, while FIG. 23*b* depicts the discriminating unit 2106 in an open position. The discriminating unit 2106 may need to be opened when a bill has not fed properly, or if the discriminating unit 2106 needs to be serviced. Discriminating unit 2106 features a moveable arm 2302 having an engagement region 2302*a* and a release region 2302*b*. The moveable arm 2302 is adapted to fit within a support bracket 2304 running the width of the discriminating unit 2106. The moveable arm 2302 is adapted to interact with a flange 2306 to lock the discriminating unit 2106 in an open position (as shown in FIG. 23). The flange 2306 has a cutout region 2306*a*. Specifically, the engagement region 2302*a* of the movable arm 2302 is adapted to fit within the cutout region 2306*a* of the flange 2306 to hold the discriminating unit in the open position as depicted in FIG. 23*b*. As the discriminating unit is opened, the moveable arm 2302 slides past the flange 2306 until the engagement region 2302*a* of the moveable arm 2302 slides into the cutout region 2306*a* of the flange 2306. In order to close the discriminating unit once it is locked in the open position, a user pulls on the release region 2302*b* of the moveable arm 2302. Pulling on the release region 2302*b* causes the engagement region 2302*a* of the moveable arm 2302 to withdraw from the cutout region 2306*a* of the flange 2306. Once the moveable arm 2302 and the flange 2306 are no longer engaged, the discriminating unit may be closed. According to some embodiments, a biasing spring 2308 acts on the moveable arm 2302 to cause the arm 2302 to move towards the cutout region 2306*a* of the flange 2306. The biasing spring 2308 improves the likelihood that the engagement region 2302*a* of the moveable arm 2302 slides into the cutout region 2306*a* of the flange 2306. The use of the moveable arm 2302 and the flange 2306 makes it easier for the user to open and close the discriminating unit 2106.

Figure 24:
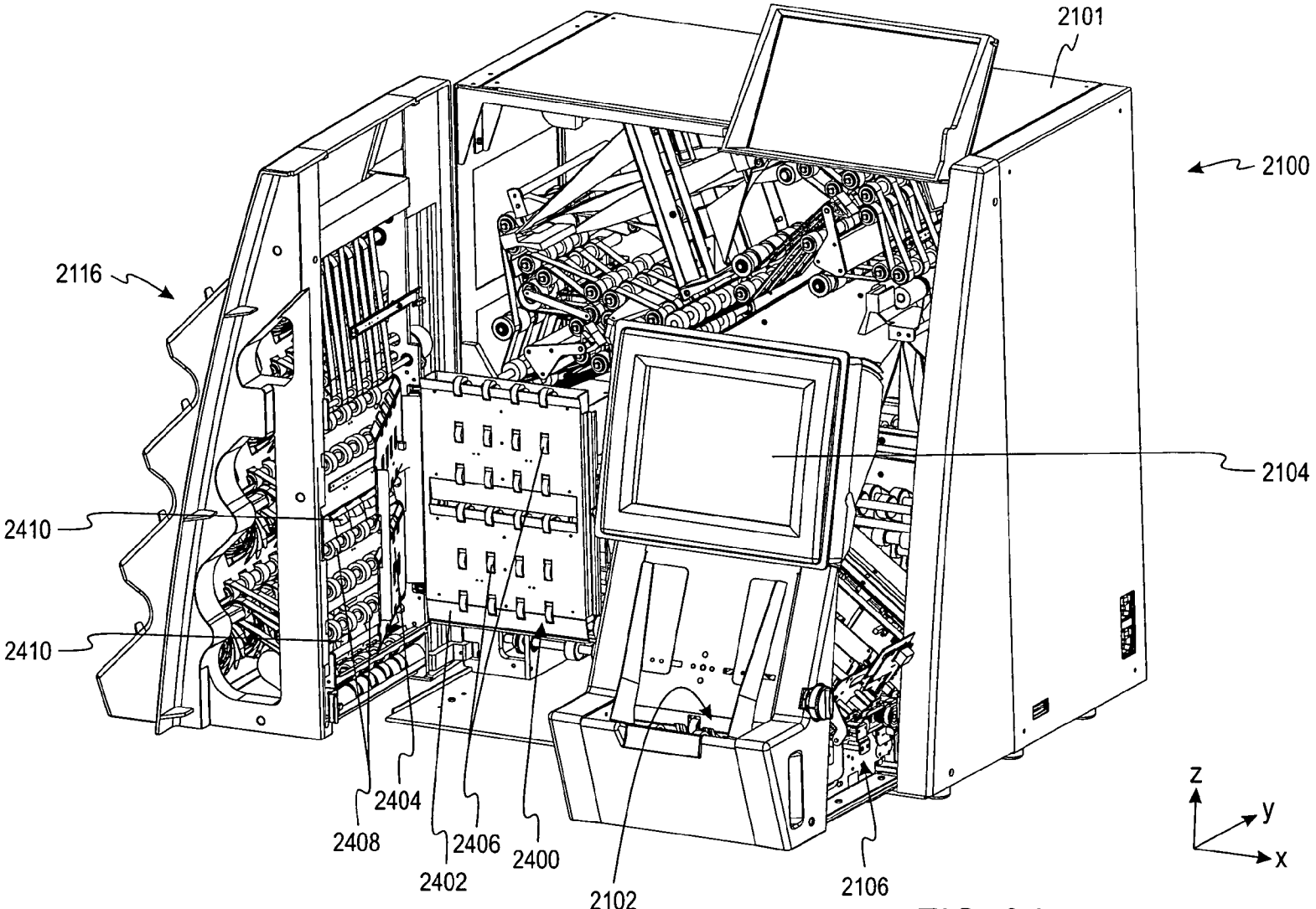
FIG. 24 is an alternate perspective view of the sorter of FIG. 21 opened for servicing.

Turning now to FIG. 24, the processing device 2100 is shown with the stacking unit 2116 swung away from the housing 2100. As can be seen, the stacking unit 2116 features an output receptacles transport region 2400. The output receptacles transport region 2400 comprises a first flat plate 2402, a second flat plate 2404, a first plurality of rollers 2406, a second plurality of rollers 2408, and a plurality of diverters 2410. A bill that has been transported through the device 2100 enters the output receptacles transport region 2400 and is positioned between the first flat plate 2402, the second flat plate 2404, as well as the first plurality of rollers 2406 and the second plurality of rollers. As the bill is transported up the output receptacles transport region (generally in the positive z-direction) it is diverted to the proper output receptacle 2116*a*-2116*d* (FIG. 21) by one of the plurality of diverters 2410. Using the first flat plate 2402 and the second flat plate 2404 allows a user to more easily clear a jam in the output receptacles transport region. As shown in FIG. 24 the first flat plate 2402 is swung away from the second flat plate 2404. Swinging the flat plates 2402, 2404 away from each other causes any bills located between the flat plates 2402, 2404 to be freed, as the force on the bills applied by the flat plates 2402, 2404 and the plurality of rollers 2406, 2408 is removed. For example, if a bill jam was to occur in the output receptacles transport region 2400, a user would swing the flat plates 2402, 2404 away from each other, and the bills would simply fall to a table or other surface the device 2100 is resting on.

Figure 25:
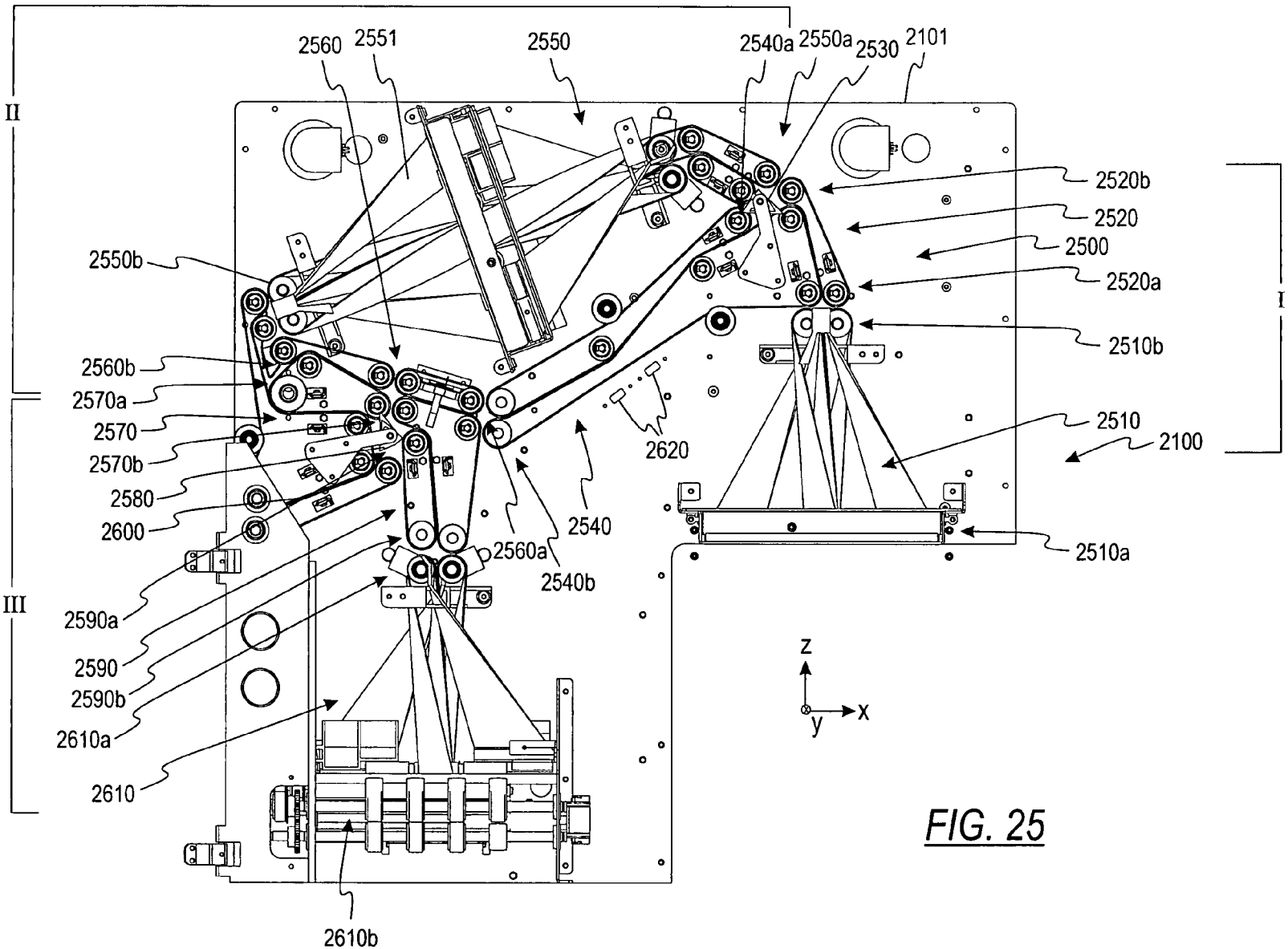
FIG. 25 is a front view of a portion of the transporting mechanism of FIG. 21.

FIG. 25 depicts a portion of a transport mechanism 2500 of the processing device 2100. For ease of viewing the transport mechanism 2500, the input receptacle, stacking unit, and slidably mounted unit are not depicted in FIG. 25. The transport mechanism 2500 is held within the housing 2101 of the device 2100. In this embodiment there is shown a right-vertical-currency-bill-rotating-mechanism 2510 that receives currency bills that have passed from the input receptacle 2102 (FIG. 21) through the discrimination unit 2106 (FIG. 21). Bills enter the portion of the transport mechanism at the bottom of the right-rotating-mechanism 2510*a* and are transported towards the top 2510*b* of the right-rotating-mechanism 2510. As previously described in relation to FIG. 5*a*, the bills are rotated during this upward movement through right-rotating-mechanism 2510. As described in relation to FIG. 21, the right-rotating-mechanism 2510 rotates a bill entering the bottom of the right-rotating-mechanism 2510*a* with the portrait plane generally normal to the yz-plane and rotates the bill approximately 90° about the z-axis so that the portrait plane is generally normal to the xz-plane when the bill reaches the top 2510*b* of the right-rotating-mechanism 2510.

From the top 2510*b* of the right-rotating-mechanism 2510, the bills are transported upward and to the left along a first diagonal-transporting mechanism 2520 from the bottom 2520*a* of the first diagonal-transporting mechanism to the top 2520*b* of the first diagonal-transporting mechanism 2520.

Bills exiting the first diagonal-transporting mechanism 2520 are diverted at a first diverter 2530 to either a second diagonal-transporting mechanism 2540 or a facing-transporting mechanism 2550. Bills diverted through the facing transport mechanism pass through a bill facing mechanism 2551, which is used to rotate the orientation of a bill approximately 180°. For example, if a U.S. bill is initially presented at the facing mechanism 2551 with the surface bearing a portrait of a president facing down, the bill will be rotated 180° as it passed through the facing mechanism 2551 so that the bill surface with the portrait faces up when exiting the bill facing mechanism 2551. The decision may be made to send a bill to the facing mechanism 2551 when the selected mode of operation or other operator instructions call for maintaining a given face orientation of bills as they are processed by the currency processing device 2100. For example, it may be desirable in certain circumstances for all of the bills ultimately delivered to the output receptacles to have the same face orientation. In such embodiments of the currency handling device 2100, the device is capable of determining the face orientation of a bill, and directing a bill not having the desired face orientation to the bill facing mechanism 2551 before being delivered to the appropriate output receptacle. Face orientation may be determined using one or more of the bill characteristic sensors. In some embodiments, an imager is used to determine face orientation. In some embodiments, one or more non-image sensors are used to determine face orientation.

According to one embodiment the bill facing mechanism 2551 comprises a part of twisted endless belts as described in U.S. Pat. No. 6,371,303 ("Two Belt Bill Facing Mechanism"), which is hereby incorporated by reference in its entirety. Bills enter the facing-transporting-mechanism 2550 at an inlet 2550*a*. Once within the facing-transporting-mechanism 2550, the orientation of the bill is rotated 180° while its leading edge remains constant. At the output 2550*b* of the bill facing-transporting-mechanism, the bill is directed towards a fourth diagonal transporting mechanism 2570.

While the bill facing mechanism 2551 has been shown and described as a facing mechanism consisting of a pair of belts for rotating the orientation of the bills, other types of facing mechanisms may be used in alternative embodiments of the currency processing device of the present invention. For example, the document facing mechanism of U.S. Pat. No. 6,074,334 ("Document Facing Method and Apparatus"), which is hereby incorporated by reference in its entirety, may be implemented in connection with alternative embodiments of the present invention.

Bills diverted by the first diverter 2530 to the second diagonal-transporting mechanism 2540 are transported downward and to the left along the second diagonal-transporting mechanism 2540 from the top 2540*a* of the first diagonal-transporting mechanism to the bottom 2540*b* of the second diagonal-transporting mechanism 2540.

From the bottom 2540*b* of the second diagonal-transporting mechanism 2540, the bills are transported upward and to the left along a third diagonal-transporting mechanism 2560 from the bottom 2560*a* of the third diagonal-transporting mechanism to the top 2560*b* of the third diagonal-transporting mechanism 2560.

Bills exiting the top 2560*b* of the third diagonal-transporting mechanism 2560 and bills exiting the output 2550*b* of the bill facing-transporting-mechanism 2550 are transported slightly downward and to the right along the fourth diagonal-transporting mechanism 2570 from the top 2570*a* of the fourth diagonal-transporting mechanism to the bottom 2570*b* of the fourth diagonal-transporting-mechanism 2570.

Bills exiting the fourth diagonal-transporting-mechanism 2570 are diverted at a second diverter 2580 to either a fifth diagonal-transporting-mechanism 2590 or a modular-output-transporting-mechanism 2600. Bills diverted to the modular-output-transporting-mechanism 2600 are sent to a modular output receptacle unit (FIGS. 26, 27) attached to the left side of the housing 2101 that functions similarly to the output receptacles 2116 described in connection with FIG. 21.

Bills diverted by the second diverter 2580 to the fifth diagonal-transporting mechanism 2590 are transported downward and to the right along the fifth diagonal-transporting mechanism 2590 from the top 2590*a* of the fifth diagonal-transporting mechanism to the bottom 2590*b* of the fifth diagonal-transporting mechanism 2590.

Bills exiting the bottom 2590*b* of the fifth-diagonal-transporting mechanism 2590 enter a left-vertical-currency-bill-rotating-mechanism 2610. Bills enter the top of the left-rotating-mechanism 2610*a* and are transported towards the bottom 2610*b* of the left-rotating-mechanism 2610. As previously described in relation to FIG. 5*a*, the bills are rotated during this downward movement through right rotating mechanism 2610. As described in relation to FIG. 21, the left-rotating-mechanism 2610 rotates a bill entering the top of the left-rotating-mechanism 2610*a* with the portrait plane generally normal to the xz-plane and rotates the bill approximately 90° about the z-axis so that the portrait plane is generally normal to the yz-plane when the bill reaches the bottom 2610*b* of the left-rotating-mechanism 2610. Bills exiting the bottom 2610*b* of the left-rotating-mechanism 2610 enter the output receptacles transport region 2400 previously described in relation to FIG. 24.

To simplify the description of the transport mechanism 2500, it may be broken down into three transport paths. A first transport path, path I, comprises the right-rotating-mechanism 2510 and the first diagonal-transporting mechanism 2520. A bill moving in the path I moves generally in the positive z-direction. A second transport path, path II, comprises the second-diagonal transporting mechanism 2540, the facing-transporting mechanism 2550, the third diagonal-transporting mechanism 2560, and the fourth diagonal-transporting mechanism 2570. A bill moving in path II moves generally along the x-axis, with the majority of the movement in the negative x-direction. A third transport path, path III, comprises the fifth diagonal-transporting-mechanism 2590 and the left-rotating-mechanism 2610. A bill moving in path III moves generally along the z-axis in the negative z-direction.

FIG. 25 also depicts two USB ports 2620 used to service and update the device 2100 mounted to the inside of the housing 2101. The USB ports 2620 are operatively connected to a processor used to control the operations of the device 2100. The USB ports may be used to update software contained in the device 2100 and may be used to obtain information from the device if the device 2100 needs maintenance. Mounting the USB ports inside the housing 2101, as opposed to mounting the ports 2620 on the back or the sides of the device 2100 allows the updating and servicing of the device 2100 without needing to move the device from its operating location, allowing the device 2100 to have a more permanent installation.

Figure 26:
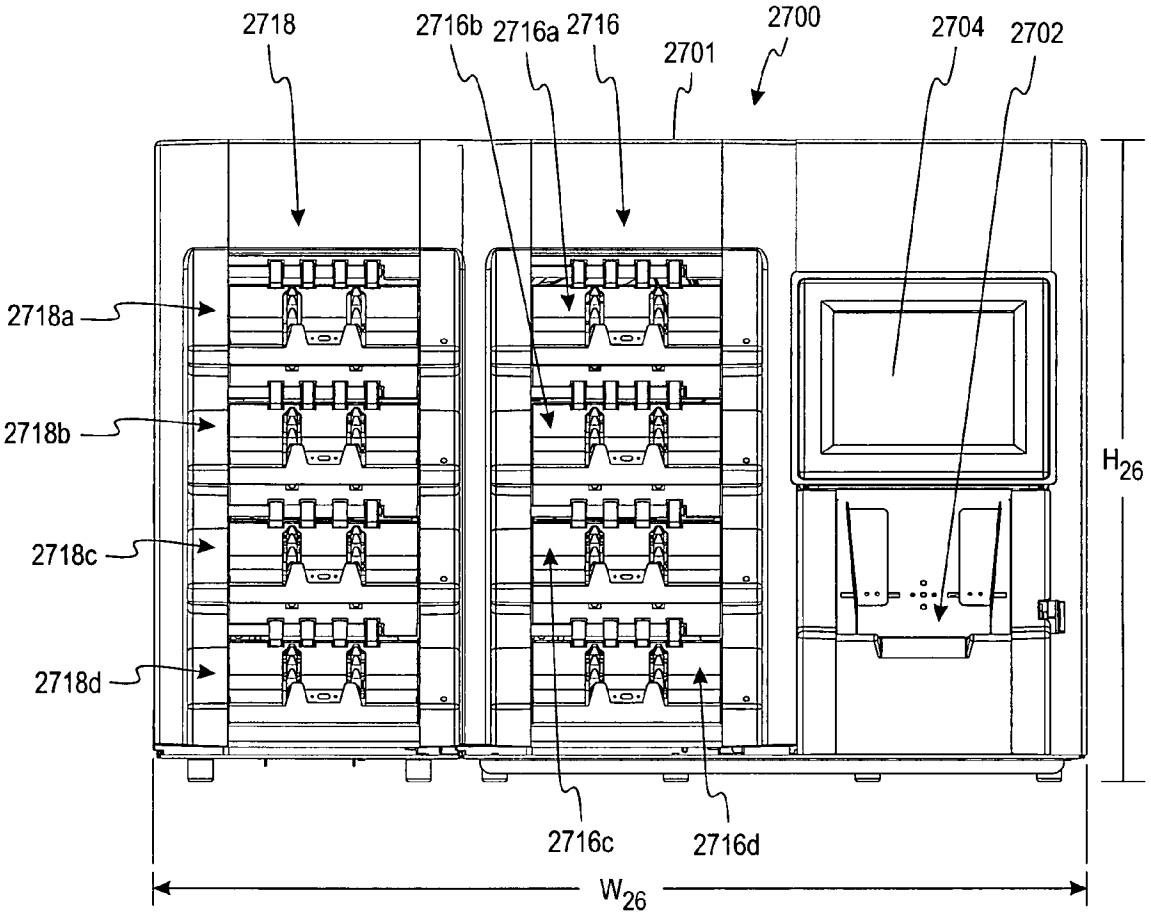
FIG. 26 is a front view of a multi-pocket currency sorter device having eight output receptacles according to an embodiment of the present invention.
Figure 27:
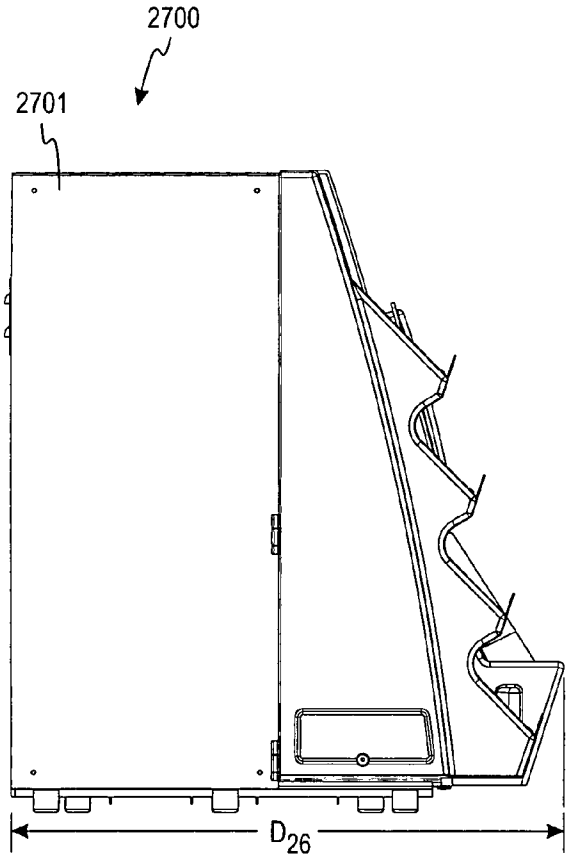
FIG. 27 is a side view of the sorter of FIG. 26.

Turning now to FIG. 26, a front view of another embodiment of a multi-pocket currency sorter or processor 2700 is shown. The device 2700 features a housing 2701 for supporting the various components comprising the device 2700. The device 2700 has an input hopper or receptacle 2702 adapted to receive a stack of currency bills to be processed. In some embodiments the input receptacle 2702 has a capacity of approximately 700 to approximately 800 currency bills. The input receptacle 2702 is adapted to receive bills as previously described in relation to FIGS. 2*a*, and 2*b*. The device 2700 also comprises a first stacking unit 2716, comprising output receptacles 2716*a*-2716*d* that are laterally offset from the input hopper 2702. As shown in FIG. 26, the four output receptacles 2716*a*-2716*d* are shown to the left of the input hopper 2702. The device 2700 also comprises a second stacking unit 2718, comprising output receptacles 2718*a*-2718*d*. The second stacking unit 2718 is located to the left of the first stacking unit 2716. The bills are transported to the stacking units 2716, 2718 by a transport mechanism that includes at least three bill-rotating-mechanisms such that a bill placed in the input receptacle 2102 with a portrait side facing generally in the direction of the z-axis, and having a portrait plane generally parallel to the portrait side of the bill, will be rotated approximately 90° by a first bill-rotating-mechanism such that the portrait plane rotates from being generally normal to the yz-plane, to being generally normal to the xz-plane so that the bill may be displaced along the x-axis. The second bill-rotating-mechanism corresponds to the first stacking unit 2716, and the third bill-rotating-mechanism corresponds to the second stacking unit 2718. The second and third bill-rotating-mechanism will rotate the bill such that the bill with the portrait plane generally normal to the xz-plane is rotated approximately 90° to being generally normal to the yz-plane so that the bill may be displaced along the y-axis.

The currency processor 2700 may also comprise an operator or user interface 2704 and discriminating unit as described in connection with FIG. 21.

For example, the device 2700 may be adapted to determine the denomination of the bills placed into the input hopper and then sort the bills into the various output receptacles 2716*a*-*d*, 2718*a*-*d*, based on their denomination, e.g., $1 bills may be routed to pocket 2716*a*, $2 bills to pocket 2716*b*, $5 bills to pocket 2716*c*, $10 bills to pocket 2716*d*, $20 bills to pocket 2718*a*, $50 bills to pocket 2718*b*, and $100 bills to pocket 2718*c*. In some embodiments, pocket 2718*d* may be used as a reject pocket and used to receive bills or documents which cannot be denominated as having one of the above seven U.S. denominations, bills suspected to be counterfeit (suspect bills), and/or bills or documents meeting or failing to meet some other criterion.

According to one embodiment the device 2700 is compact, having a width $W_{26}$ of about 44 inches (about 112 cm), a height $H_{26}$ of about 29 inches (about 74 cm), and a depth $D_{26}$ (FIG. 27) of about 30 inches (about 76 cm). Thus, according to some embodiments, a sorter is provided that a footprint (width×depth) of less than about 1320 in.$^2$ (about 8500 cm$^2$) and a volume of less than about 38,280 in.$^3$ (about 630,000 cm$^3$).

According to another embodiment the device is compact, having a width of about 50 inches (about 115 cm), a height of about 30 inches (about 77 cm), and a depth of about 30 inches (about 77 cm). Thus, according to some embodiments, a sorter is provided that a footprint (width×depth) of less than about 1350 in.$^2$ (about 8900 cm$^2$) and a volume of less than about 45,000 in.$^3$ (about 680,000 cm$^3$).

Figure 28:
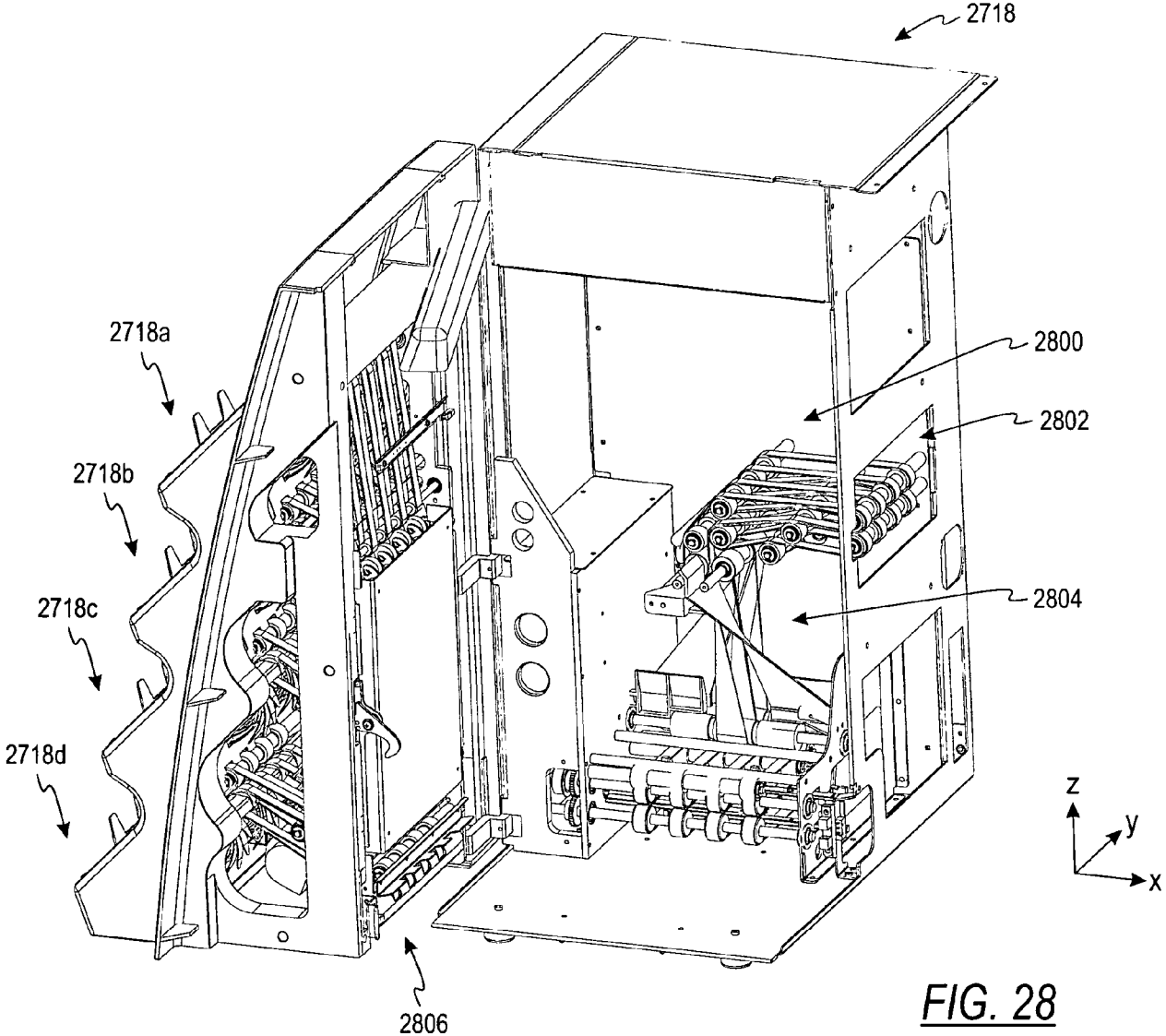
FIG. 28 is a perspective view of a second stacking unit.

Turning now to FIG. 28, the second stacking unit 2718 is shown in greater detail. The second stacking unit 2718 comprises a stacking unit transport mechanism 2800. Bills enter the second stacking unit transport mechanism 2718 via the modular output region 2118 (FIG. 21) when used with the sorter 2100 of FIG. 21. Bills enter the second stacking unit along a horizontal transporting-mechanism 2802. Bills move generally in the negative x-direction in the horizontal transporting-mechanism 2802. Bills exiting the horizontal transporting-mechanism 2802 enter a second-stacking-unit-vertical-bill-rotating-mechanism 2804. The second-stacking-unit-vertical-bill-rotating-mechanism 2804 rotates a bill entering the top of rotating mechanism 2804 with the portrait plane generally normal to the xz-plane and rotates the bill approximately 90° about the z-axis so that the portrait plane is generally normal to the yz-plane when the bill reaches the bottom of the second-stacking-unit-vertical-bill-rotating-mechanism 2804. Bills exiting the second-stacking-unit-vertical-bill-rotating-mechanism 2804 enter an output receptacles transport region 2806 of the second stacking unit 2718. The output receptacles transport region 2806 is generally identical to the output receptacles transport region 2400 described previously in relation to FIG. 24.

Figure 29:
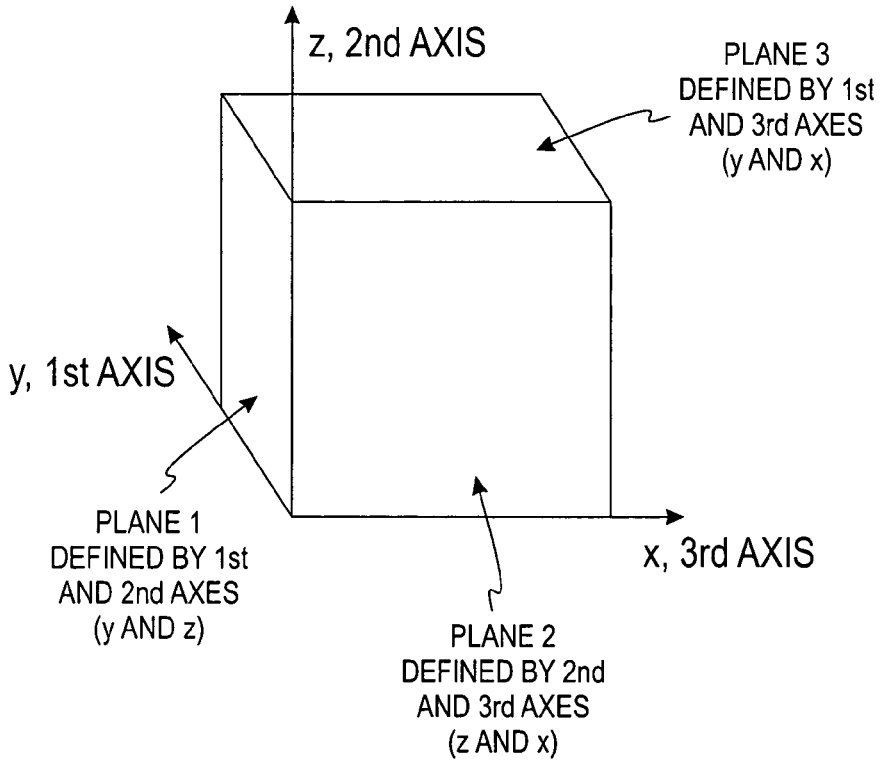
FIG. 29 is a three-dimensional coordinate system.

Turning next to FIG. 29, a three-dimensional coordinate system is shown as used in the description of the present invention. The three-dimensional coordinate system comprises a first axis, a second axis, and a third axis. The first axis is a y-axis. The first axis generally corresponds to a direction of depth. The second axis is a z-axis. The second axis generally corresponds to a direction of height. The third axis is an x-axis. The third axis generally corresponds to a direction of width. The three axes allow a first plane, a second plane, and a third plane to be formed. The first plane is formed by the first axis and the second axis. The first plane is a yz-plane. The first plane does not change dimensions along the third axis. The second plane is formed by the second axis and the third axis. The second plane is an xz-plane. The second plane does not change dimension along the first axis. The third plane is formed by the first axis and the third axis. The third plane is an xy-plane. The third plane does not change dimension along the second axis.

According to some embodiments, a compact multi-pocket sorter has a flagging control interface. The flagging control interface has a data retrieval device such as a touch screen that receives information from a user of a multi-pocket sorter of the present invention specifying if operation should be suspended based on detection of a bill meeting, or failing to meet, one or more criteria. Furthermore, where the operation is to be suspended upon detecting a bill to be flagged (e.g., a suspect), the sorter may stop with the flagged bill residing within the transport mechanism (before reaching a pocket), being the last bill delivered to an output receptacle, or being at some other location such as being two or three bills down in an output receptacle. The sorter could provide an appropriate notification to the operator and the operator could evaluate the flagged bill and take appropriate additional action (e.g., hit a denomination key, remove the bill and hit continue)—see e.g., U.S. Pat. No. 5,790,697. Routing and flagging control interfaces are described in greater detail in U.S. Pat. No. 6,311,819, which is incorporated herein by reference in its entirety. It is contemplated that the flagging control interface may be included in the embodiments previously described.

According to some embodiments, sorters may be used to strap down loose currency by denomination. For example, when larger retail customers such as grocery stores or other retailers, casinos, or other industries that deposit large volumes of currency, an operator using a sorter at the branch could run the deposit through the sorter and sort the bills by denomination, e.g., $1 bills into Pocket 1, $5 into Pocket 2, $10 into Pocket 3, etc. Furthermore, strap limits could be set for each pocket or denomination, e.g., 100 bills per denomination. Then as a strap limit is reached, the operator could remove the bills and place an appropriate strap around the set of bills, e.g., a set of 100 $20 bills may be physically bound with a strap labeled "$20" and/or "$2000" and/or having an appropriate color, e.g., blue. Then the branch's inventory could more readily be kept via straps of currency rather than as loose currency. This procedure would facilitate the branch's ability to keep track of its inventory as it is easier and faster to manually count straps of currency rather than manually count loose currency. It is contemplated that the sorters previously described may also be used to strap currency.

According to one embodiment, a user of a processing and sorting device may set the number of bills to be placed in a strap. For example, if a user wishes to create straps consisting of fifty (50) $1 bills, the user could utilize the user interface of the device to set a strap limit of fifty (50) $1 bills to one of the output receptacles. In the example described only a single output receptacle is being used to hold $1 bills, it is contemplated that additional output receptacles may be used to hold $1 bills and in such an embodiment the following description describes what occurs when the final output receptacle used to hold $1 bills is being filled, and the $1 bills have not been removed from any of the other output receptacles. The user would then activate the device and processing of a stack of currency placed in the input receptacle of the device would begin. The device would use the discriminating unit to evaluate the denomination of the bills and the controller would keep track of the count of each denomination. According to some embodiments, once the controller determines that fifty (50) $1 bills have passed through the discriminating unit the feeding of bills from the input receptacle halts, but the transportation of bills already within the device continues. The controller tracks the position of a $50^{th}$ $1 bill (bill n) as it moves through the transport path. Once the $50^{th}$ $1 bill (bill n) is placed in the appropriate output receptacle, the controller determines if a next bill after the $50^{th}$ $1 bill (bill n+1) is also a $1 bill. If the next bill (bill n+1) is a $1 bill, the transport mechanism halts, ensuring that only fifty (50) $1 bills will be in the appropriate output receptacle. If the next bill, (bill n+1) is not a $1 bill, the next bill is transported to its appropriate output receptacle. This checking for $1 bills continues until a $1 bill after the $50^{th}$ $1 bill (bill n+x, where x is equal to the number bills following bill n until another $1 bill is located) is located, or until all bills (bill n+i, where i is equal to the total number of bills after bill n in the transport mechanism) within the transport mechanism have been fed to an output receptacle. Thus, for the bills that are within the transport path (bill n+1 to bill n+i) when the $50^{th}$ $1 bill (bill n) is placed in the appropriate output receptacle, the device determines if any of those bills (bill n+1 to bill n+i) are $1 bills, and if so, the entire transport mechanism will stop when the $51^{st}$ $1 bill (bill n+x) is the next bill to be placed in an output receptacle. For example, if ten (10) bills (bill n+1 to bill n+10) are within the transport mechanism when the $50^{st}$ $1 bill (bill n) is detected and the fourth bill (bill n+4) is a $1 bill, the device will deliver the first three bills following the $50^{th}$ $1 bill (bill n+1 to bill n+3) to appropriate output receptacles, and then the transport mechanism will halt. Once the fifty (50) $1 bills are removed from the output receptacle for strapping, the transport mechanism resumes operation, and continues transporting the bills already within the transport mechanism, and also transporting additional bills from the input receptacle. This way, the correct number of bills to be strapped will be placed in the appropriate output receptacle, and the restart of the processing device.

Alternate Embodiments

AA. A three-dimensional currency processing device lying in a space defined by three perpendicular axes, namely, a first axis, a second axis, and a third axis, comprising:

an input receptacle adapted to receive a stack of bills to be processed, the input receptacle holding the stack of bills such that individual bills lie in a plane generally normal to a plane defined by the first and the second of said axes, the plane defined by the first and second axes being plane 1;

at least one an output receptacle adapted to receive and stack bills after said bills have been processed, the output receptacle holding the stacked bills such that individual bills lie in a plane generally normal to the plane 1, the output receptacle being displaced laterally from the input receptacle along the third axis, a second plane being defined by the second and third axes; and a transport mechanism adapted to move bills from the input receptacle to the output receptacle such that when a bill is being moved along the third axes it lies in a plane generally normal to the second plane.

BB. A three-dimensional currency processing device lying in a space defined by three perpendicular axes, namely, a first axis, a second axis, and a third axis, the first axis running in a front/back direction, the second axis being a vertical axis, and the third axis running in a left/right direction comprising:

an input receptacle adapted to receive a stack of bills to be processed, the input receptacle holding the stack of bills such that individual bills lie in a plane generally normal to a plane defined by the first and the second of said axes, the plane defined by the first and second axes being a plane 1;

at least one an output receptacle adapted to receive and stack bills after said bills have been processed, the output receptacle holding the stacked bills such that individual bills lie in a plane generally normal to the plane 1, the output receptacle being displaced laterally from the input receptacle along the third axis, a second plane being defined by the second and third axes; and a transport mechanism adapted to move bills from the input receptacle to the output receptacle such that when a bill is being moved along the third axes it lies in a plane generally normal to the second plane.

CC. A three-dimensional currency processing device lying in a space defined by three perpendicular axes, namely, a first axis, a second axis, and a third axis, comprising:

an input receptacle adapted to receive a stack of bills to be processed, the input receptacle holding the stack of bills such that individual bills lie in a plane generally normal to a plane defined by a first and a second of said axes, the plane defined by the first and second axes being a plane 1, a second plane being defined by the second and third axes;

at least one an output receptacle adapted to receive and stack bills after the bills have been processed, the output receptacle holding the stacked bills such that individual bills lie in a plane generally normal to the plane 1, the output receptacle being displaced laterally from the input receptacle along the third axis; and a transport mechanism adapted to receive bills from the input receptacle and rotate the bills about a line parallel to the direction of movement of the bills such that the bills change from lying in a plane generally normal to the plane 1 to a plane generally normal to the plane 2; wherein the transport mechanism being adapted to move the bills along a direction having a component along the third axis while the bills are generally normal to the plane 2;

the transport mechanism being adapted to rotate the bills about a line parallel to the direction of movement of the bills such that the bills change from lying in a plane generally normal to the plane 2 to a plane generally normal to the plane 1; and the transport mechanism being adapted to then transport the bills lying in a plane normal to plane 1 into the at least one output receptacle.

DD. A currency processing device having an input receptacle and at least one output receptacle, the at least one output receptacle being laterally displaced from the input receptacle along a first axis, the first axis defining a left and a right direction, the device having a transport mechanism adapted to move bills in a forward direction from the input receptacle to the laterally displaced output receptacle, the forward direction of motion of each bill being changed only by rotating the leading edge of the bill about a line perpendicular to the forward direction of motion of the bill.

EE. A three-dimensional currency processing device lying in a space defined by three perpendicular axes, namely, a first axis, a second axis, and a third axis, comprising:

an input receptacle adapted to receive a stack of bills to be processed, the input receptacle holding the stack of bills such that individual bills lie in a plane generally normal to a plane defined by the first and the second of said axes, the plane defined by the first and second axes being plane 1;

at least one an output receptacle adapted to receive and stack bills after said bills have been processed, the output receptacle holding the stacked bills such that individual bills lie in a plane generally normal to a plane 1, the output receptacle being displaced laterally from the input receptacle along the third axis, a second plane being defined by the second and third axes; and a transport mechanism adapted to move bills from the input receptacle to the output receptacle such that when a bill is being moved along the third axes it lies in a plane generally normal to the second plane;

wherein a bill orientation is changed from being generally normal to the first plane to being generally normal to the second plane by rotating the bill only about a line generally parallel to the direction of motion of the bill.

FF. A currency processing device having an input receptacle and at least one output receptacle, the at least one output receptacle being laterally displaced from the input receptacle along a first axis, the first axis defining a left and a right direction, the space in which the device resides being defined by the first axis and two additional mutually perpendicular axes including a second vertical axis, the first left/right axis and the second vertical axis defining a first plane, the device having a transport mechanism adapted to move bills from the input receptacle to the laterally displaced output receptacle such that whenever the bill is moving in a direction having a lateral component, the bill is maintained in a plane generally normal to the first plane.

GG. A currency processing device having an input receptacle and at least one output receptacle, the output receptacle being laterally displaced from the input receptacle along a first axis, the first axis defining a left and a right direction, the input receptacle being adapted to receive a stack of bills to be processed, each bill being rectangular and having a long dimension and a narrow dimension and two long edges and two narrow edges, the device having a transport mechanism adapted to move bills in a forward direction such that one of the long and narrow dimensions of each bill is generally perpendicular to the forward direction and the other of the long and narrow dimensions is generally parallel to the forward direction of each bill, the forward direction defining a leading edge of the bill, the transport mechanism moving the bills from the input receptacle to the laterally displaced output receptacle while maintaining the same leading edge of a bill, the direction of motion of the leading edge of each bill being changed only by rotating the leading edge of the bill about a line generally perpendicular to the leading edge of the bill and the orientation of a bill being changed only by rotating the bill about a line generally parallel to the forward direction of motion of the bill.

HH. A currency processing device having an input receptacle and at least one output receptacle, the output receptacle being laterally displaced from the input receptacle along a first axis, the first axis defining a left and a right direction, the space in which the device resides being defined by the first axis and two additional mutually perpendicular axes, the device having a transport mechanism adapted to move bills from the input receptacle to the laterally displaced output receptacle by rotating the bills only about lines generally parallel to one of the three axes.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A currency processing device for receiving a stack of currency bills and rapidly processing the bills in the stack, the device comprising:

an input receptacle positioned to receive a stack of bills to be processed, the bills having a leading edge and a trailing edge;

a stacking unit comprising a plurality of output receptacles for receiving bills after the bills have been processed, the output receptacles arranged such that the output receptacles are laterally offset of the input receptacle;

a transport mechanism for transporting the bills, one at a time, from the input receptacle to the output receptacles while maintaining the same edge of a bill as leading throughout the transportation of the bill between the input and output receptacles;

a discriminating unit comprising at least one detector positioned between the input receptacle and the output receptacles, the detector generating at least one output signal used to count and to determine the denomination of the bills; and a housing adapted to hold the input receptacle, the stacking unit, the transport mechanism, and the discrimination unit, the housing having a front side, a back side, a right side and a left side;

wherein the stacking unit is hingedly connected to the left side or the right side of the housing, and the discriminating unit is slidably moveable away from the front side and the back side of the housing towards a front of the device.

2. The currency processing device of claim 1, wherein the transport mechanism has at least a first, second, and third transport paths, the first transport path having a bill rotating mechanism for rotating the currency bills a around an axis passing through the leading and trailing edges of the currency bills and approximately orthogonal to the those edges so that the leading edge of a currency bill exiting the first transport path is aligned with the second path, the first transport path transports the bills generally in the vertical direction, the second transport path transports the bills generally in the horizontal direction, the third transport path having a bill rotating mechanism for rotating the currency bills, around an axis passing through the leading and trailing edges of the currency bills and approximately orthogonal to the those edges so that the leading edge of a currency bill exiting the third transport path is aligned with the stacking unit, the third transport path transports the bills generally in the vertical direction.

3. The currency device of claim 1, wherein the plurality of output receptacles includes a plurality of output receptacles laterally offset to the left of the input receptacle.

4. The currency processing device of claim 1, wherein the plurality of output receptacles includes a plurality of output receptacles laterally offset to the right of the input receptacle.

5. The currency processing device of claim 1 further comprising at least one USB port.

6. The device of claim 2 wherein the bill rotating mechanisms each comprise a two-belt currency bill rotating mechanism.

7. A currency processing device for receiving a stack of currency bills and rapidly processing the bills in the stack, the device comprising:

an input receptacle positioned to receive a stack of bills to be processed, the bills having a leading edge and a trailing edge;

a first stacking unit comprising a first plurality of output receptacles for receiving bills after the bills have been processed, the output receptacles arranged such that the output receptacles are laterally offset of the input receptacle;

a second stacking unit comprising a second plurality of output receptacles for receiving bills after the bills have been processed, the output receptacles arranged such that the output receptacles are laterally offset of the input receptacle and the first plurality of output receptacles;

a transport mechanism adapted to transport the bills, one at a time, from the input receptacle to the output receptacles while maintaining the same edge of a bill as leading throughout the transportation of the bill between the input and output receptacles;

a discriminating unit comprising at least one detector positioned between the input receptacle and the output receptacles, the detector generating at least one output signal used to count and to determine the denomination of the bills; and a housing for the input receptacle, plurality of output receptacles, transport mechanism, and discrimination unit, the housing having a front side, a back side, a right side and a left side;

wherein the first plurality of output receptacles is hingedly connected to a side of the housing, and the discriminating unit is slidably moveable away from the front side and the back side of the housing towards a front of the device.

8. The currency processing device of claim 7 in which the first and second plurality of output receptacles are laterally offset to the left of the input receptacle.

9. The currency processing device of claim 7 in which the first and second plurality of output receptacles are laterally offset to the right of the input receptacle.

10. The currency processing device of claim 7 wherein the device a width of about 44 inches, a depth of about 30 inches, and a height of about 29 inches.

11. The currency processing device of claim 7 wherein the device has a footprint of less than about 1300 in.$^2$.

12. A method for rapidly moving currency bills from a stack of bills placed in an input receptacle of a currency processing device to a stacking unit having a plurality of output receptacles laterally offset from the input receptacle in the device for creating a stack of a pre-determined number of currency bills of a particular denomination, the method comprising the acts of:

removing bills from the stack one at a time;

moving the bills removed from the stack away from the input receptacle along a first transport path;

examining the bills, including counting and denominating the bills;

rotating the bills approximately 90° around an axis extending approximately orthogonally through the leading and trailing edges of the bills; and moving the rotated bills laterally along a second transport path in the direction in which the output receptacles are offset from the input receptacle;

rotating the bills a second time approximately 90° around an axis extending approximately orthogonally through the leading and trailing edges of the bills so that the bills are aligned to the stacking unit;

delivering the bills to the output receptacles laterally offset from the input receptacle along a third transport path based on the act of examining;

tracking the number of bills delivered to an output receptacle corresponding to a particular denomination;

wherein, upon the act of tracking reaching a pre-determined number of currency bills;

a) halting the removing of bills from the stack when the act of examining indicates the pre-determined number of bills of the particular denomination is reached;

b) determining the location of any additional bills of the particular denomination in the transport paths after the act of halting of the act of removing from the stack;

c) transporting the bills in the transport paths between the pre-determined number of bills of the particular denomination and the first additional bill of the particular denomination to the output receptacles after the act of halting;

d) stopping the act of transporting of bills in the transport paths before the first additional bill of the particular denomination is delivered to an output receptacle.

13. The method of claim 12 further comprising the act of restarting the acts of moving and the act of removing after the pre-determined number of bills of the particular denomination have been removed from the output receptacle.

14. The method according to claim 12 wherein the act of examining further comprises the act of authenticating the bills.

15. The method according to claim 12 wherein the examining is performed before the bills are rotated.

16. The method of claim 12 wherein the acts of rotating comprise rotating bills using a two-belt currency bill rotating mechanism.

17. A method for rapidly moving currency bills from a stack of bills placed in an input receptacle of a currency processing device to a stacking unit having a plurality of output receptacles laterally offset from the input receptacle in the device for creating a stack of a pre-determined number of currency bills of a particular denomination, the method comprising the acts of:

removing bills from the stack one at a time;

moving the bills removed from the stack away from the input receptacle along a first transport path;

examining the bills, including counting and denominating the bills;

rotating the bills approximately 90° around an axis extending approximately orthogonally through the leading and trailing edges of the bills; and moving the rotated bills laterally along a second transport path in the direction in which the output receptacles are offset from the input receptacle;

rotating the bills a second time approximately 90° around an axis extending approximately orthogonally through the leading and trailing edges of the bills so that the bills are aligned to the stacking unit;

delivering the bills to the output receptacles laterally offset from the input receptacle along a third transport path based on the act of examining;

tracking the number of bills delivered to an output receptacle corresponding to a particular denomination until a bill n corresponding to the pre-determined number of bills of the particular denomination is delivered;

wherein, upon the act of tracking reaching bill n;

a) halting the act of removing from the stack when the act of examining indicates bill n is reached;

b) determining the location of a bill n+x corresponding to a first additional bill of the particular denomination in the transport paths after the act of halting of the act of removing from the stack;

c) transporting the bills in the transport paths between the bill n and the bill n+x to the output receptacles after the act of halting;

d) stopping the act of transporting of bills in the transport paths before bill n+x is delivered to an output receptacle.

18. The method of claim 17 further comprising the act of restarting the acts of moving and the act of removing after the pre-determined number of bills of the particular denomination have been removed from the output receptacle.

19. The method according to claim 17 wherein the act of examining further comprises the act of authenticating the bills.

20. The method according to claim 17 wherein the examining is performed before the bills are rotated.

21. The method of claim 17 wherein the acts of rotating comprise rotating bills using a two-belt currency bill rotating mechanism.

* * * * *